US012084853B2

(12) United States Patent
Cook et al.

(10) Patent No.: US 12,084,853 B2
(45) **Date of Patent: *Sep. 10, 2024**

(54) REINFORCED FLOORS FOR MODULAR BATHROOMS

(71) Applicant: Tile Redi, LLC, Charlotte, NC (US)

(72) Inventors: Joseph R. Cook, Coral Springs, FL (US); David Steadman, Charlotte, NC (US); Saberul Sharker, Elkhart, IN (US)

(73) Assignee: Tile Redi, LLC, Charlotte, NC (US)

( * ) Notice: Subject to any disclaimer, the term of this patent is extended or adjusted under 35 U.S.C. 154(b) by 284 days.

This patent is subject to a terminal disclaimer.

(21) Appl. No.: 17/483,138

(22) Filed: Sep. 23, 2021

(65) Prior Publication Data

US 2023/0098163 A1 Mar. 30, 2023

(51) Int. Cl.

| | |
|---|---|
| ***E04B 1/348*** | (2006.01) |
| ***E04F 15/02*** | (2006.01) |
| ***E04F 15/10*** | (2006.01) |

(52) U.S. Cl.

CPC ..... *E04B 1/34869* (2013.01); *E04B 1/34815* (2013.01); *E04F 15/02188* (2013.01); *E04F 15/10* (2013.01)

(58) Field of Classification Search

CPC .. E04F 15/02188; E04B 1/06; E04B 1/34869; E04H 1/1244; E04H 1/1266; E04H 1/005; E04H 1/1216; A47K 3/284; A47K 3/40; A47K 3/30; A47K 4/00; A47K 11/04

See application file for complete search history.

(56) References Cited

U.S. PATENT DOCUMENTS

| | | | |
|---|---|---|---|
| 423,528 | A | 3/1890 | Hunger et al. |
| 845,526 | A | 2/1907 | Collins |
| 1,017,167 | A | 2/1912 | Pleins |
| 1,017,187 | A | 2/1912 | Swain |
| 1,664,503 | A | 4/1928 | Cornell |
| 1,684,503 | A | 9/1928 | Nilson |
| 1,873,424 | A | 8/1932 | Kerr et al. |
| 1,884,503 | A | 10/1932 | Anthonisen |
| 2,025,814 | A | 12/1935 | Goss |
| 2,031,255 | A | 2/1936 | Deubelbeiss |
| 2,055,173 | A | 9/1936 | Deubelbeiss |
| 2,145,215 | A | 1/1939 | Sakier |
| 2,197,874 | A | 4/1940 | Myers |
| 2,389,724 | A | 11/1945 | Falco |
| 2,394,594 | A | 2/1946 | Cohn |
| 2,400,663 | A | 5/1946 | Tennant |
| 2,400,683 | A | 5/1946 | Burnett |
| 2,449,323 | A | 9/1948 | Richterkessing |
| 2,467,074 | A | 4/1949 | Birdwell et al. |
| 2,487,074 | A | 11/1949 | Schulze et al. |

(Continued)

*Primary Examiner* — Kyle J. Walraed-Sullivan
(74) *Attorney, Agent, or Firm* — Moore & Van Allen PLLC

(57) ABSTRACT

Reinforced floor components of prefabricated bathroom pods. The floor components are reinforced and integrated into bathroom pods or other building units in such a manner as to add significant strength to the bathroom pods to resist bending, twisting and sagging, and/or to aid in lifting and supporting the weight of the bathroom pods, and thereby add to the structural integrity of the prefabricated bathroom pods to which they are attached.

11 Claims, 73 Drawing Sheets

(56) References Cited

U.S. PATENT DOCUMENTS 2,589,592 A 3/1952 Munar
2,636,830 A 4/1953 Wall
2,677,268 A 5/1954 Hobbs
2,757,385 A 8/1956 Whittick
2,836,830 A 6/1958 Norman
2,838,830 A 6/1958 Huggins
2,907,048 A 10/1959 Gould
3,134,197 A 5/1964 Mccolley
3,363,267 A 1/1968 Kaiser et al.
3,501,879 A 3/1970 Graham et al.
3,551,918 A 1/1971 Bergmark
3,605,352 A 9/1971 Ruggles et al.
3,606,617 A 9/1971 Frazier
3,675,384 A 7/1972 Knecht
3,718,365 A 2/1973 Gibson
3,742,525 A 7/1973 Oropallo
3,744,065 A 7/1973 Yavitch
3,800,335 A 4/1974 Buonaura
3,896,511 A 7/1975 Cuschera
3,987,714 A 10/1976 Campbell
3,992,825 A 11/1976 May
4,067,072 A 1/1978 Izzi
4,087,072 A 5/1978 Olsen
4,123,810 A 11/1978 Oropallo
4,146,939 A 4/1979 Izzi
4,261,824 A 4/1981 Cuschera
4,423,526 A 1/1984 Izzi, Sr.
4,423,528 A 1/1984 Wiedmeier
4,446,939 A 5/1984 Oudelaar
4,462,123 A 7/1984 Morris et al.
4,462,129 A 7/1984 Brannock
4,477,934 A * 10/1984 Salminen ..... A47K 4/00 4/596
4,482,123 A 11/1984 Corbeil et al.
4,486,468 A 12/1984 Gray
4,541,132 A 9/1985 Long
4,557,004 A 12/1985 Piana
4,561,134 A 12/1985 Mathews et al.
4,578,832 A 4/1986 Primucci
4,694,513 A 9/1987 Kiziah
4,750,967 A 6/1988 Kott et al.
4,910,611 A 3/1990 Cok
4,910,811 A 3/1990 Izzi, Sr.
4,928,329 A 5/1990 Palmeri
4,938,825 A 7/1990 Macdonald
4,941,218 A 7/1990 Mccartney
4,974,269 A 12/1990 Baus
4,987,619 A 1/1991 Smith
4,993,087 A 2/1991 Roquebrune
4,993,201 A * 2/1991 Bunyard ..... A47K 3/284 4/596
5,080,068 A 1/1992 Sawamoto
5,090,068 A 2/1992 Zellner
5,092,002 A 3/1992 Powers
5,115,604 A 5/1992 Bunyard
5,159,723 A 11/1992 Benedict
5,224,224 A 7/1993 Hintz et al.
5,243,790 A 9/1993 Gagne
5,243,798 A 9/1993 Elliott
5,261,130 A 11/1993 Kendall
5,289,599 A 3/1994 Hintz et al.
5,297,299 A 3/1994 Wilson
5,299,330 A 4/1994 Moore et al.
5,311,707 A 5/1994 Laroche et al.
5,371,980 A 12/1994 Dix
5,435,021 A 7/1995 Williams
5,436,021 A 7/1995 Bodor et al.
5,458,769 A 10/1995 Johannessen
5,473,843 A 12/1995 Laroche et al.
5,546,719 A 8/1996 Maiers et al.
5,619,832 A 4/1997 Myrvold
5,718,008 A 2/1998 Pane
5,742,956 A 4/1998 Tarver
5,845,347 A 12/1998 Young
5,903,937 A 5/1999 Clarke
5,911,518 A 6/1999 Jurek et al.
5,913,777 A 6/1999 Gerber
5,916,662 A 6/1999 Schmidt
5,950,370 A 9/1999 Peck
5,997,009 A 12/1999 Geise
6,003,169 A 12/1999 Davis, Jr.
6,014,780 A 1/2000 Jurek et al.
6,058,659 A 5/2000 Astrom
6,094,757 A 8/2000 Torres
6,138,295 A 10/2000 Hess
6,155,015 A 12/2000 Kirby
6,159,723 A 12/2000 Murakami et al.
6,175,971 B1 1/2001 D'Neill
6,178,571 B1 1/2001 Mcallister
6,240,578 B1 6/2001 Planella
6,301,725 B1 10/2001 Harvey
6,381,773 B1 5/2002 Mcallister
6,571,406 B2 6/2003 Gerloff
6,643,863 B1 11/2003 Gerber
6,687,925 B2 2/2004 Minnick
6,698,037 B2 3/2004 Lipp
6,725,470 B2 4/2004 Webb
6,735,793 B2 5/2004 Peterson
6,766,544 B1 7/2004 Lloyd et al.
6,766,545 B2 7/2004 Hodges
6,777,063 B2 8/2004 Born
6,788,544 B1 9/2004 Barsun et al.
6,851,133 B1 2/2005 Nehring
6,990,695 B2 1/2006 Grayson
6,992,695 B1 1/2006 Simpson et al.
7,005,315 B2 2/2006 Hong et al.
7,007,315 B2 3/2006 Stonecipher
7,026,349 B2 4/2006 Dhanak et al.
7,028,349 B2 4/2006 Helmetsie et al.
7,100,331 B2 9/2006 Nehring
7,100,391 B2 9/2006 Boukas
7,213,274 B2 5/2007 Cotton et al.
7,296,309 B2 11/2007 Nehring
7,296,909 B2 11/2007 Van Deursen et al.
7,562,495 B1 7/2009 Fairchild et al.
7,624,759 B1 12/2009 Smert et al.
7,739,757 B2 6/2010 Witt
7,849,531 B2 12/2010 Rooke et al.
8,112,827 B2 2/2012 Degooyer et al.
8,112,831 B2 2/2012 Cook
8,141,182 B2 3/2012 Cook
8,141,183 B2 3/2012 Cook
8,181,286 B2 5/2012 Cook
8,181,288 B1 5/2012 Davis, Jr.
8,201,287 B2 6/2012 Oetting
8,209,795 B2 7/2012 Cook
8,307,582 B2 11/2012 Cook
8,347,424 B2 1/2013 Wroblewski et al.
8,375,480 B2 2/2013 Cook
8,561,224 B2 10/2013 Cook
8,789,217 B2 7/2014 Cook
8,789,316 B2 7/2014 Cook
8,918,926 B1 12/2014 Herring
9,049,969 B2 6/2015 Cook
9,107,545 B1 8/2015 Herring
9,167,940 B2 10/2015 Cook
9,357,884 B2 6/2016 Cook
9,366,017 B2 6/2016 Cook
9,510,712 B2 12/2016 Cook
9,770,139 B2 9/2017 Cook
9,770,140 B2 9/2017 Cook
9,775,472 B1 10/2017 Herring
11,149,429 B2 * 10/2021 Gomo ..... E03F 5/06
11,406,228 B2 8/2022 Cook
2001/0052148 A1 12/2001 Hasenkopf
2002/0066140 A1 6/2002 Gerloff
2003/0033668 A1 2/2003 Pane
2003/0089059 A1 5/2003 Kirby
2004/0034922 A1 2/2004 Grayson
2004/0205890 A1 10/2004 Smale
2004/0237187 A1 12/2004 Stonecipher
2005/0028270 A1 2/2005 Nehring
2005/0050628 A1 3/2005 Mascheroni
2005/0081290 A1 4/2005 Stimpson

(56) References Cited

U.S. PATENT DOCUMENTS

2005/0210577 A1 9/2005 Sisk
2005/0283900 A1 12/2005 Campbell
2006/0026752 A1 2/2006 Torres
2006/0066140 A1 3/2006 Kirk
2006/0183387 A1 8/2006 Taylor et al.
2006/0213006 A1 9/2006 Rush et al.
2006/0222793 A1 10/2006 Kashimura et al.
2006/0222796 A1 10/2006 Morris
2007/0042828 A1 2/2007 Krushke et al.
2007/0266491 A1 11/2007 Gann
2008/0016614 A1 1/2008 Daniels
2008/0148474 A1 6/2008 Witt
2008/0196155 A1* 8/2008 Stimpson ..... A47K 3/405 4/605
2008/0222785 A1 9/2008 Irizarry-Lugo
2008/0222790 A1 9/2008 Grant
2008/0222793 A1 9/2008 Cook
2008/0222794 A1 9/2008 Cook
2008/0222795 A1 9/2008 Cook
2008/0222796 A1 9/2008 Cook
2008/0222797 A1 9/2008 Cook
2008/0222891 A1 9/2008 Cook
2008/0229494 A1 9/2008 Degooyer et al.
2009/0100769 A1 4/2009 Barrett et al.
2009/0241256 A1 10/2009 Tempas et al.
2009/0241258 A1 10/2009 Cook
2009/0260151 A1* 10/2009 Graber ..... A47K 3/30 4/599
2009/0307835 A1 12/2009 Anastasi Vavvessi
2010/0024107 A1 2/2010 Stimpson
2010/0043136 A1 2/2010 Michael
2010/0263168 A1 10/2010 Hsieh
2010/0263188 A1 10/2010 Cook
2010/0281612 A1* 11/2010 Cook ..... A47K 3/008 52/302.6
2010/0325969 A1* 12/2010 Hourihan ..... A47K 3/008 52/287.1
2011/0197351 A1 8/2011 Cook
2011/0197355 A1 8/2011 Lemire
2012/0036629 A1 2/2012 Cook
2012/0036630 A1 2/2012 Cook
2012/0036631 A1 2/2012 Cook
2012/0036632 A1 2/2012 Cook
2012/0036697 A1 2/2012 Cook
2012/0272449 A1* 11/2012 Wedi ..... E04F 15/02188 4/613
2012/0278989 A1 11/2012 Cook
2013/0097944 A1* 4/2013 Van Ravenhorst ... E04F 13/165 52/745.13
2013/0276226 A1 10/2013 Cook et al.
2014/0033424 A1 2/2014 Cook
2014/0041112 A1 2/2014 Cook
2014/0175700 A1 6/2014 Cook
2015/0208876 A1 7/2015 Salvatori
2020/0214510 A1 7/2020 Brill et al.
2020/0229654 A1* 7/2020 Paradis ..... E04C 2/246
2022/0192433 A1 6/2022 Cook

* cited by examiner

REINFORCED FLOORS FOR MODULAR BATHROOMS

TECHNICAL FIELD

The present invention relates generally to showers, bathroom floors and other drainable structures that are part of a prefabricated bathroom pod construction or other similar types of modular building units, and more particularly to pod bathroom floors where the pod bathroom floor is reinforced and integrated into the bathroom pod or other building unit in such a manner as to add significant strength to the bathroom pod to resist bending, twisting and sagging, and/or to aid in lifting and supporting the weight of the bathroom pod floors and walls.

BACKGROUND

Most bathroom shower enclosures are created using complicated construction methods. For example, using conventional techniques, a skilled installer frames out the area to be enclosed using two-by-four wooden, steel or aluminum studs to create a shower enclosure space. Felt or tar paper is then laid over a subfloor area enclosed within the space. A flexible, leak-proof liner is installed on top of the felt or tar paper and attached to the frame. Next, the installer attaches dry wall boards to the framing studs, creating shower sidewalls. A hole is cut in the liner to allow for a drain, and a layer of mortar is applied to the shower sidewalls and curb and allowed to cure. Additional mortar is applied on top of the leak-proof liner and hand-shaped to form a shower floor which slopes toward the drain such that water from the shower flows toward the drain. After the mortar has cured, shower tile is applied to the floor and sidewalls to create the finished enclosure.

The process of creating an enclosed shower in this manner is time-consuming and requires experience, knowledge and skill in order to maintain the proper pitch and uniformity in shaping the floor. Irregularities in the pitch of the floor can cause water from the shower not to drain properly or make tiling the shower enclosure difficult. The liners are also susceptible to punctures or leaks and may be difficult for the installer to properly form square corners at the intersection of the shower sidewalls and floor. Additionally, the mortar layer used to create the floor is necessarily thick in order to form a sloped surface, therefore the time required for the floor to cure before applying tile may be quite long (e.g., greater than 24 hours). As a result, construction projects that require a multitude of showers or bathrooms to be fabricated such as residential complexes, hotels, and hospitals will be more expensive and take longer due to the required labor.

In recent years, to decrease this cost especially for the aforementioned commercial applications, the process of shower installation has been vastly improved by the introduction of prefabricated shower bases used for forming the shower floor. Use of these prefabricated shower bases significantly decreases the amount of time and skill required to construct a bathroom shower enclosure, as well as providing more of a consistent and reliable flooring surface upon which to apply floor coverings. These shower bases are pre-constructed molded units having a sloping floor, an integrated drain, curb, sidewalls, and a horizontal surface on the top of each sidewall for receiving drywall such that the drywall surface is substantially flush to the shower base sidewalls. Installation of the shower base involves securing a section of drain pipe to the drain, applying adhesive and sealing material to the sub floor where the base will rest, and seating the base on the subfloor. Tile can then be applied directly to the shower walls and shower base without the need for first applying mortar.

Other improvements in the construction process have included the provision of entire prefabricated bathroom pods, that are assembled off-site and installed in a building under construction to decrease the cost of labor when building suites in the aforementioned commercial applications.

However, more than just prefabricated shower components are needed to create prefabricated bathroom pods. In particular, there exists a need to make the entire bathroom floor a monolithic and fortified component of such pods that are sturdy enough to withstand the weight and forces exerted on the bathroom floor and other pod components during fabrication, lifting, transport and installation, without fear of damage occurring to the bathroom floor or another part of the prefabricated bathroom pod.

Bathroom pod construction is a new and growing competitive construction segment which has certain advantages over conventional construction methods, particularly in large new built projects. Bathroom pod manufacturers have been successful in eliminating many deficiencies associated with traditional bathroom construction methods undertaken in the field on a construction site by having pod company employees responsible for all or substantially all of the construction and assembly of a pod in a factory setting. When the bathroom pod is finished, it is shipped to a construction site where it is lifted and then installed in the structure as a finished bathroom.

The factory environment allows significantly more oversight and control over how and when a pod is manufactured, including sequencing different groups of pod employees based upon when their trade expertise is required. Pod supervisors are also readily available to oversee real time work quality, sequencing and scheduling.

With all employees working for the pod manufacturer, the pod employees avoid many of the friction occurring on a traditional construction site between and among different trades present in traditional construction, including, among other things, one trade intentionally or recklessly negatively impacting finished work of another trade.

Bathroom pod manufacturers have introduced meaningful innovation in the construction of bathrooms. However, that innovation has not, for the most part, trickled down to the construction of pod bathroom floor components. Currently, portions of the pod bathroom floor are still being manufactured in much the same way that bathroom floors have been manufactured for years in conventional construction. Bathroom pods are still installed with basic substrates on which pod floors are assembled and installed using a series of off-the-shelf bathroom products which basically mimics traditional (i.e., non-modular) construction practices. Consequently, pod bathroom floors share many of the same headaches and drawbacks associated with traditional construction, along with several additional meaningful drawbacks that are uniquely attributable to pod construction. For example, since pods are manufactured in a factory, they must be shipped from the factory to the construction site and then placed on substrates in buildings with any number of stories. Heretofore, the interconnections between bathroom pod floors and the walls of the pod have not employed independent weight bearing substrates or anti-torsional features which prevent pod floors and/or walls from twisting, bending, sagging and/or otherwise potentially compromising the installed floor and wall coverings, causing them to loosen or dislodge from the pod floor and/or walls when the completed pod is installed on a traditional construction site substrate.

SUMMARY OF THE DISCLOSURE

With the introduction of the herein disclosed new reinforced pod bathroom floor systems, the bathroom pod industry will now have a one-piece pod flooring system which will revolutionize how the bathroom pod industry manufactures bathroom pod floors. Most importantly, the one-piece pod bathroom floor systems provide a full menu of custom solutions for the bathroom pod industry which are not otherwise available and will save significant time and cost. The inventions set forth in this application address many of the thorny issues currently plaguing the bathroom pod manufacturers related to the bathroom pod component. Specifically, the pod bathroom floor component described herein not only provides one or more bathroom shower floors, it also provides all the other bathroom floor structures which include but are not limited to one or more flat bathroom areas, one or more non-shower pitched bathroom wet areas, one or more dry pitched bathroom areas, the entrance to the bathroom, along with any custom size bathroom floor component required, while also having the pod bathroom floor entrance component fit into a shallow substrate slab recess (for example, 1.5"), thereby avoiding the excessive costs of recessing the slab even more. Most importantly, all of the above is contained in a one-piece bathroom floor component, which has adequate independent weight bearing floor capabilities as well as being resistant to sagging, bending, twisting and other deformations, and in some embodiments also has pod wall weight bearing capabilities, so the bathroom pod manufacturer can order and receive a one piece pod bathroom floor component which can be assembled with the pod wall panels in a very short period of time (e.g., less than 45 minutes).

A prefabricated bathroom pod according to an embodiment of the present disclosure may comprise a plurality of wall studs supporting wall panels, a ceiling structure, electrical wiring, plumbing (as well as associated accessories), and a bathroom floor component including one or more plastic and/or foam members, the bathroom floor component being characterized as being encapsulated in a waterproof covering or membrane. The walls may connect the ceiling to the bathroom floor component, the electrical wiring may be attached to at least one of the plurality of walls and/or the ceiling, and the plumbing may be attached to at least one of the plurality of walls and/or the bathroom floor component. Thereafter, wall coverings and floor coverings may be applied to the bathroom pod walls and floor.

A prefabricated bathroom pod according to another embodiment of the present disclosure may comprise a plurality of wall studs supporting wall panels, a ceiling structure, electrical wiring, plumbing (as well as associated accessories, if any), and a bathroom floor component including at least a first elongated frame member that is adhered to one or more plastic or foam floor members, the bathroom floor component being characterized as being either encapsulated in a waterproof covering or membrane or comprising one or more closed cell floor panels which are not encapsulated in a waterproof covering The walls may connect the ceiling to the bathroom floor component, the electrical wiring may be attached to at least one of the plurality of walls and/or the ceiling, and the plumbing may be attached to at least one of the plurality of walls and/or the bathroom floor component. Thereafter, wall coverings and floor coverings may be applied to the bathroom pod walls and floor.

A bathroom floor component according to an embodiment of the present disclosure may comprise one or more floor edge strengthening peripheral members, one or more cross-brace trasverse floor strengthening members, and one or more plastic and/or foam members. The one or more edge floor strengthening peripheral members may be joined to the one or more cross-brace trasverse floor strengthening members, defining one or more pockets, and at least one of the plurality of foam and plastic materials members may be disposed in each of the one or more pockets.

A method of fabricating and using a bathroom floor component according to an embodiment of the present disclosure may comprise positioning one or more foam and/or plastic members that are spaced apart from each other, creating a peripheral framework that may include a plurality of floor edge strengthening members forming an enclosed perimeter around all of the one or more foam and/or plastic floor members, providing a plurality of cross-brace transverse floor strengthening members between the two or more foam and/or plastic floor members, and attaching each of the one or more foam and/or plastic floor members to at least one of the plurality of edge peripheral members, and/or to at least one of the plurality of cross-brace transverse strengthening members.

A prefabricated bathroom pod according to another embodiment of the present disclosure may comprise a ceiling, a floor component, a plurality of walls, electrical wiring and plumbing accessories. An improvement for such a bathroom pod may comprise a bathroom floor component including a perimeter raised platform strengthening member, which defines one or more of a planar upper surface and planar lower surface, defining an outer perimeter of the bathroom floor component, and a foam and/or plastic floor member surrounded by the perimeter peripheral member. The foam and/or plastic floor member may define a drain aperture, and at least a first top surface all or a portion of which is sloped toward the drain aperture. The foam and/or plastic floor member may be a single monolithic member or may be comprised of a plurality of separate floor members, which may or may not be separated by, and attached to, one or more cross-brace transverse strengthening members. In embodiments, the perimeter raised platform strengthening member may be adapted to strengthen the floor component and attach to and support the plurality of bathroom pod walls.

In embodiments, an improvement to this arrangement may include one or more of a rectangular wall frame member and a U-shaped channel forming a lower edge of the bathroom walls, with both the U-shaped channel and the rectangular shaped frame member sized and shaped to mate with the planar upper surface of the raised platform strengthening member, and one or more fasteners adapted to pass through the raised platform strengthening member and one or more of the U-shaped channel and the wall frame member to connect the floor component to the walls of the pod. The raised platform can be substantially the same width as the wall studs 110, or substantially the same width as the wall studs 110 with shower board attached to it, or narrower or wider than both of these two widths, based on the customer needs or other design criteria.

In other embodiments, an improvement to this arrangement may include one or more of a rectangular wall frame member and a U-shaped channel forming a lower edge of the bathroom walls, with both the U-shaped channel and the rectangular shaped frame member sized and shaped to mate with the planar upper surface of the raised platform strengthening member, where wallboard (e.g., sheet rock) is associated with the pod walls, the width of the planar upper surface of the raised platform strengthening member being at least as wide as the combined widths of the wallboard and the U-shaped channel or the rectangular shaped frame member, and further comprising one or more fasteners adapted to pass through the raised platform strengthening member and one or more of the U-shaped channel and the wall frame member to connect the floor component to the walls of the pod.

In still other embodiments, an improvement to this arrangement may include one or more transverse bars, straps or metal frames associated with the bottom side of the bathroom floor component. The transverse bars, straps or metal frame may define one or more apertures adapted to align with corresponding apertures defined by said perimeter raised platform strengthening member, said one or more fasteners adapted to pass through the apertures in the strengthening bars/straps/metal frame, said raised platform strengthening member and the one or more of the U-shaped channel and the wall frame member to connect the floor component to the walls of the pod.

A bathroom floor component according to another embodiment of the present disclosure may comprise one or more foam and/or plastic floor members, a raised platform strengthening member including a top planar surface, the raised platform strengthening member at least partially surrounding the one or more foam and/or plastic floor members, an outer wall of the raised platform strengthening member defining an outer perimeter of the bathroom floor component, the raised platform strengthening member also defining an inner wall and a bottom surface. A strengthening border member may be disposed between the one or more foam and/or plastic floor members and the raised platform strengthening member. The one or more foam and/or plastic floor members may define a drain aperture and include at least a first top surface all or a portion of which slopes toward the drain aperture.

In embodiments, the raised platform strengthening member is reinforced by weight-bearing, anti-compression elements. In embodiments, the floor panels may consist of a single, closed cell panel as the only floor panel for the bathroom floor component. In embodiments, such single closed cell panel may also be the only panel used with a raised pod wall support platform.

A method of fabricating and using a bathroom floor component according to yet another embodiment of the present disclosure may comprise machining a foam and/or plastic floor member having at least one sloped surface extending downwardly toward a drain aperture, further machining from the same piece of foam and/or plastic a raised platform strengthening member at least partially surrounding the floor member, the raised platform strengthening member adapted to be placed in registry with the pod walls to at least partially support the weight of the pod walls. The raised platform strengthening member may be provided with apertures suited to receiving fasteners to connect the bathroom floor component to lower ends of the pod walls. The method of fabricating in this embodiment comprises encapsulating the entirety of the bathroom floor component in a waterproof layer.

A method of fabricating and using a bathroom floor component according to another embodiment of the present disclosure may comprise machining a foam and/or plastic floor member having at least one sloped surface extending downwardly toward a drain aperture, further machining from the same piece of foam and/or plastic a raised platform strengthening member at least partially surrounding the floor member, the raised platform strengthening member adapted to be placed in registry with the pod walls to at least partially support the weight of the pod walls, machining voids in the raised platform strengthening member adapted to receive anti-compression elements which will serve to support some or all of the weight of the pod walls, and associating the anti-compression elements with the voids. The raised platform strengthening member and/or the anti-compression elements may be provided with apertures suited to receiving fasteners to connect the bathroom floor component to lower ends of the pod walls. The method of fabricating in this embodiment comprises encapsulating the entirety of the bathroom floor component in a waterproof layer.

A method of fabricating and using a bathroom floor component according to a still further embodiment of the present disclosure may comprise machining one or more plastic and/or foam floor members with a contour, providing one or more transverse strengthening members and one or more peripheral strengthening members, associating the foam and/or plastic floor members with the one or more transverse strengthening members and the one or more peripheral strengthening members, and attaching the foam and/or plastic floor members to the one or more transverse strengthening members and the one or more peripheral strengthening members.

A method of fabricating and using a bathroom floor component according to another embodiment of the present disclosure may comprise machining one or more foam and/or plastic floor members, providing one or more transverse strengthening members, associating the foam and/or plastic floor members with the one or more transverse strengthening members, and attaching the foam and/or plastic floor members to the one or more transverse strengthening members A still further method comprises providing a raised peripheral support platform around at least a portion of a periphery of the two or more foam and/or plastic floor members.

In some embodiments, an even further method comprises the provision of a reinforcing member such as a metal frame associated with, and supporting an underside of, the raised peripheral support platform and/or the underside of one or more portions of floor of the bathroom floor component In embodiments, the bathroom floor component is encapsulated in a waterproof shell on some or all sides, which adds to the strength and water imperviousness thereof.

A prefabricated bathroom pod according to another embodiment of the present disclosure may comprise a ceiling, a plurality of walls, and electrical wiring and plumbing accessories, as well as a bathroom floor component supported by a support substrate. In one embodiment, the floor component that is supported by the substrate is encapsulated in a waterproof shell. In another embodiment, the floor component and a portion or all of the substrate are both encapsulated in a waterproof shell. In a third embodiment, the floor component, the floor substrate and a raised peripheral platform are all encapsulated in a waterproof shell. In a forth embodiment, the floor component includes a support frame, where one or more portions of the support frame may be encapsulated in a waterproof shell and/or one or more portions may not be so encapsulated.

In still further embodiments, a bathroom floor component of prefabricated bathroom pod may be comprised of a single bathroom floor panel which is made of a material that is impervious to water, such as closed cell foam or polyethelene. In such embodiments, a single closed cell floor panel could be used for the bathroom floor, which would not necessarily need to be encapsulated in a waterproof shell, although encapsulating the floor component in a waterproof shell could optionally be done.

BRIEF DESCRIPTION OF THE DRAWINGS

FIGS. 24-26B depict a fifth embodiment of the invention, which is substantially the same as the embodiment shown in FIGS. 19-23 but with a single-panel floor member.

FIG. 24 is a perspective exploded view of a fifth embodiment of the invention.

FIG. 25 is a bottom plan view of the bathroom floor component of FIG. 24.

FIG. 26B is a bottom plan view of the bathroom floor component of FIGS. 24 and 25 after being coated with a waterproof membrane.

DETAILED DESCRIPTION

Figure 1:
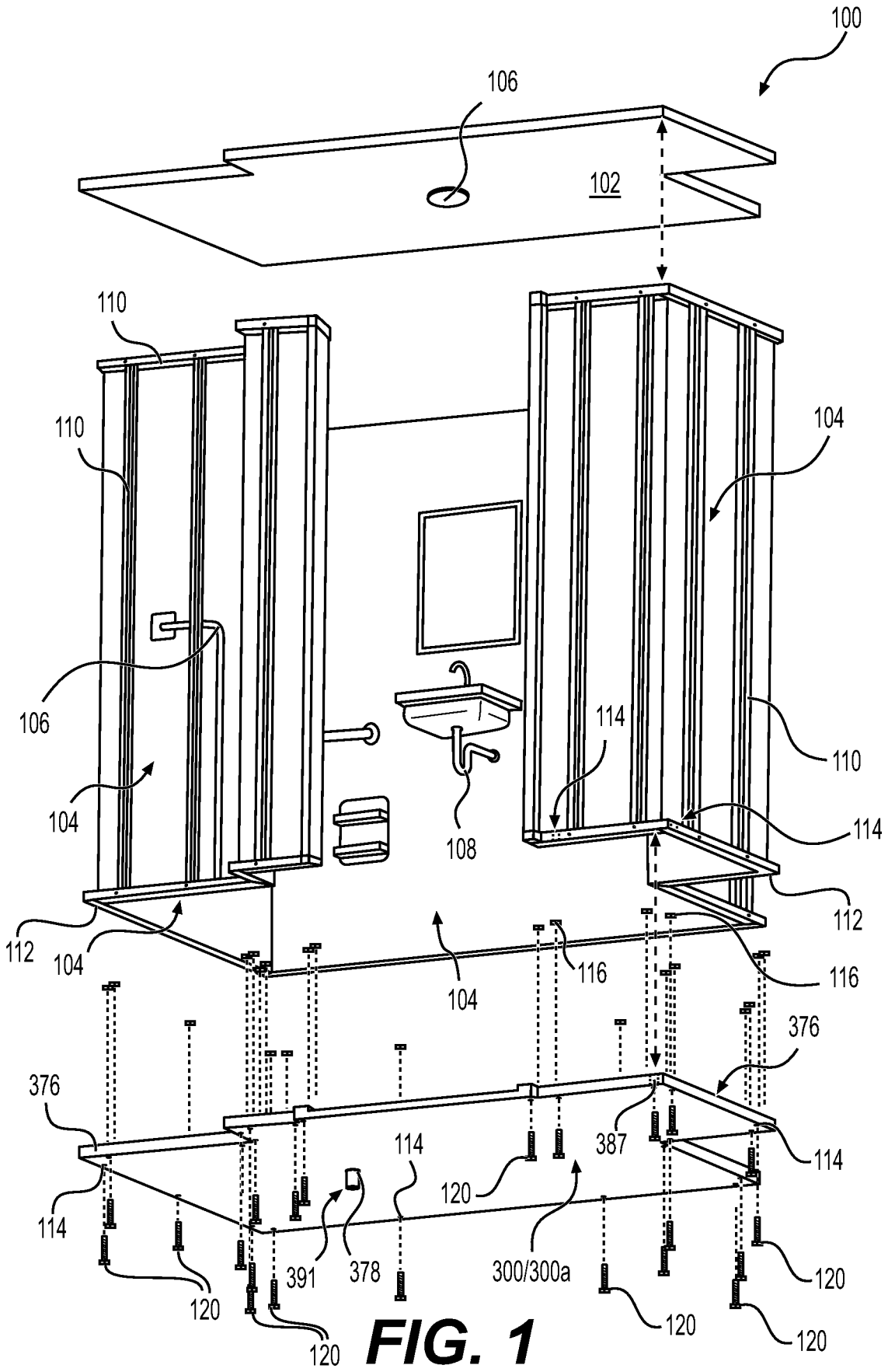
FIG. 1 is a bottom exploded perspective view of a bathroom pod constructed with a prefabricated bathroom floor component according to a first embodiment of the present disclosure.
Figure 2A:
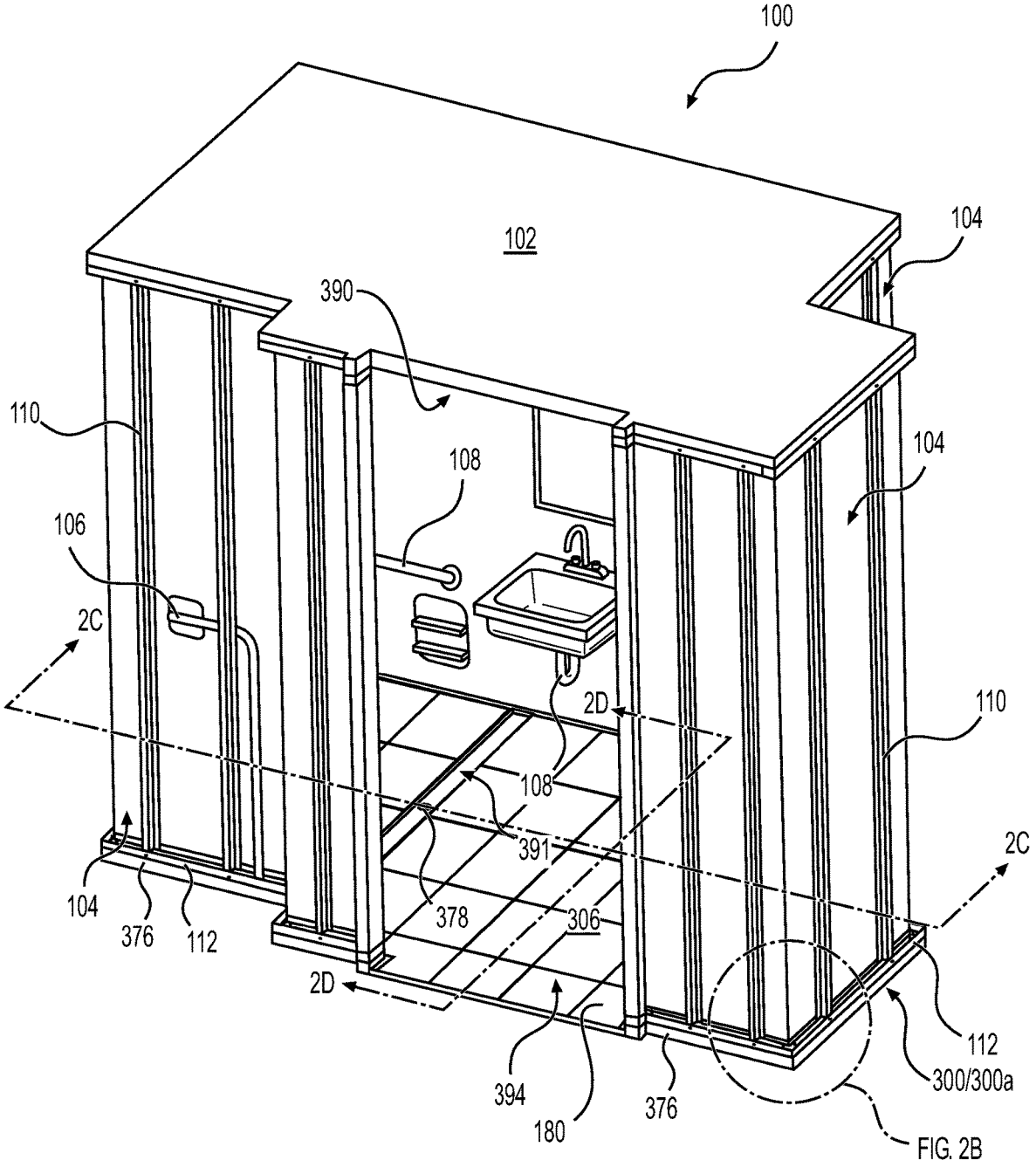
FIG. 2A is a top perspective assembled view of the bathroom pod of FIG. 1 constructed with a prefabricated bathroom floor component of FIG. 4A.
Figure 2B:
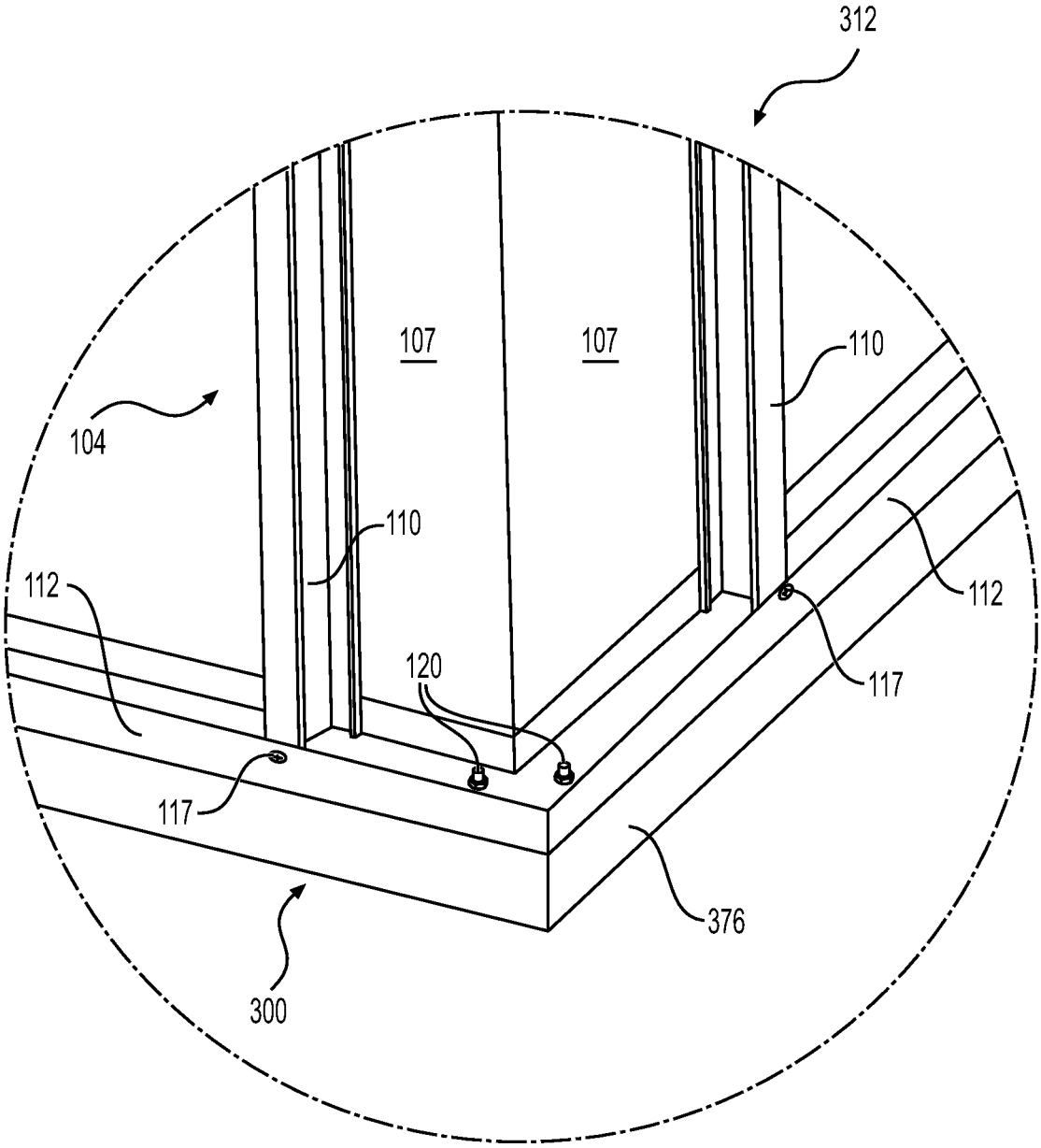
FIG. 2B is an enlargement of the area of detail shown in FIG. 2A, showing a corner of the prefabricated bathroom floor component fastened to the walls of the bathroom pod.
Figure 2C:
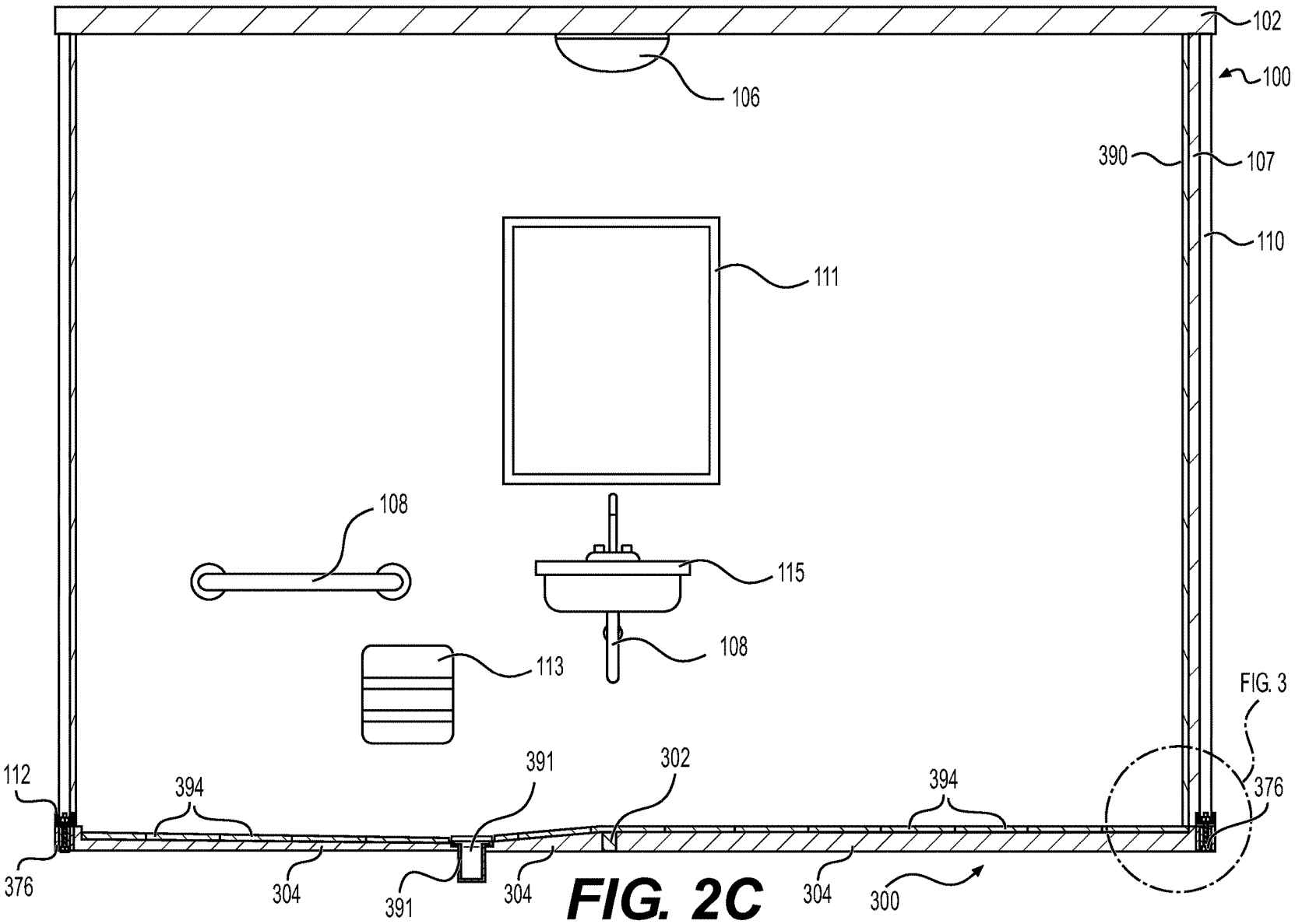
FIG. 2C is a front elevational sectional view of the bathroom pod of FIG. 2A, taken along lines 2C-2C thereof.
Figure 2D:
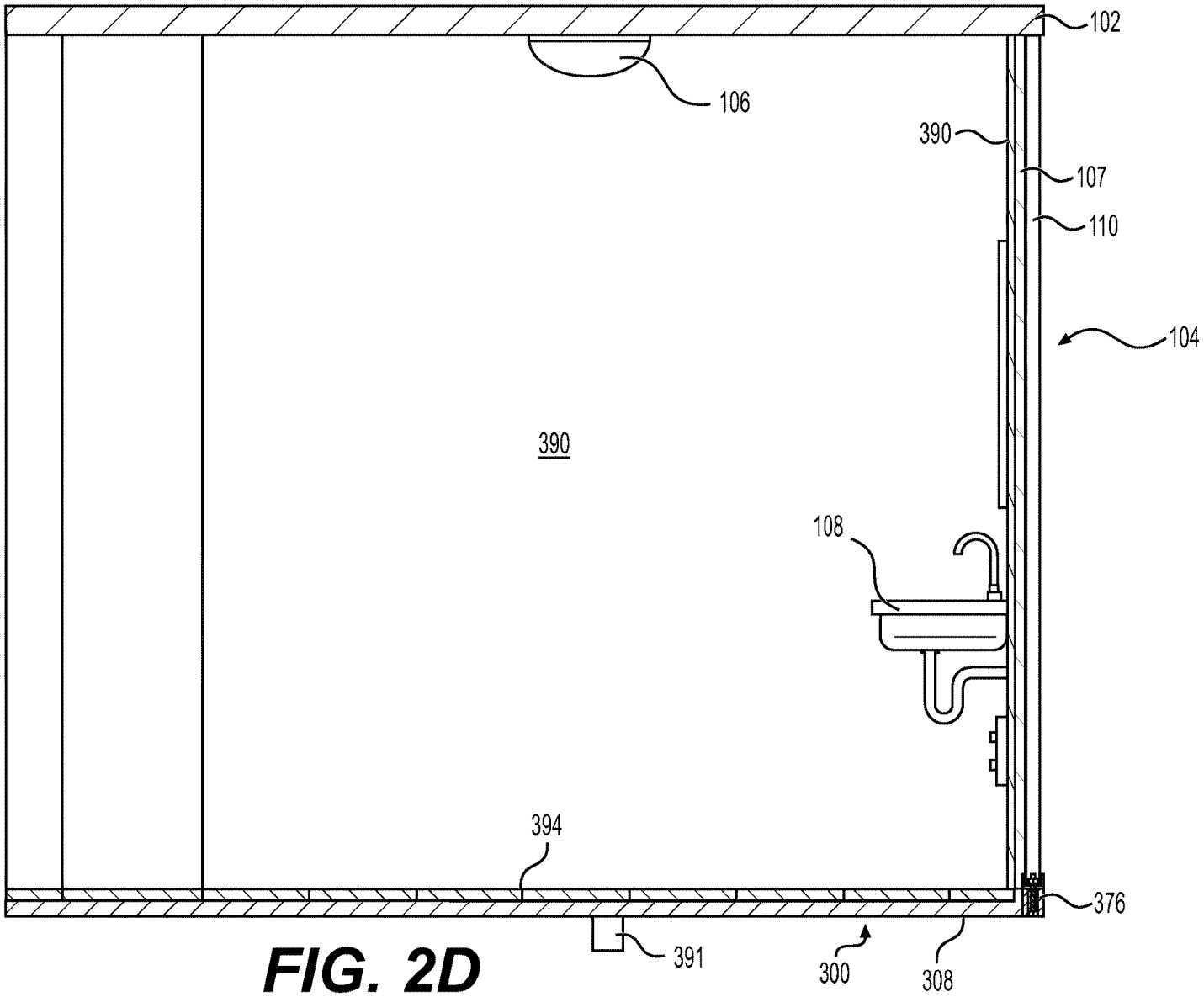
FIG. 2D is a side elevational sectional view of the bathroom pod of FIG. 2A, taken along lines 2D-2D thereof.

Reference will now be made in detail to embodiments of the disclosure, examples of which are illustrated in the accompanying drawings. Wherever possible, the same reference numbers will be used throughout the drawings to refer to the same or like parts. In some cases, a reference number will be indicated in this specification and the drawings will show the reference number followed by a letter for example, 100*a*, 100*b* or a prime indicator such as 100', 100" etc. It is to be understood that the use of letters or primes immediately after a reference number indicates that these features are similarly shaped and have similar function such as is often the case when geometry is mirrored about a plane of symmetry. For ease of explanation in this specification, letters or primes will often not be included herein but may be shown in the drawings to indicate duplications of features discussed within this written specification.

Accordingly, the apparatus components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

The embodiments of the present disclosure typically include combinations of structural components and manufacturing, installation and use steps related to the creation of a variety of bathroom floors including shower floors that may be used in a bathroom floor component or the like.

In this document, relational terms, such as "first" and "second," "top" and "bottom," and the like, may be used solely to distinguish one entity or element from another entity or element without necessarily requiring or implying any physical or logical relationship or order between such entities or elements.

The terms "comprises," "comprising," "comprise", "including", "include" or any other variation thereof are intended to cover a non-exclusive inclusion, such that a process, method, article, or apparatus that comprises a list of elements need not necessarily include only those elements, but may include other elements not expressly listed or inherent to such process, method, article, or apparatus.

The term "plurality of" as used in connection with any object or action means two or more of such objects or actions.

As used herein, the articles "a" and "an" are intended to include one or more items, and may be used interchangeably with "one or more." Where only one item is intended, the term "one" or similar language is used. Also, as used herein, the terms "has", "have", "having", "with" or the like are intended to be open-ended terms. Further, the phrase "based on" is intended to mean "based, at least in part, on" unless explicitly stated otherwise.

Terms such as "wall coverings", "floor covering", "wall or flooring material," "floor and wall covering," "flooring material" and "covering material" mean one or more of ceramic, natural stone or other tile, stone, granite, marble, cultured marble, solid surface, or any other surface (e.g. stone), or non-slip finished shower surfaces such as vinyl, epoxy, or plastic, stucco, concrete and mortar surfaces, whether or not applied or combined with adhesives or other substances, and any other material or materials used to provide a finished surface.

The term "tiled" means any surface having floor or wall covering materials, such as one or more of ceramic, porcelain, natural stone or other tile, stone, granite, marble, cultured marble, solid surface or any other surface (e.g., stone), or non-slip finished shower surfaces such as vinyl, epoxy, or plastic, stucco, concrete and mortar surfaces, whether or not applied or combined with adhesives or other substances, and any other material or materials used to provide a finished surface.

The term "non tileable" means one or more surfaces or structural components which are not capable of receiving wall or floor material or were not designed, marketed or sold with the intention of being tileable or tiled, and in fact are not tiled.

The term "tileable" or "ready-to-tile" means one or more surfaces or structural components which are capable of receiving wall or flooring material, whether through the use of adhesives or any other means of attachment, such as clips, straps or other mechanical fastening structure(s).

A "fastener" or "fastening" may include anything known in the art for fastening including, but not limited to, cap screws, bolts, screws, clips, adhesives, etc.

The term "standard drain" or "drain assembly" means any kind of drain made of any kind of material, including but not limited to metal or plastics, and with any kind of connection to a drain system such as a waste water system, including but not limited to a solvent weld drain, a welded connection drain, a hub (outside caulk) drain, a spigot drain, a hubless spigot drain, a hubless drain, an inside caulk (gasket) drain, a hubbed (push on) drain, a compression drain, and a clamping ring drain.

The term "trench drain" means any linear drain and any linear trench adapted to direct water to a building drain, and contemplates any type of drain fixture.

The term "drain area" or "drain aperture" means an area in which a drain is either to be formed or installed, or is actually formed or installed, in a shower pan and/or bathroom floor.

The term "molded" means any component that is formed with a finished product at the time that the finished product is molded.

The term "plastic" means any foam, plastic, polyurethane, PVC, ABS, polyethylene or other material having characteristics similar thereto.

The term "foam" means any rigid polyurethane foam or any other material having characteristics similar thereto.

The terms "pitch" or "slope" mean the change in elevation per unit of length of floor. A typical shower floor pitch is ¼" per foot, although any pitch is deemed to be within the scope of the inventions disclosed herein. Non shower pitch areas typically would have pitch which is between ⅛' per foot to 1/16" per foot more or less. Shower surfaces and non-shower wet areas are typically pitched toward the drain, encouraging water to flow to the drain. Dry pitched areas may or may not be pitched to a drain.

As used herein, a "frame member" or "strengthening member" may be a structural strength enhancing member that is made from any material that will have the tendency to increase the strength of the bathroom floor components of this invention when incorporated into such bathroom floor components, and may have a thickness of ¼" inch to 2 inches more or less, along with any length and width.

As used herein, an "anti-compression member" is a weight-supporting element adapted to be incorporated into or otherwise used to support weight to avoid deformation of a component or structure by a weight-bearing object.

As used herein, a "concrete member" or "concrete frame member" is a frame member made or cut from concrete wall board or porcelain cement or the like, and may have any thickness, for example ½ inch to 2 inches. Other forms of concrete or cement may be used to manufacture a concrete member, etc.

As used herein, a "foam and/or plastic member" may be any type of foam or plastic material such as polyurethane, PVC, ABS, polyethelene, and other plastics and/or foam, including an XPS (extruded polystyrene) foam that is commercially available, that is cut or manufactured to size, and that may be of any desired density depending on the specific need for such foam and/or plastic member. Other types of foam and plastic may be used to manufacture a foam and/or plastic member.

As used herein, a "bathroom pod," "prefabricated pod bathroom," "bathroom pod chamber," or the like, is a prefabricated, portable pod, from time of manufacture to time of final installation, comprising bathroom features such as one or more floor areas, walls, ceiling, plumbing fixtures, electrical features, decorative floor and wall covering material, etc.

The embodiments disclosed herein may be employed in, by example but not by way of limitation, residential single and multi-family complexes, hospitals, health care facilities, nursing homes, assisted living and aging in place facilities dormitories, hospitality facilities, hotels, military housing, time shares, commercial, military, student and/or industrial facilities, and any other installations in which one or more bathrooms pods are incorporated into the construction.

First, a prefabricated bathroom chamber or bathroom pod, or pod or a bathroom pod floor component that may be employed according to one or more embodiments of the present disclosure suitable for building commercial projects, will be discussed. Then, a pod bathroom floor component that may be used in such a bathroom pod or other similar applications, as a replacement in the field, or in a custom application, will be discussed. Later herein, a method for fabricating and/or using one or more component embodiments will be described. This methodology will be repeated for similar or related embodiments.

Representative Prefabricated Bathroom Pod with a Raised Peripheral Strengthening Wall-Support Platform Given the size of the typical bathroom pod floor component and the weight of the bathroom pod once assembled, a robust method for resisting sagging, twisting, bending and other destructive forces during lifting, transport and installation of the bathroom pods is desired, as well as the needed structure to strengthen the floor component and support the weight of the bathroom walls and wall coverings, bathroom floors and floor coverings, accessories and ceiling panel.

A bathroom pod 100 according to an embodiment of the present disclosure will now be discussed with reference to FIGS. 1-6. The bathroom pod 100 as shown may comprise a ceiling 102, a plurality of walls 104, electrical wiring 106, plumbing 108, and a bathroom floor component 300/300 *a*. As shown in FIGS. 4 and 5, the underlying bathroom floor component 300 may include one or more transverse strengthening members 302, which strengthening members may be made of wood, concrete wallboard material (e.g., HARDIE™ board manufactured by JAMESHARDIE™ Building Products, Inc.) porcelain, metal, extruded thermoplastics, reinforced thermoplastics, etc, or the like, and that is adhered to one or more foam floor panels 304.

Figure 6:
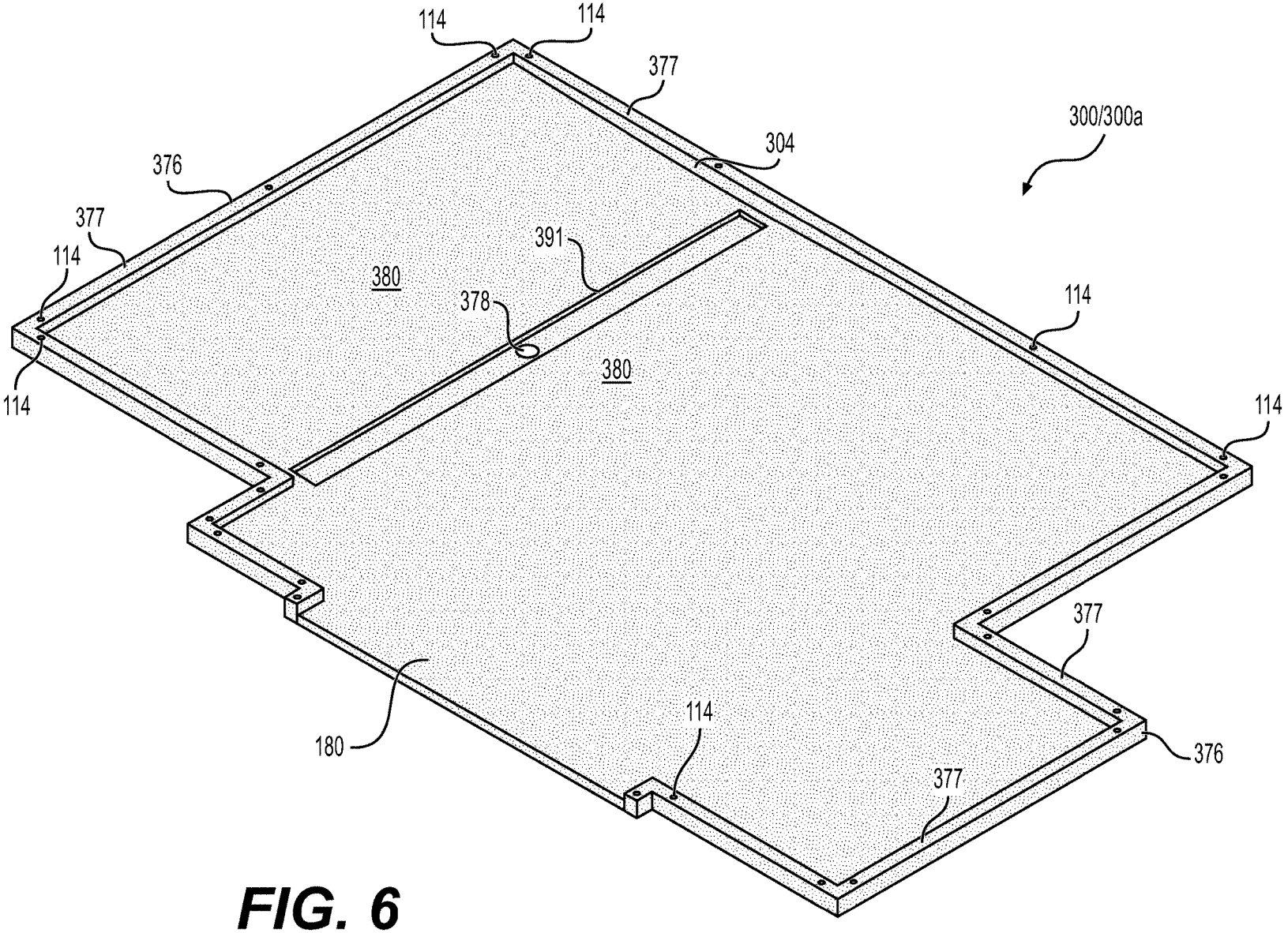
FIG. 6 is a perspective view of the prefabricated bathroom floor component of FIGS. 4-5 after being coated with a waterproof sealant.

As seen in FIG. 6, one or more floor panels 304 (and strengthening members 302 if present) are not typically seen in the finished bathroom floor component 300 as assembled since the entire floor component 300 is encapsulated in a waterproof material, creating an encapsulation layer 325, which will be discussed in more detail below. The operative wall and floor areas of the pod 100 (including encapsulation layer 325) are usually covered by decorative and/or functional wall and floor covering 390, 394, respectively, such as wall and floor tile, respectively, or the like, as is well known. An ingress/egress area 180 may be provided to permit unencumbered access to the bathroom pod.

Further, in some embodiments, a weight bearing raised platform 376 for supporting the pod walls is formed from the same one or more foam floor panels 304 referenced above to create a raised peripheral planar wall support surface 377 defining an outer raised platform perimeter of bathroom floor component 300. Additionally, one or more of the foam floor panels 304 may define a drain aperture 378, and define sloped upper surfaces 380 that are directed toward the drain aperture 378.

Typically, as seen in FIGS. 1-3, the walls 104 may connect the ceiling 102 to the bathroom floor component 300, the electrical wiring 106 is attached to at least one of the plurality of walls 104 and/or the ceiling 102, and the plumbing 108 is attached to at least one of the plurality of walls 104 or the bathroom floor component 300. It is contemplated that the ceiling and/or one or more of the plurality of walls and/or plumbing fixtures/accessories may be omitted from the pod 100 in embodiments of the present disclosure. Also, various light and plumbing fixtures, or any other accessories, may or may not be present. Also, the walls may be supported by a plurality of strengthening members associated with the raised platform which strengthening members would be selected from the group of compression-resistant materials and products such as polyurethane, wood, bushings and grommets. In other embodiments, ceiling 102 may be manufactured and employed in the manner described in connection with bathroom floor component 300.

Figure 4B:
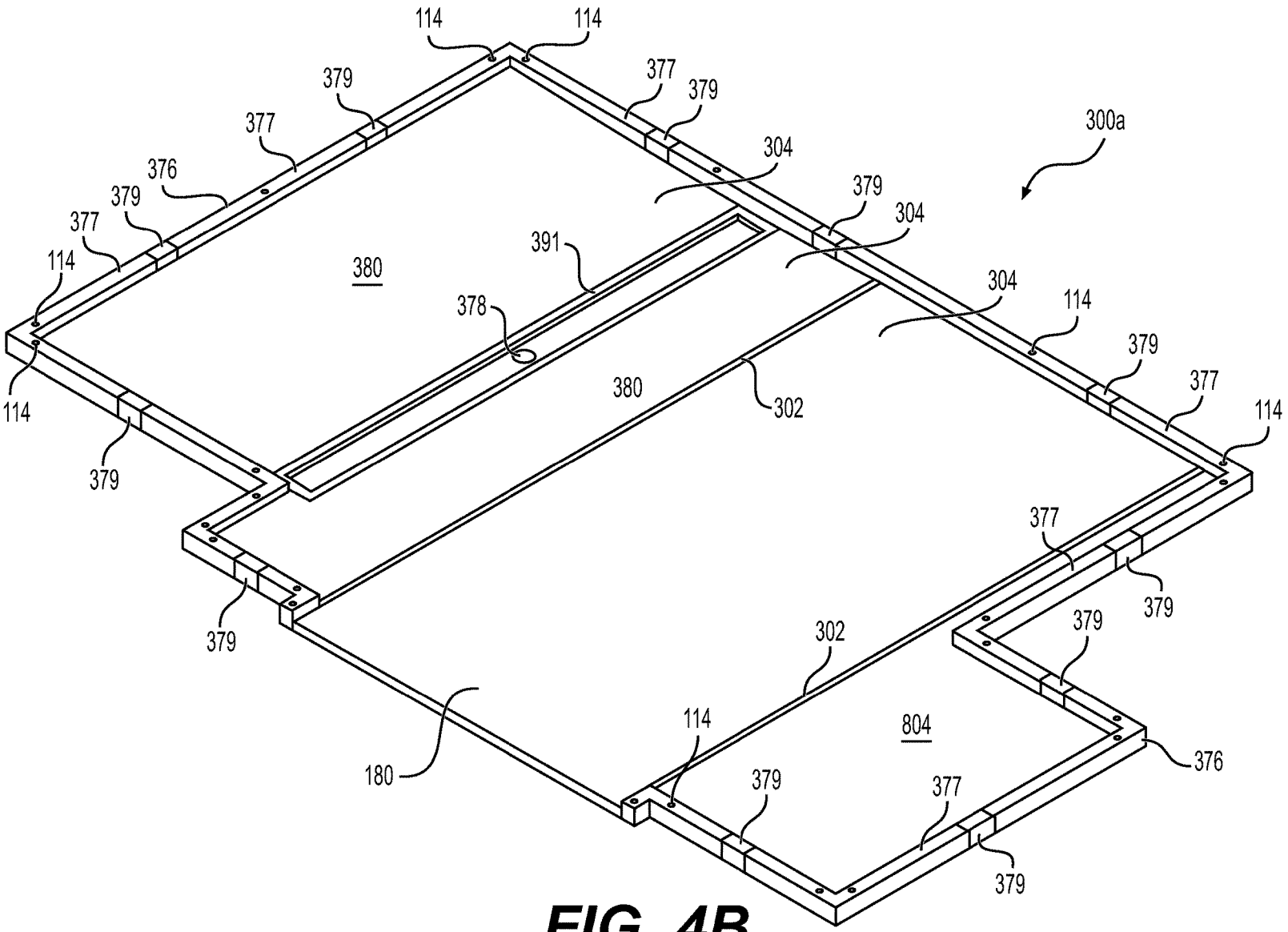
FIG. 4B is a top oriented perspective view of a prefabricated bathroom floor component that is similar or identical to that depicted in FIG. 1 prior to being encapsulated with a waterproof strengthening membrane and which employs a reinforced peripheral strengthening member, and a border member.
Figure 5A:
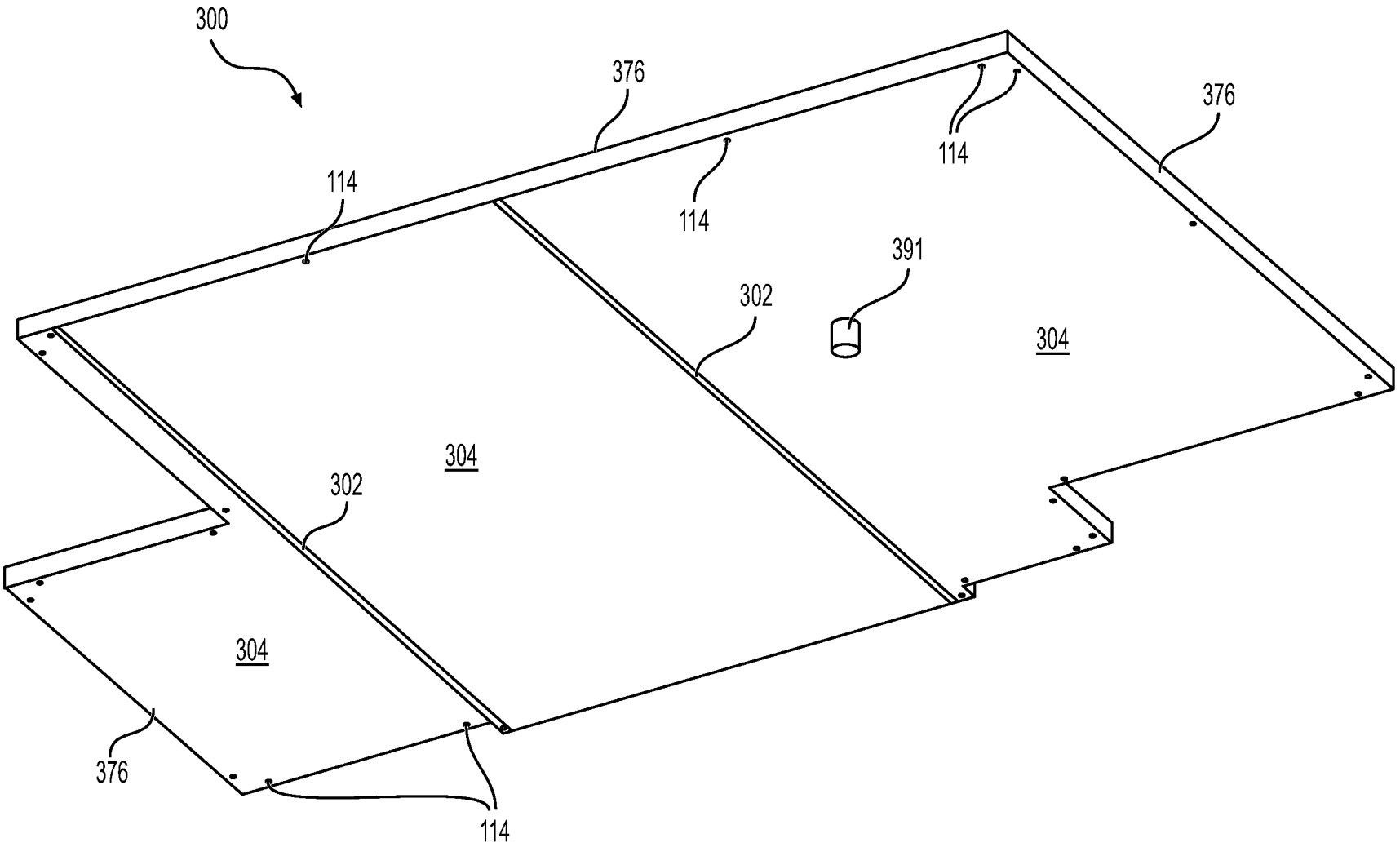
FIG. 5A is a bottom oriented perspective view of the prefabricated bathroom floor component of FIG. 4A.
Figure 5B:
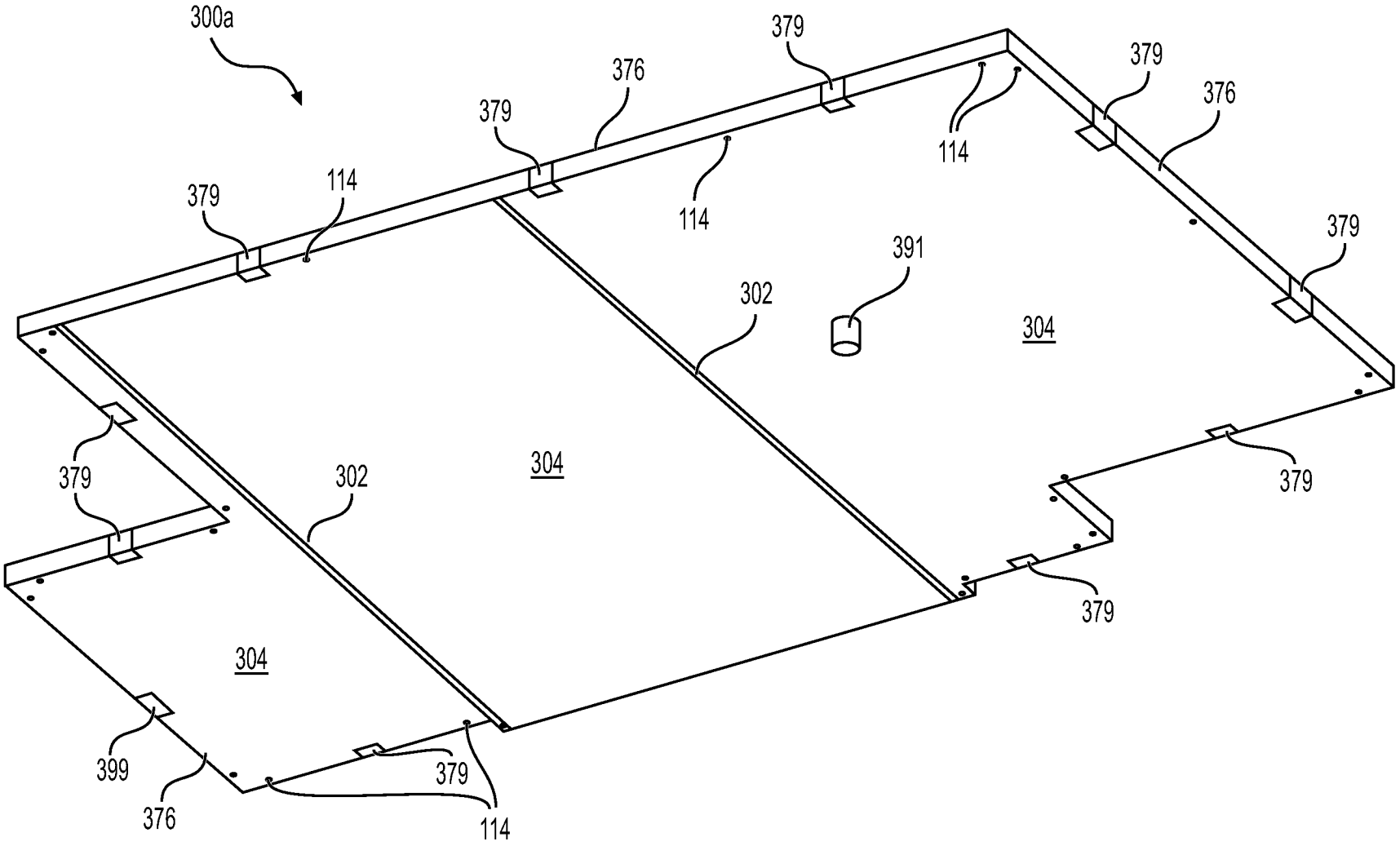
FIG. 5B is a bottom oriented perspective view of the prefabricated bathroom floor component of FIG. 4B.

Put another way, the walls may connect the ceiling to the bathroom floor component 300. The walls may include bottom frame members 112 which are adapted to align and be coplanar with upper surface 377. A plurality of hollow fastener-receiving journals or bushings 116 may be disposed in the plurality of apertures 114 defined by raised platform 376. These journals 116 may act as alignment features when the walls are fastened to the bathroom floor component 300, act to protect the integrity of apertures 114, which in some embodiments are formed in polystyrene or other relatively soft foam, and in other embodiments a more rigid foam such as polyurethane, and act to transfer weight from the walls 104 to the sub-floor (not shown) supporting pod 100. In doing so, the raised platform 376 is protected from crushing. The hollow interiors of bushings 116 allow fasteners 120 to extend through apertures 114 in raised platform 376 through the bottom wall of frame members 112 (see FIGS. 2C, 2D and 3). As seen in FIGS. 4*b* and 5B, anti-compression members 379, which may be wood, polyurethane, metal or any other material or apparatus, may be incorporated within the raised platform 376 to help in transferring the weight of the pod walls 104 from the raised platform to the sub floor (not shown). One or more of any of the raised platform anti-compression members 379 may be used in any combination in the raised platform. In embodiments, voids for receiving the anti-compression members 379 and are machined into platform 376. In other embodiments, such voids are created during manufacturing of the raised platform.

Figure 3A:
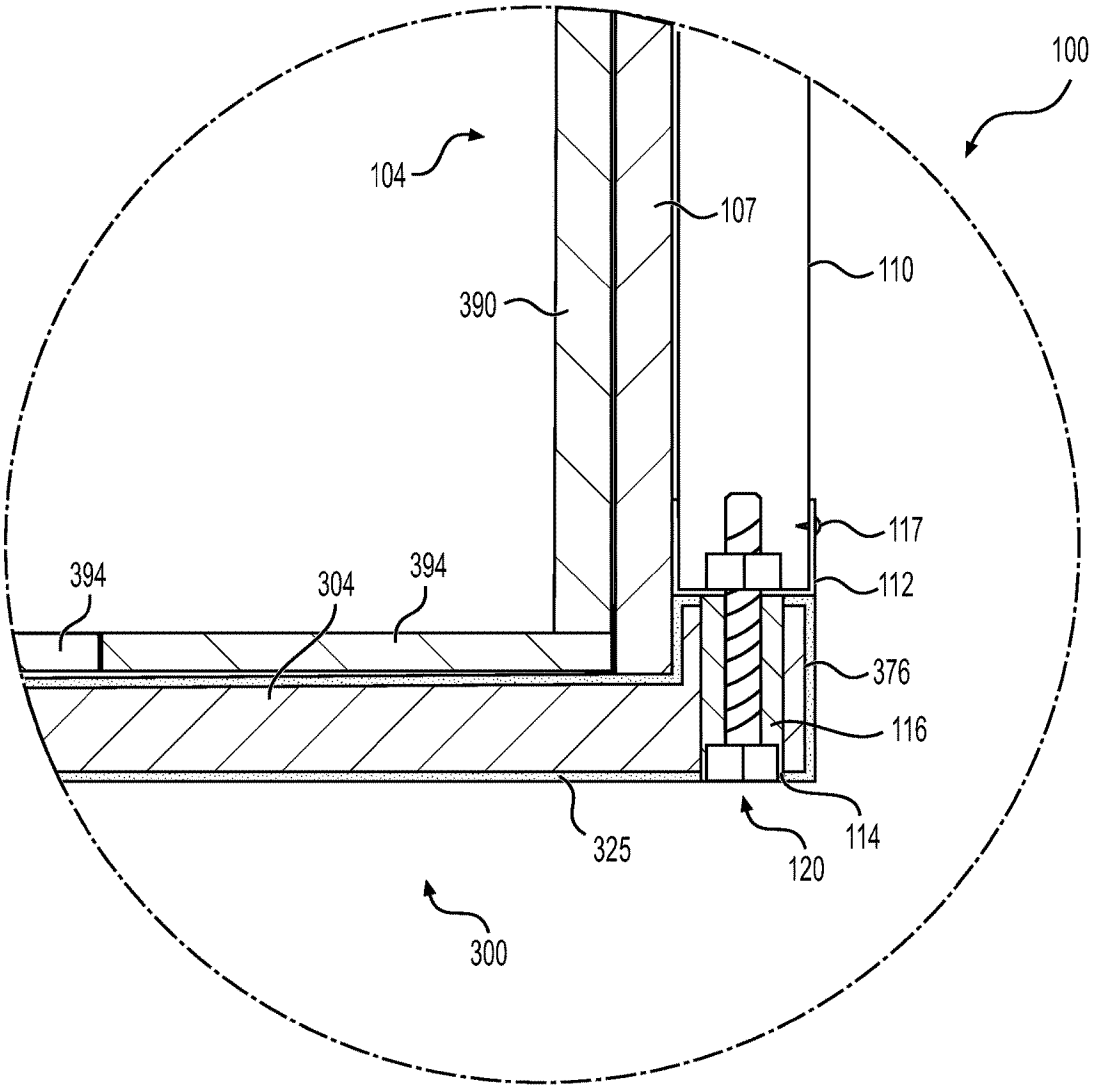
FIG. 3A is an enlargement of the area of detail shown in FIG. 2C, showing internal details of the fastened connection of the prefabricated floor component to the walls of the bathroom pod.
Figure 3B:
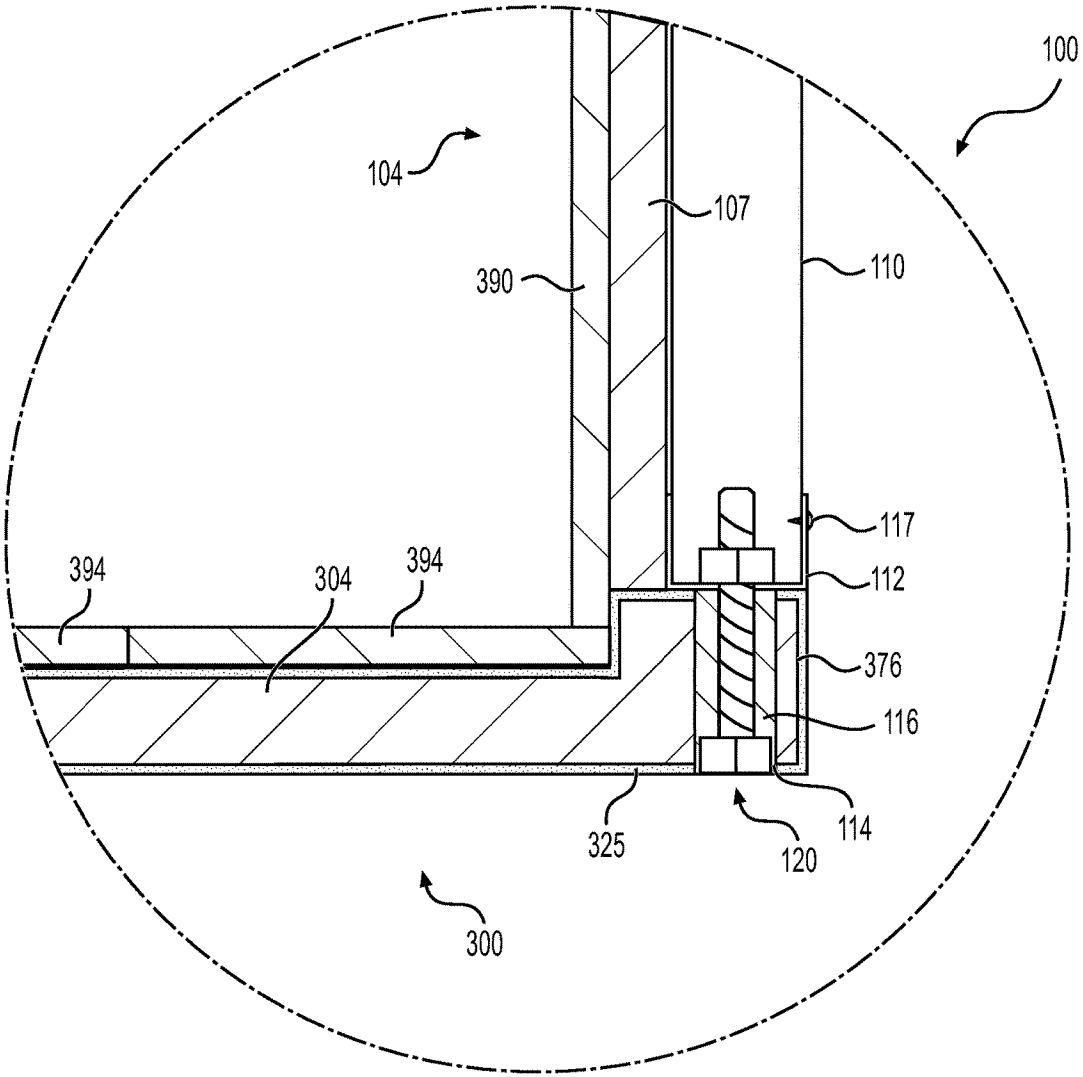
FIG. 3B is a modified form of the enlarged area of detail shown in FIG. 2C.
Figure 3C:
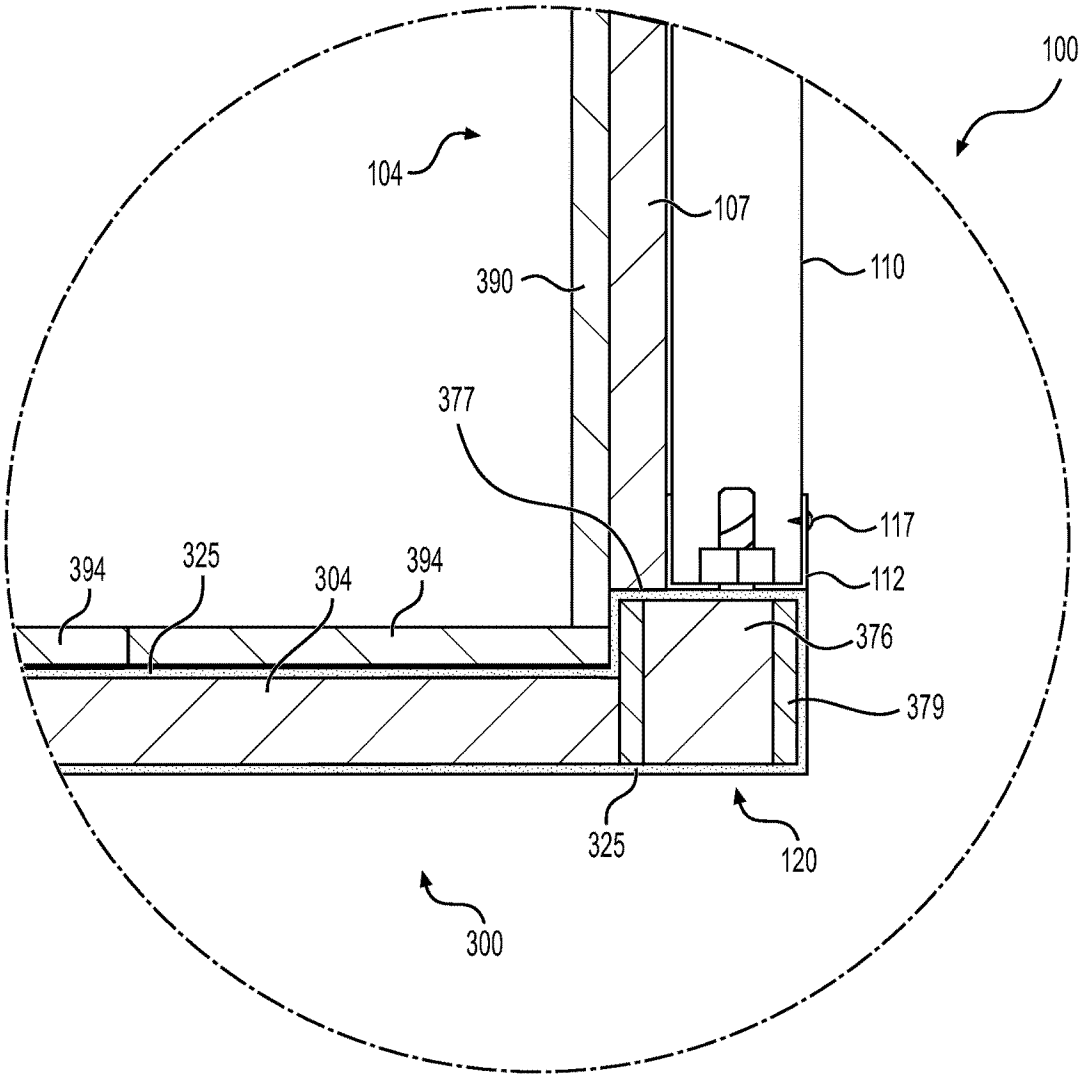
FIG. 3C is a further modified form of the enlarged area of detail shown in FIG. 2C.
Figure 3D:
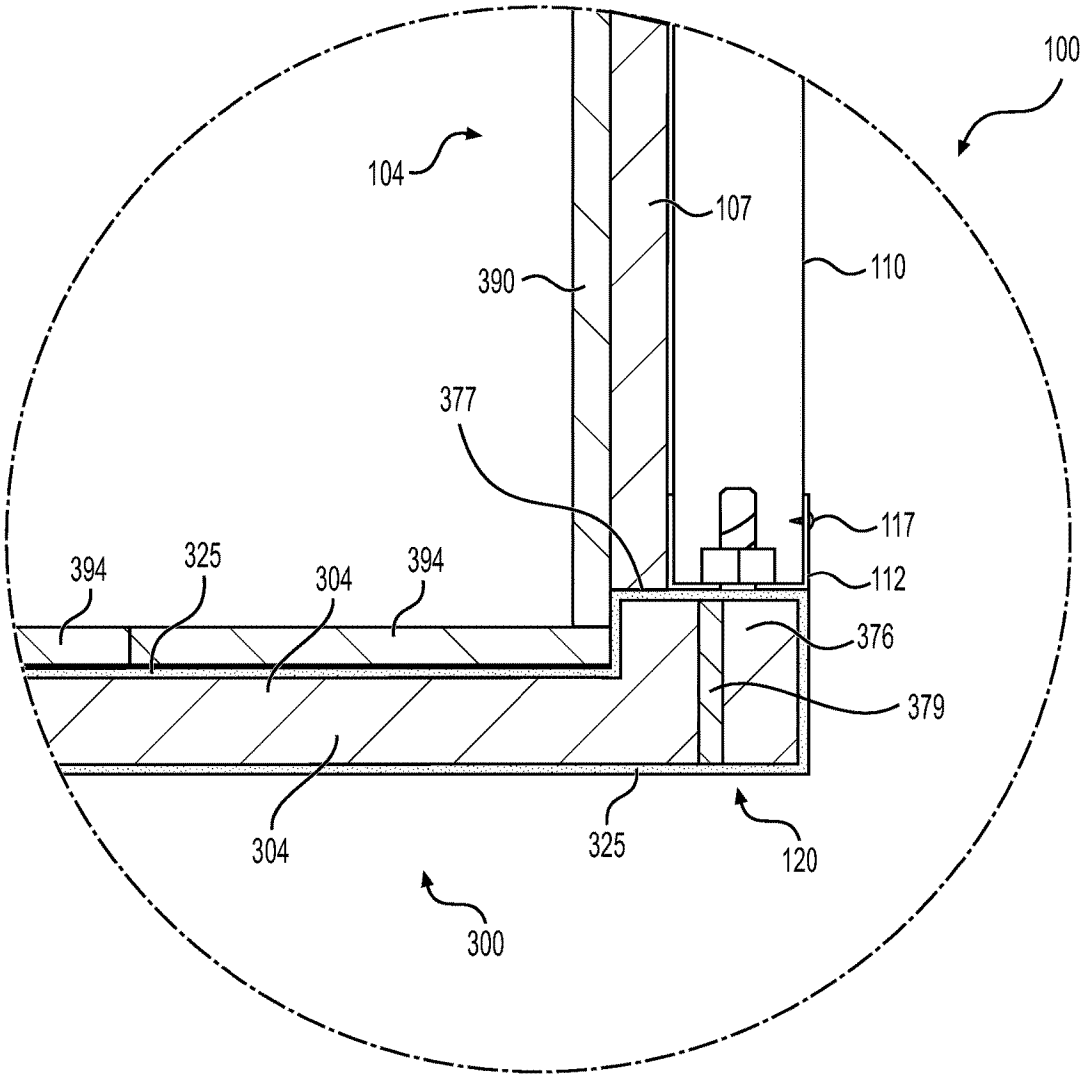
FIG. 3D is a still further modified form of the enlarged area of detail shown in FIG. 2C

Focusing on FIG. 3A, it can be seen that the bushings 116, which are preferably fabricated of metal, although any material having good compression resistance is suitable, transfer weight from the walls down to the support surface or substrate (not shown) on which the bathroom floor component 300 will sit. Any suitable fastener 120 may be used including nuts and bolts, screws, adhesive, and the like. Bottom frame members may be in the form of standard U-shaped channels, rectangular structural members such as 2×4 s or 4×4 s, or the like, to which are attached the wall studs 110. The U-shaped channels and/or rectangular structural members 112 may be referred to as a bottom wall strengthening member, bracket, track or tray, and may be used to connect the wall studs 110 to the upper surface 377 of raised platform 376. The U-shaped channels and/or bottom frame members 112 are preferably aligned with the upper surfaces 377 of raised platform 376. The fasteners 120 may engage one or more of the bottom frame members 112 through apertures 114. In embodiments, the bushings 116 may be disposed in the apertures 114, which then support the bottom frame members 112 and the anti-compression members as applicable. The fasteners 120 may extend through the bushings 116 so that the bushings 116 surround the fasteners 120.

Similarly, FIGS. 2A thru 2D depict the bathroom pod 100 as assembled. Some of the plumbing accessories are more easily seen including the shower accessories. Other features, configurations, and accessories are possible in other embodiments of the present disclosure.

The ceiling 102 may be monolithic, crack-proof, and water proof. The electrical wiring 106 and the plumbing 108 may be pretested and code compliant. The walls 104 may have moisture, mold and abuse resistant wallboard 107. Engineered steel framing studs 110 may hold the walls, and the pod floor component 100 as a whole, together. Accessories such as, but not limited to, a sink 115, rail 118, mirror 111 and foot rest 113 may also be provided. One or more of these features or accessories may be omitted in other embodiments of the present disclosure.

As can be seen, any completed, prefabricated bathroom chamber or pod such as pod 100 may speed up construction of a building by providing a completely finished modular room that is clean and ready for installation and use. Once properly positioned, physical placement within the building as well as plumbing and wiring hook ups are all that is needed before the bathroom is operational.

Turning to FIGS. 4 and 5, it can be understood that the bathroom pod floor component 300 is assembled as a collection of component parts, comprising (as will be seen in connection with FIGS. 7-10) one or more floor panels encapsulated within a one piece, waterproof, rigid layer 325 to result in a monolithic, extremely strong bathroom floor member that resists bending, sagging and twisting. The pre-encapsulated bathroom floor as shown in FIGS. 4A, 4B, 5A and 5B may comprise any number of transverse strengthening members or stringers 302. One or more foam floor-forming members 304 may be disposed between the one or more plurality of strengthening members 302. More particularly, at least one of the plurality of foam floor members 304 may be disposed between adjacent transverse cross-brace strengthening members 302. In some embodiments, a single longitudinal strengthening member 302 and two panels of foam 304 may be employed, etc. to form the bathroom floor component 300. In other embodiments, the floor and perimeter raised platform 376 are formed of a single sheet of closed cell foam, and may or may not be encapsulated in the waterproof rigid layer.

More specifically, at least one or more of the plurality of foam members 304 may be bonded to at least one or more of the plurality of outside peripheral strengthening members 374, and to at least one or more of the plurality of transverse cross-brace strengthening members 302. The bonding may be intermittent or may cover substantially the entire interface between the foam member and the peripheral strengthening member. Any suitable bonding agent may be used, such as glue, latex modified rapid setting material, etc., as will occur to those of skill in the relevant art.

As best seen in FIGS. 4-5, one of the foam members 304 may define a drain aperture 378. The drain aperture 378, as well as any contour, e.g., slope or pitch to the upper surface of floor panels 304, may be milled or drilled, etc. using a CNC (computer numerically controlled) router or milling machine, or other aperture-forming technique, etc. Alternatively, such structural features may be formed in a molding process. In like manner, contour, e.g., support ribs (not shown), may be formed in the lower surface of floor members 304. Later, a drain assembly (such as the linear trench and linear drain 391 shown in the figures, or a circular drain, etc. may be inserted into the drain aperture 378 during the fabrication of the bathroom floor component as will be discussed in more detail below.

As seen in FIGS. 4B, 5B and 6, a modified floor component 300*a* employs a prefabricated raised platform 376 having one or more anti-compression elements 379 integrated therewith. The anti-compression elements 379 transfer weight from the pod walls 104 to the substrate which supports the floor component 300*a*. Anti compression elements 379 may be comprised of wood, plastic, polyurethane, metal, pvc, concrete, porcelain cement or any suitable material capable of transferring weight forces exerted by the walls (which includes the weight of the ceiling 102 and the accessories and other items attached to the pod 100) to avoid crushing or otherwise distorting the raised platform 376. Any number of elements 379 may be employed, with each having the same size or shapes and/or dimensions, or having unique shapes, sizes and dimensions. Alternatively, the raised platform 376 may be comprised entirely of material which is capable of supporting the weight of the walls 104 and attachments thereto.

FIGS. 4A-5B show floor components 300 and/or 300*a* prior to being encapsulated with a waterproof membrane. FIG. 6 shows floor components 300 and/or 300*a* after being encapsulated with a waterproof membrane 325. As can be seen, strengthening members 302, as well as the peripheral edges of drain fixture 391, can no longer be seen after floor component 300/300*a* has been encapsulated.

Figure 4A:
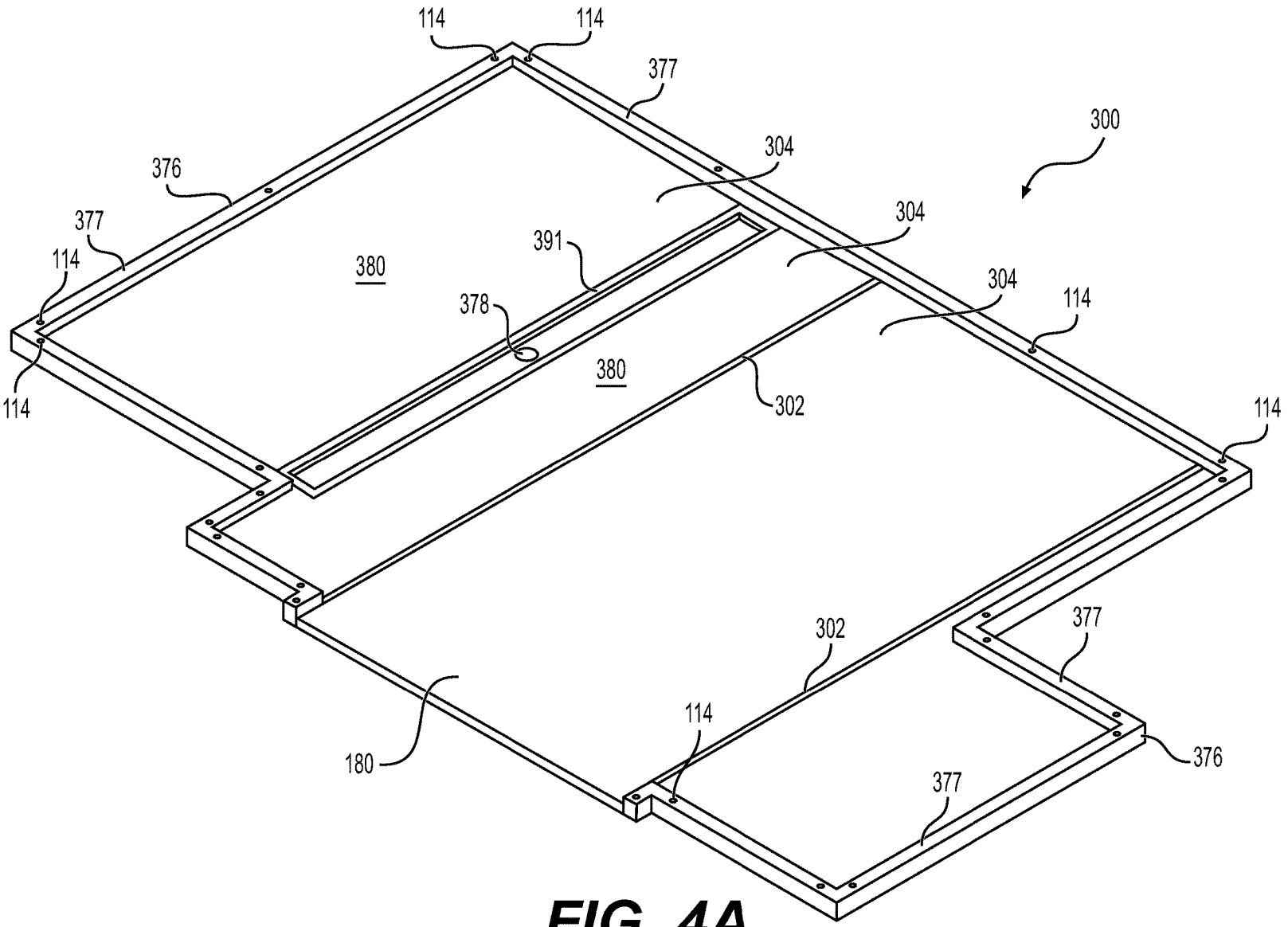
FIG. 4A is a top oriented perspective view of a prefabricated bathroom floor component that is similar or identical to that depicted in FIG. 1 prior to being encapsulated with a waterproof strengthening membrane and which employs a perimeter peripheral member. An opening without a raised wall platform, where a door may be installed, is shown toward the front of the prefabricated bathroom floor component.
Figure 4C:
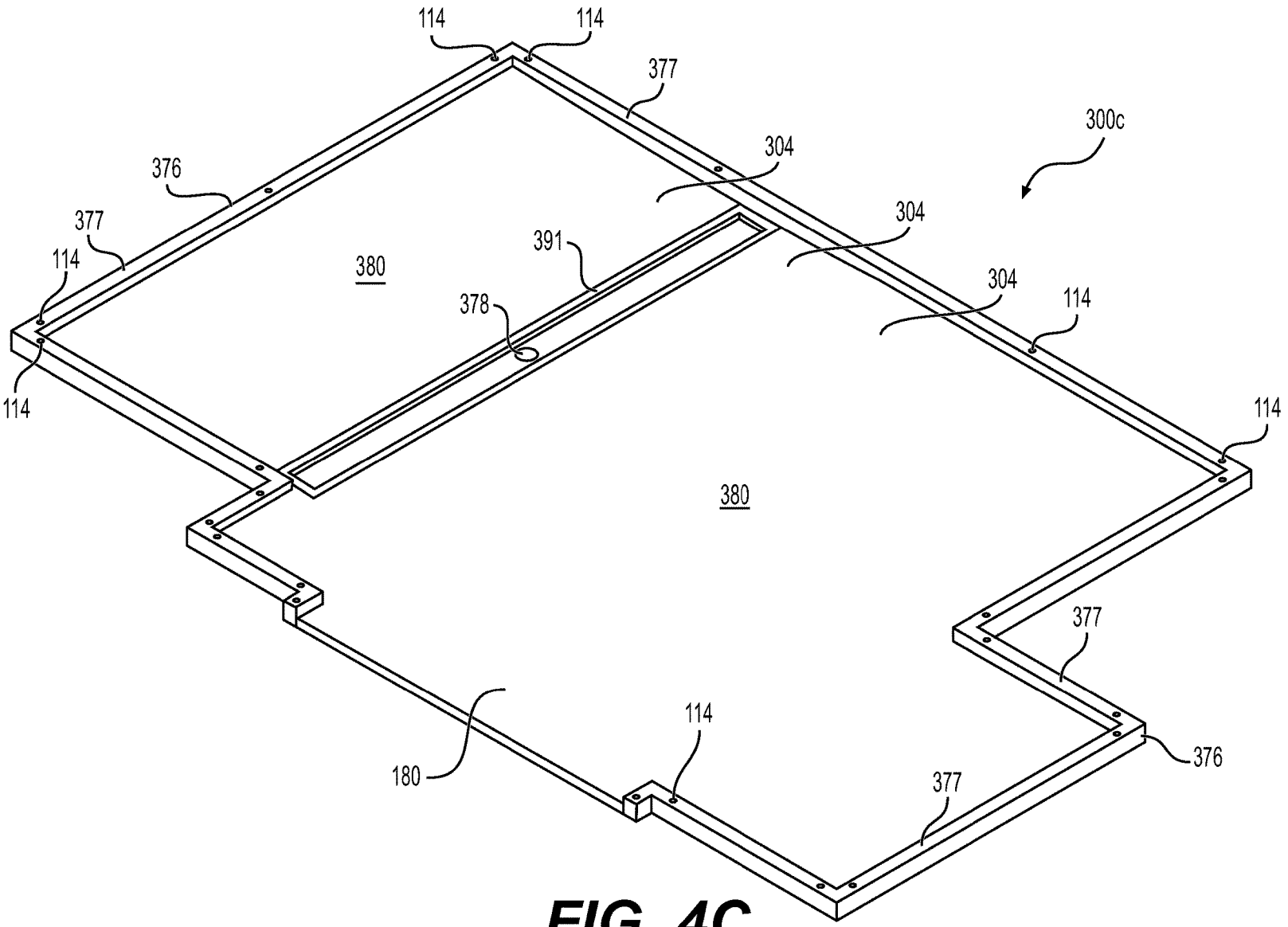
FIG. 4C is a top oriented perspective view of a prefabricated bathroom floor component that is similar to that depicted in FIG. 4A prior to being encapsulated with a waterproof strengthening membrane and which does not employ a transverse strengthening member.

The bathroom floor component 300*c* shown in FIG. 4C is in most material respects the same as the bathroom floor component of FIG. 4A, but does not have longitudinal strengthening member(s) 302. Instead, it is a single-panel floor component. In embodiments, bathroom floor component 300*c* may be coated with waterproof membrane 325, or may be uncoated, such as in cases where it is manufactured of water impervious material. In the latter case, no additional waterproofing, such as in the form of waterproof membrane 325, is necessary.

Figure 4D:
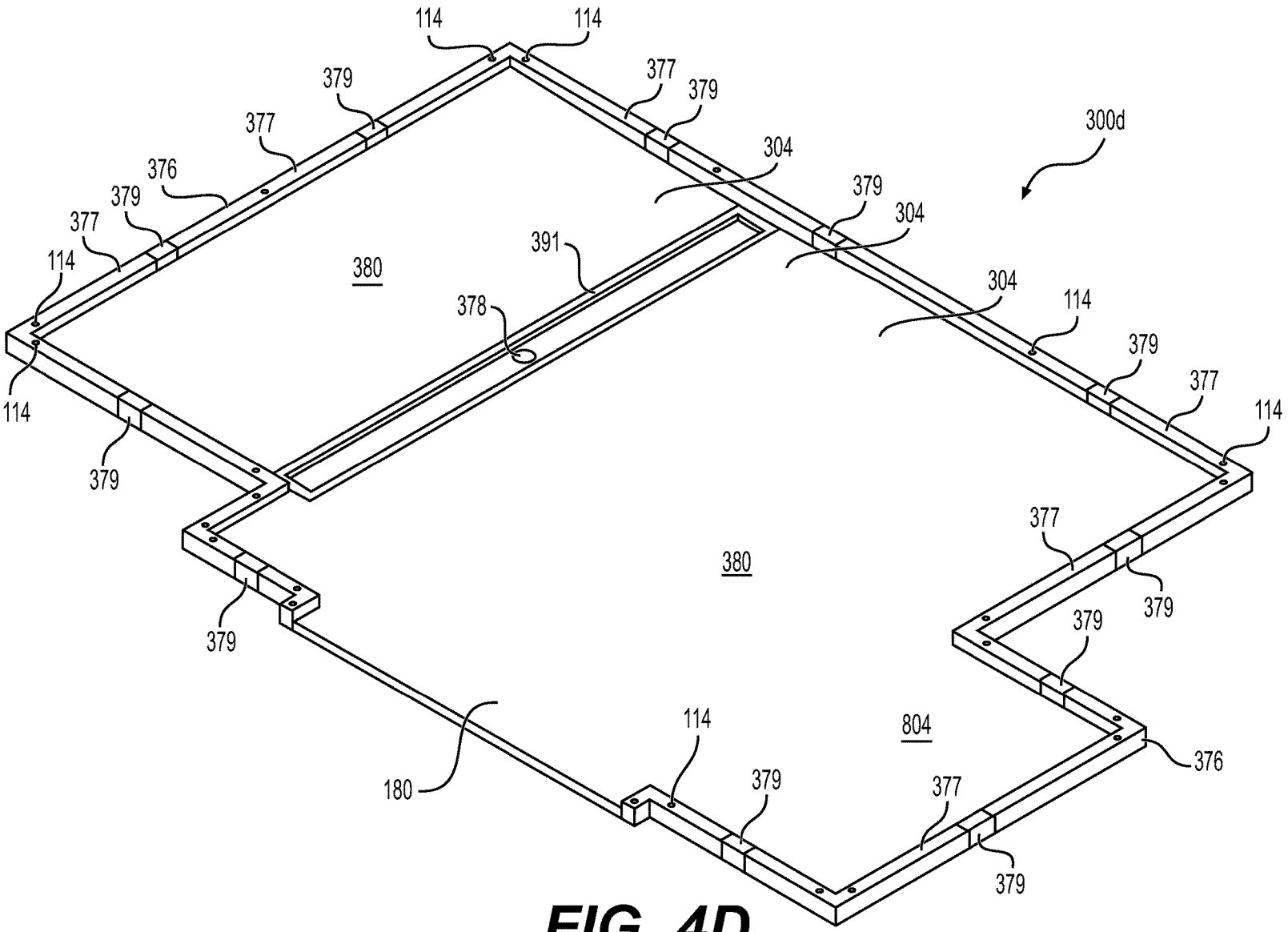
FIG. 4D is a top oriented perspective view of a prefabricated bathroom floor component that is similar to that depicted in FIG. 4B prior to being encapsulated with a waterproof strengthening membrane and which does not employs a transverse strengthening member

The bathroom floor component 300*d* shown in FIG. 4D is in most material respects the same as the bathroom floor component of FIG. 4B, but does not have longitudinal strengthening member(s) 302. Instead, it is a single-panel floor component. In embodiments, bathroom floor component 300*d* may be coated with waterproof membrane 325, or may be uncoated, such as in cases where it is manufactured of water impervious material. In the latter case, no additional waterproofing, such as in the form of waterproof membrane 325, is necessary.

Waterproof Membrane

As stated previously, it has been discovered that encapsulating or coating the bathroom floor component or other constituent element of the floor with a waterproof membrane by applying a waterproof sealant or other water-impervious material to the entire assembly significantly adds to the strength of the bathroom floor component, and also contributes to the watertight quality of the component, though a waterproof membrane may not be required when a one-piece closed cell floor panel and/or raised support platform are used for the bathroom floor component 300/300*a*. FIG. 6 shows a representative bathroom floor assembly after having been sprayed with such a membrane 325 during a bathroom floor component manufacturing process. FIGS. 7-8 show that a bathroom floor component, such as components 300 and 300*a*, may be spray coated with a waterproof sealant or other protective waterproof layer 325 to create the waterproof membrane. Other methods of application are possible, including powder coating, baking, curing, etc. Teachings of suitable coating materials, techniques and resulting structures are disclosed in U.S. Pat. Nos. 8,918,926, 9,107,545 and 9,775,472 to Herring, the disclosures of which are incorporated by reference herein as though fully set forth herein.

The bathroom floor component of FIG. 6 may be comprised of, in embodiments, a bathroom floor member 300/300*a* made of one or more plastic or foam members 304 attached to one or more longitudinal and/or peripheral strengthening members 302, 374, after having been coated with the waterproof membrane 325. The type of membrane material may vary, but may take the form of any suitable commercially available polyurethane, polyurea, or the like.

Figure 7A:
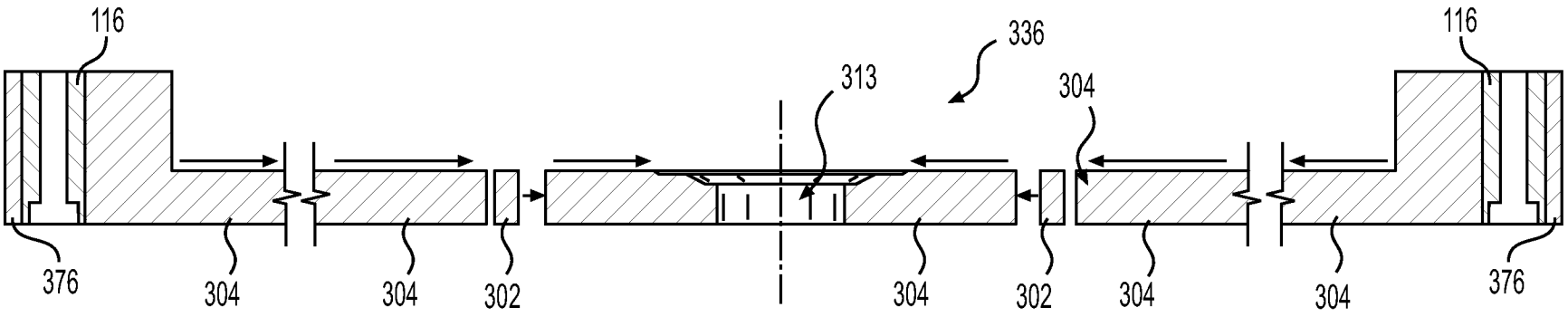
FIG. 7A is a cross-sectional exploded elevational view of the embodiment of a prefabricated bathroom floor component shown in FIG. 3A.
Figure 7B:
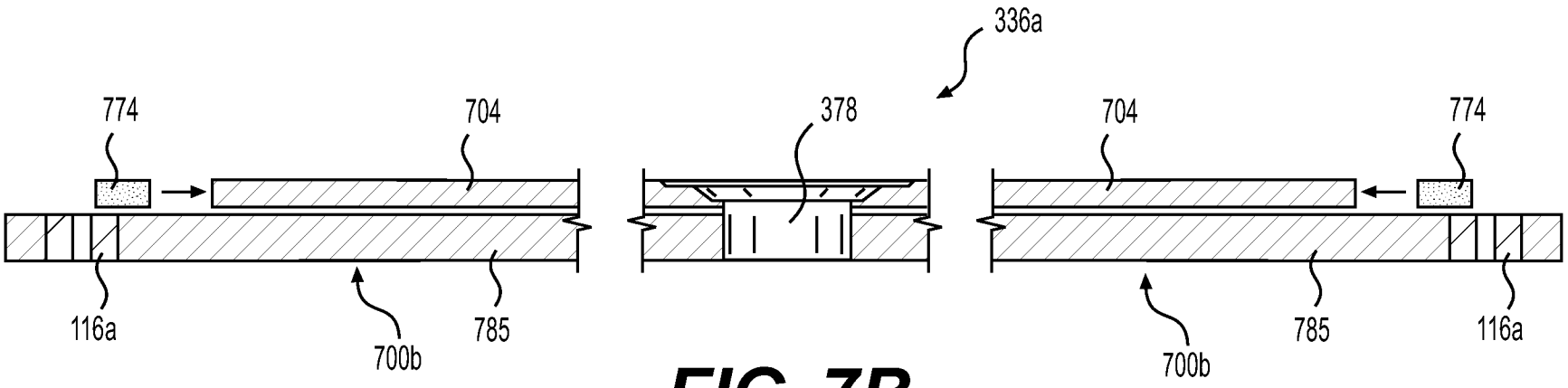
FIG. 7B is a cross-sectional exploded elevational view of the embodiment of a prefabricated bathroom floor component shown in FIG. 15B.
Figure 7C:
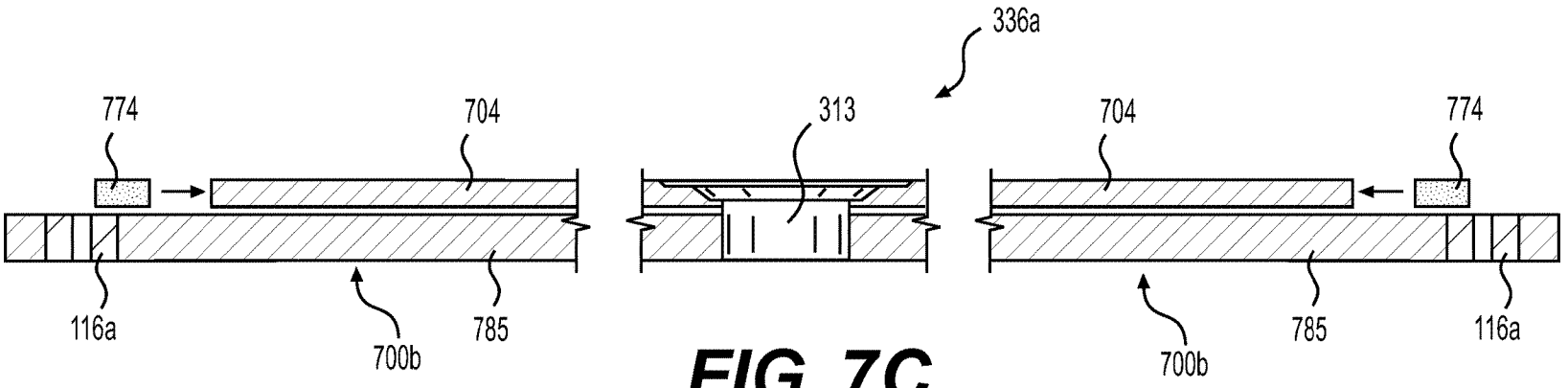
FIG. 7C is a cross-sectional exploded elevational view of the embodiment of a prefabricated bathroom floor component shown in FIG. 15C.
Figure 7D:
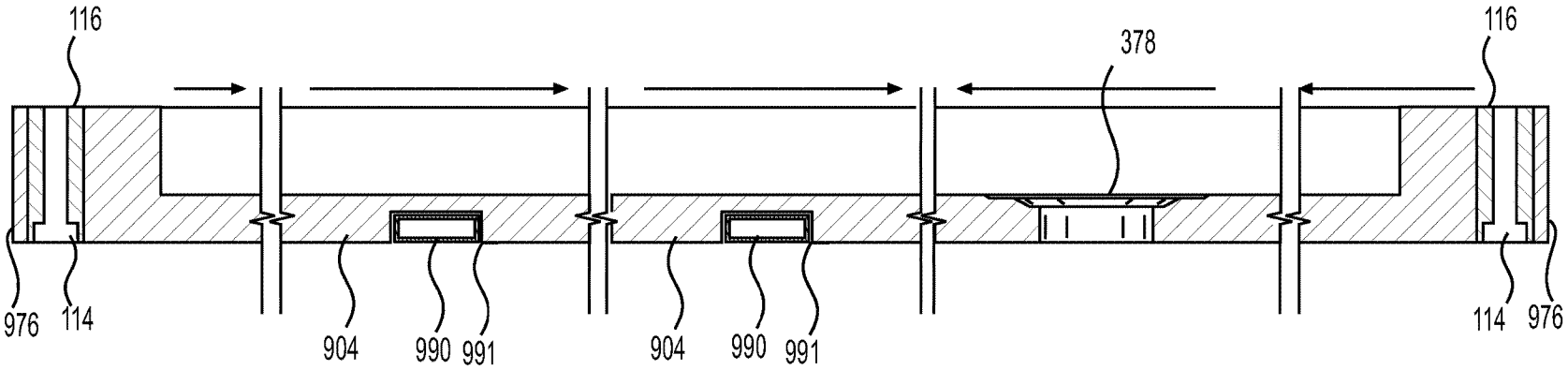
FIG. 7D is a cross-sectional exploded elevational view of the embodiment of a prefabricated bathroom floor component shown in FIG. 18D.
Figure 7E:
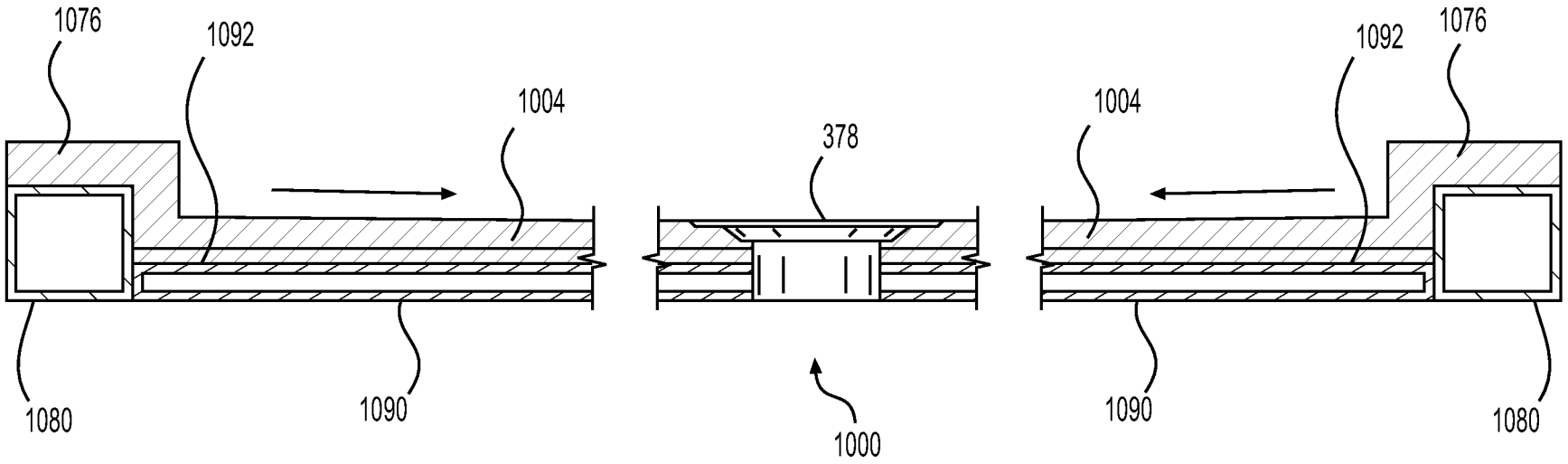
FIG. 7E is a cross-sectional exploded elevational view of the embodiment of a prefabricated bathroom floor component shown in FIG. 23.
Figure 15A:
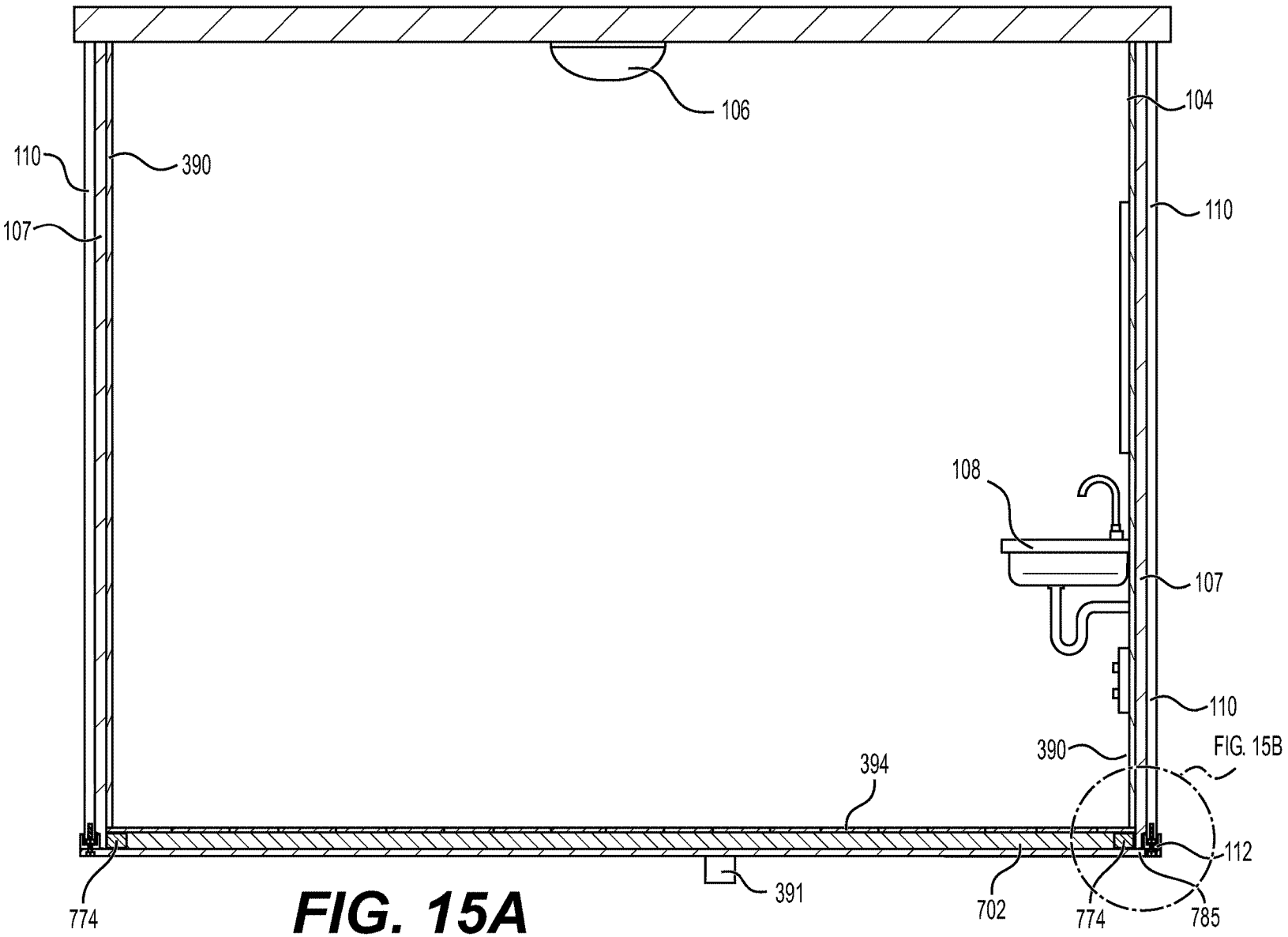
FIG. 15A is a side cross-sectional elevational view of the bathroom floor component of FIG. 12, taken along lines 15A-15A thereof.
Figure 15B:
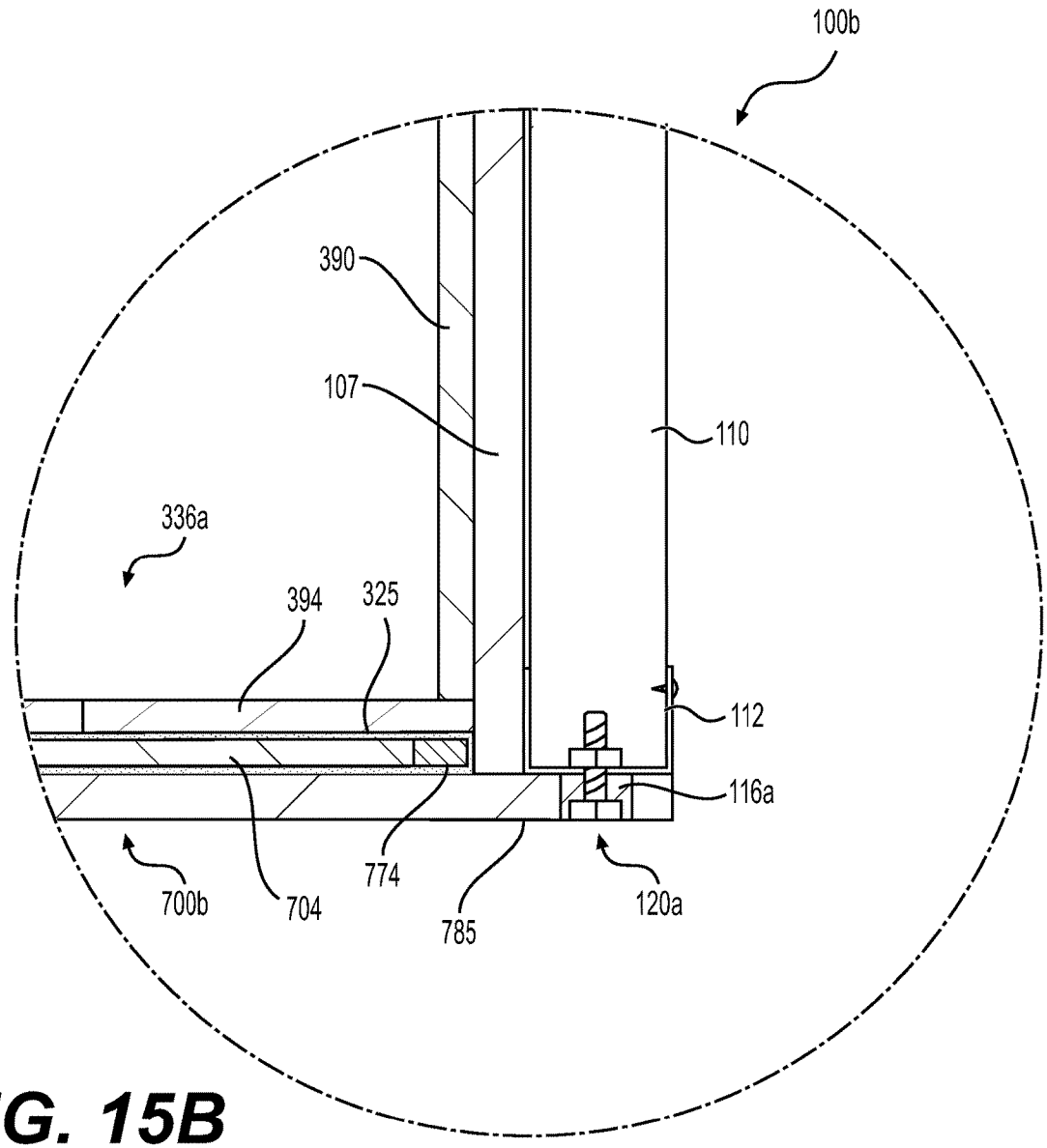
FIG. 15B is an enlarged detail view taken from FIG. 14, showing the internal details of the fastened connection of the prefabricated bathroom floor component to the walls of the bathroom pod.
Figure 18A:
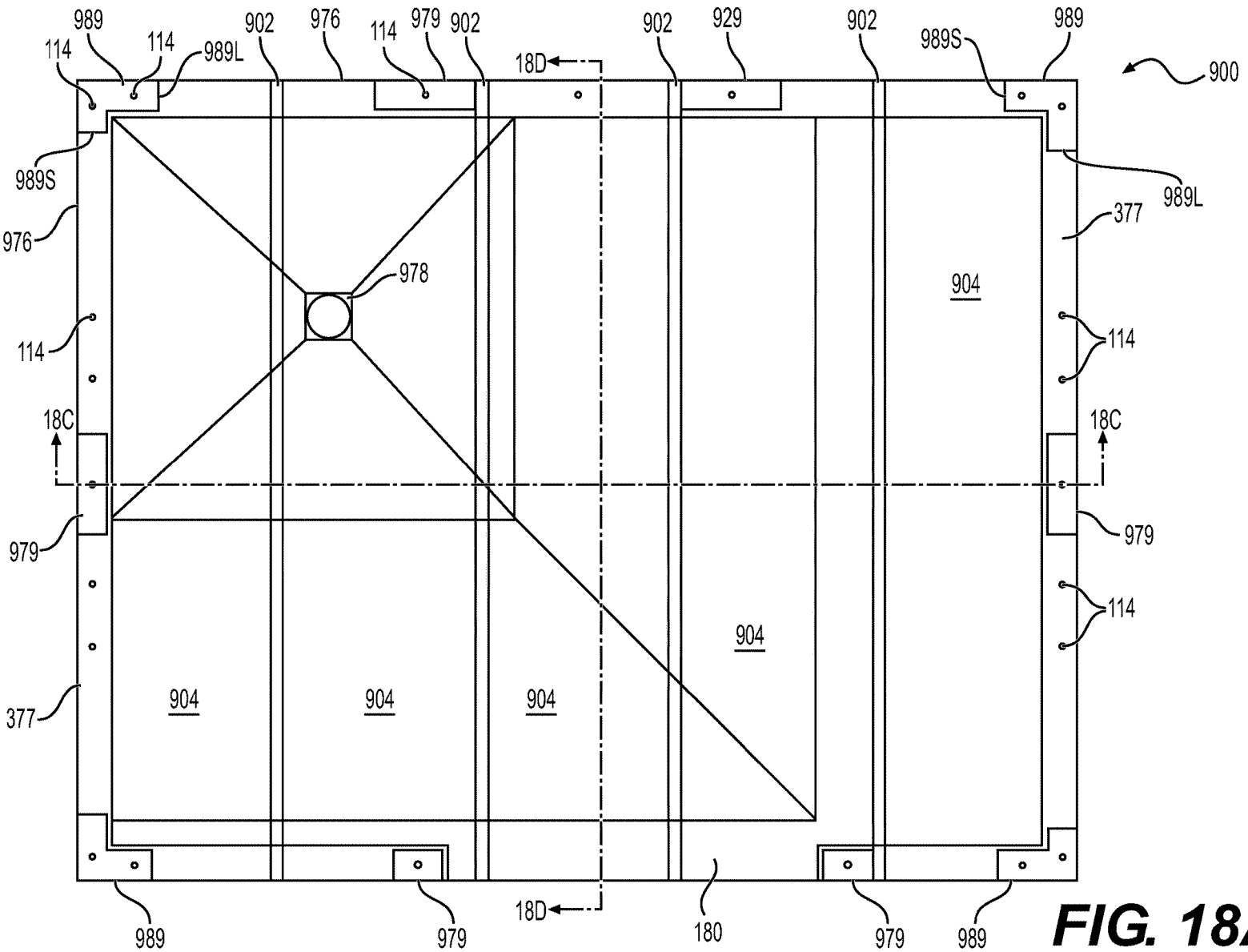
FIG. 18A is a top plan view of a prefabricated bathroom floor module according to a third embodiment of the invention.
Figure 18B:
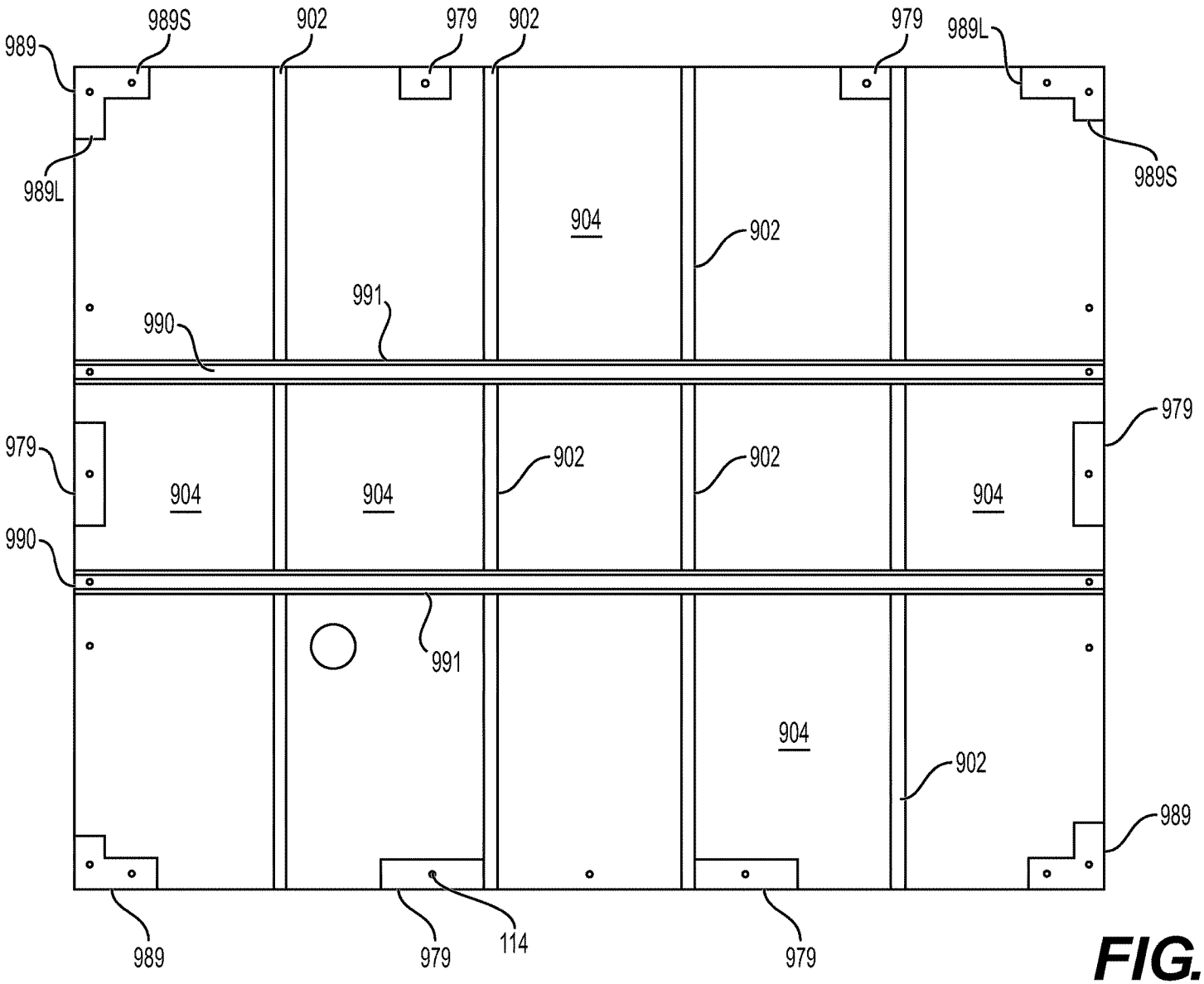
FIG. 18B is a bottom plan view of the bathroom floor component of FIG. 18A.
Figure 18C:
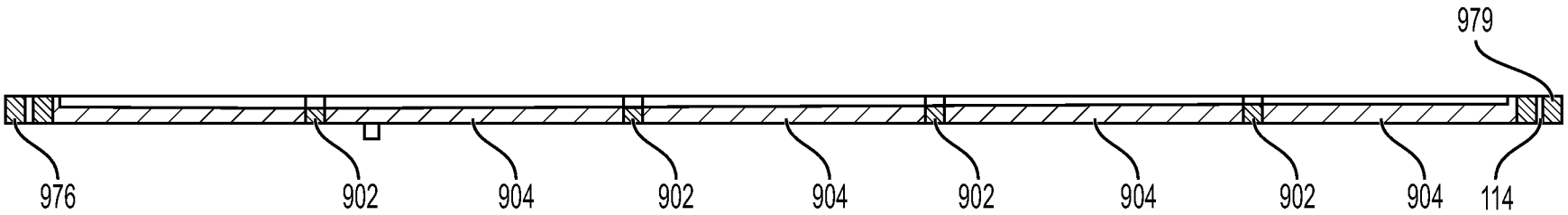
FIG. 18C is a cross-sectional elevational view of the bathroom floor component taken along lines 18C-18C of FIG. 18A.
Figure 18D:
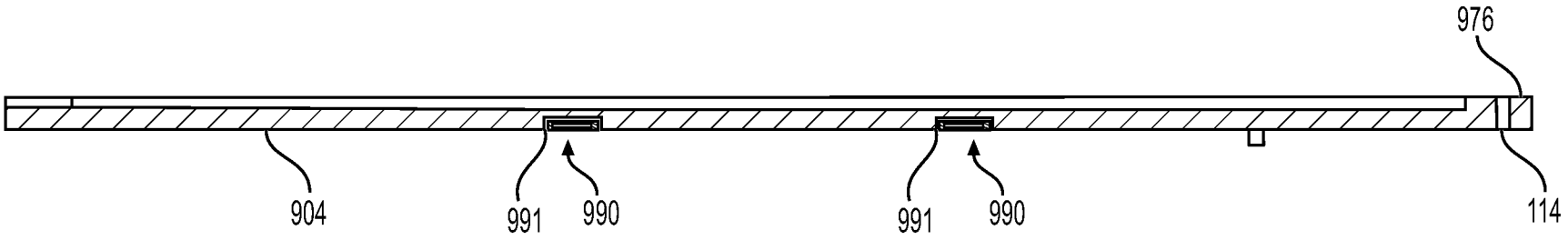
FIG. 18D is a cross-sectional elevational view of the floor module taken along lines 18D-18D of FIG. 18A.
Figure 18E:
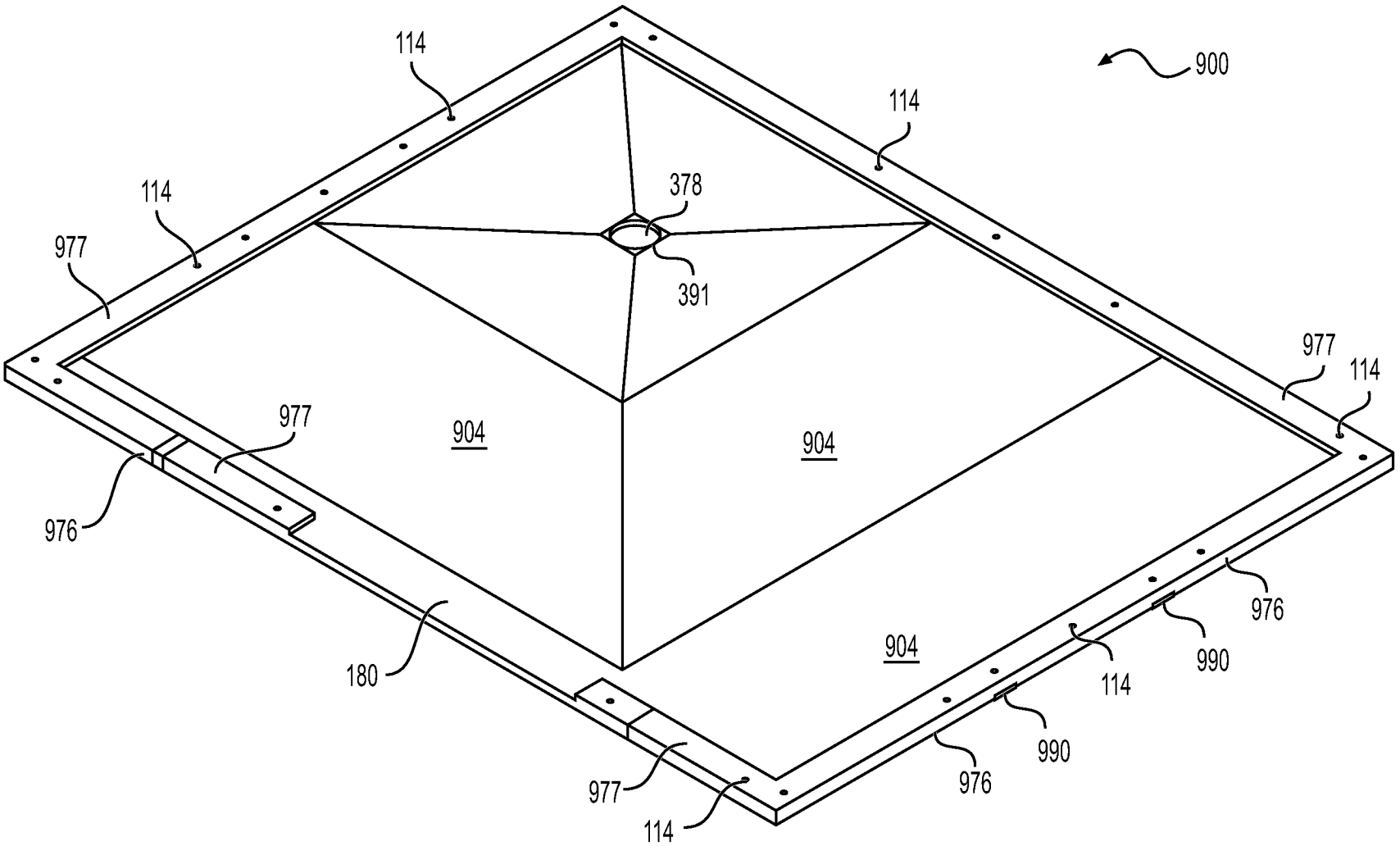
FIG. 18E is a top perspective view of the bathroom floor component of FIG. 18A without longitudinal or anti-compression elements.
Figure 18F:
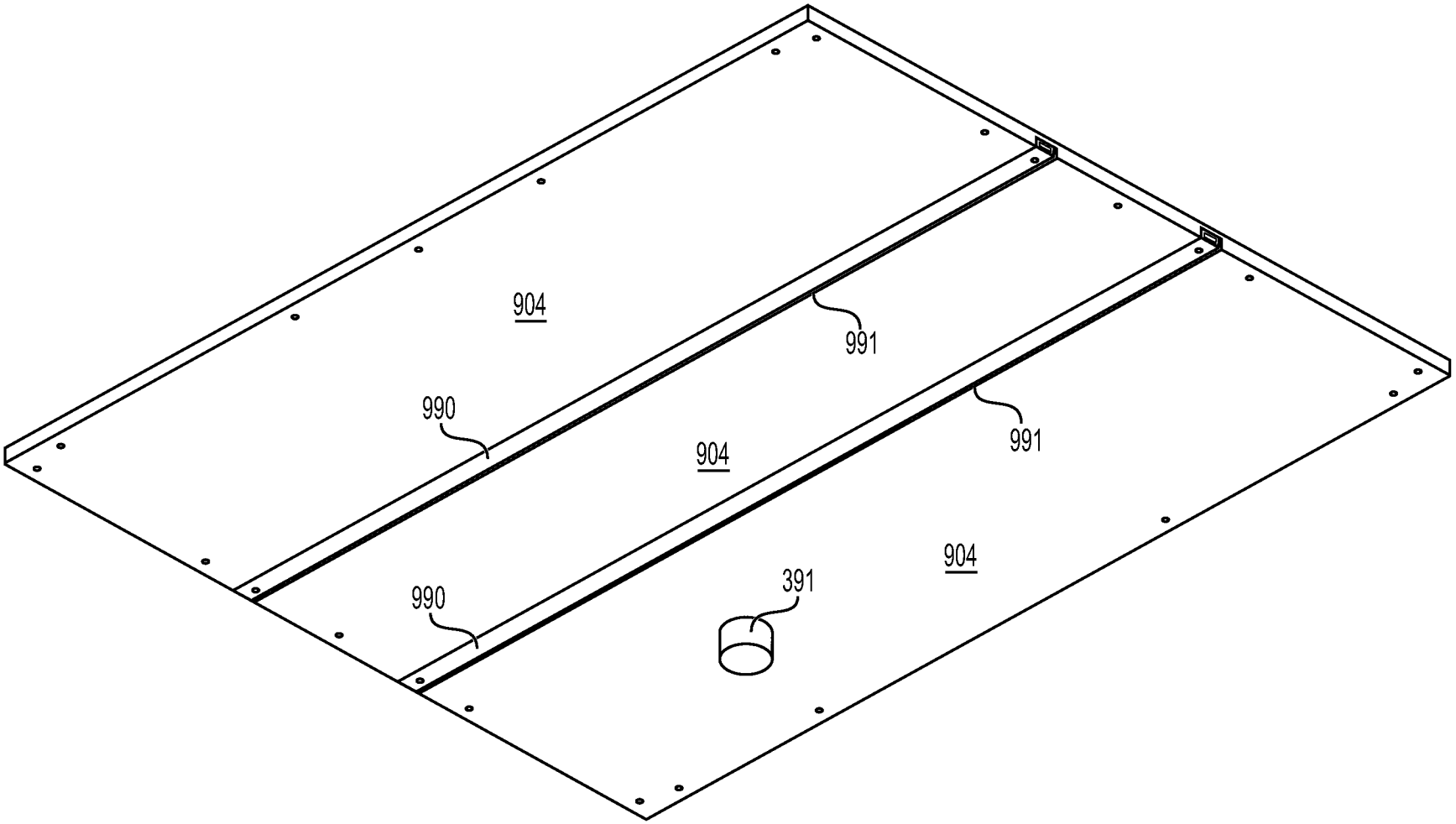
FIG. 18F is a bottom perspective view of the bathroom floor component of FIG. 18A without longitudinal or anti-compression elements.
Figure 18G:
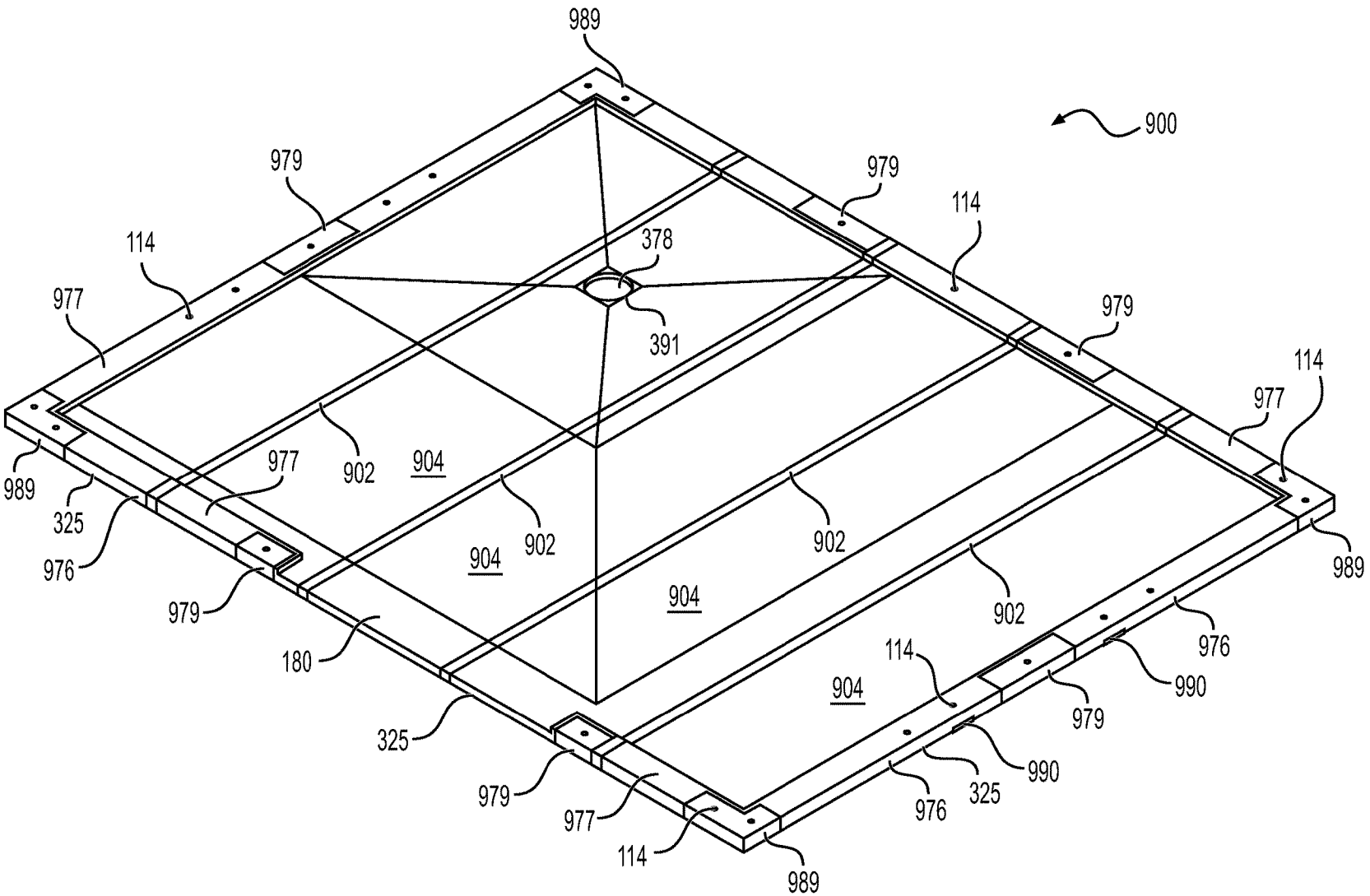
FIG. 18G is a top perspective view of the bathroom floor component of FIG. 18A with anti-compression elements.
Figure 18H:
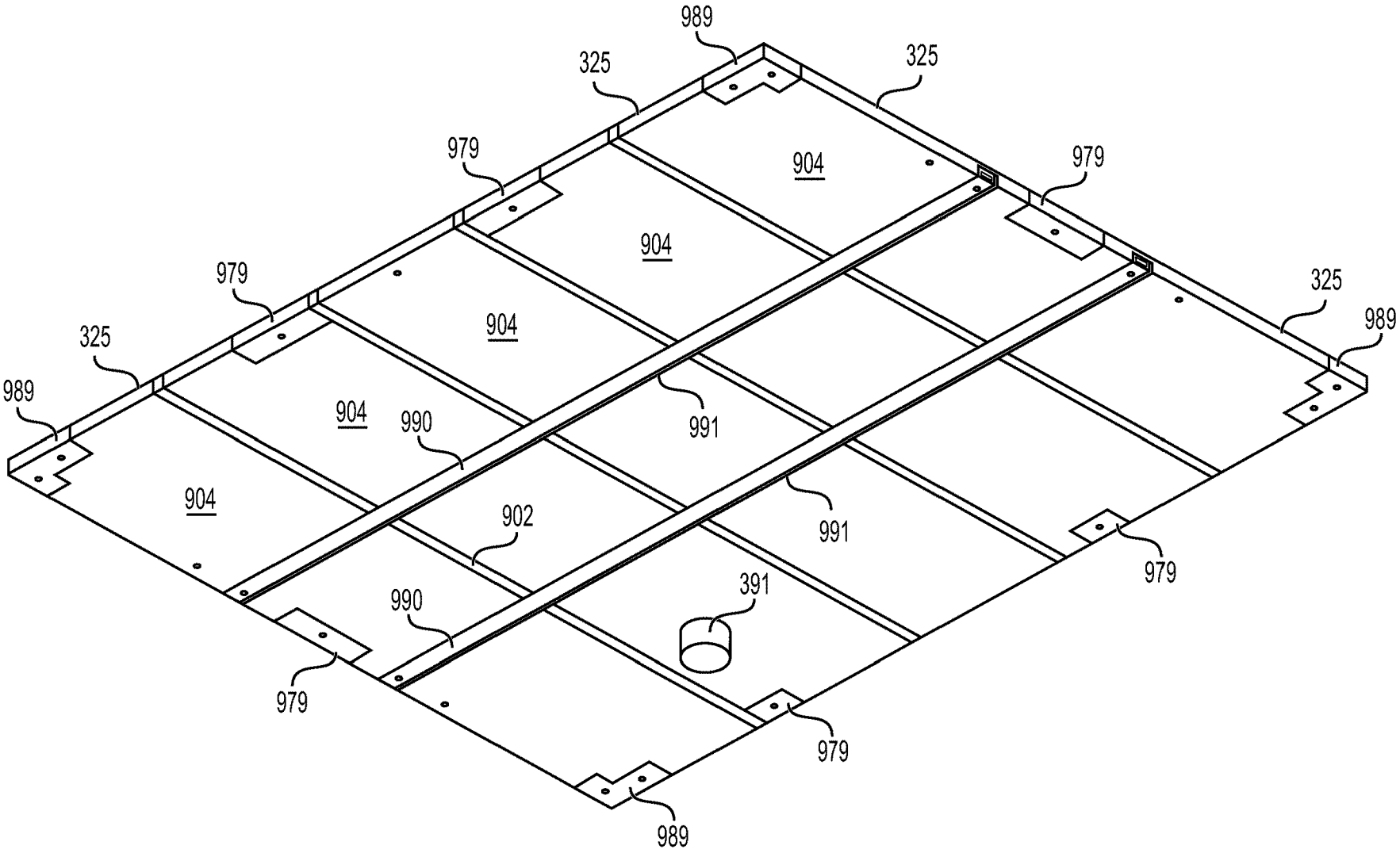
FIG. 18H is a bottom perspective view of the bathroom floor component of FIG. 18A.
Figure 18I:
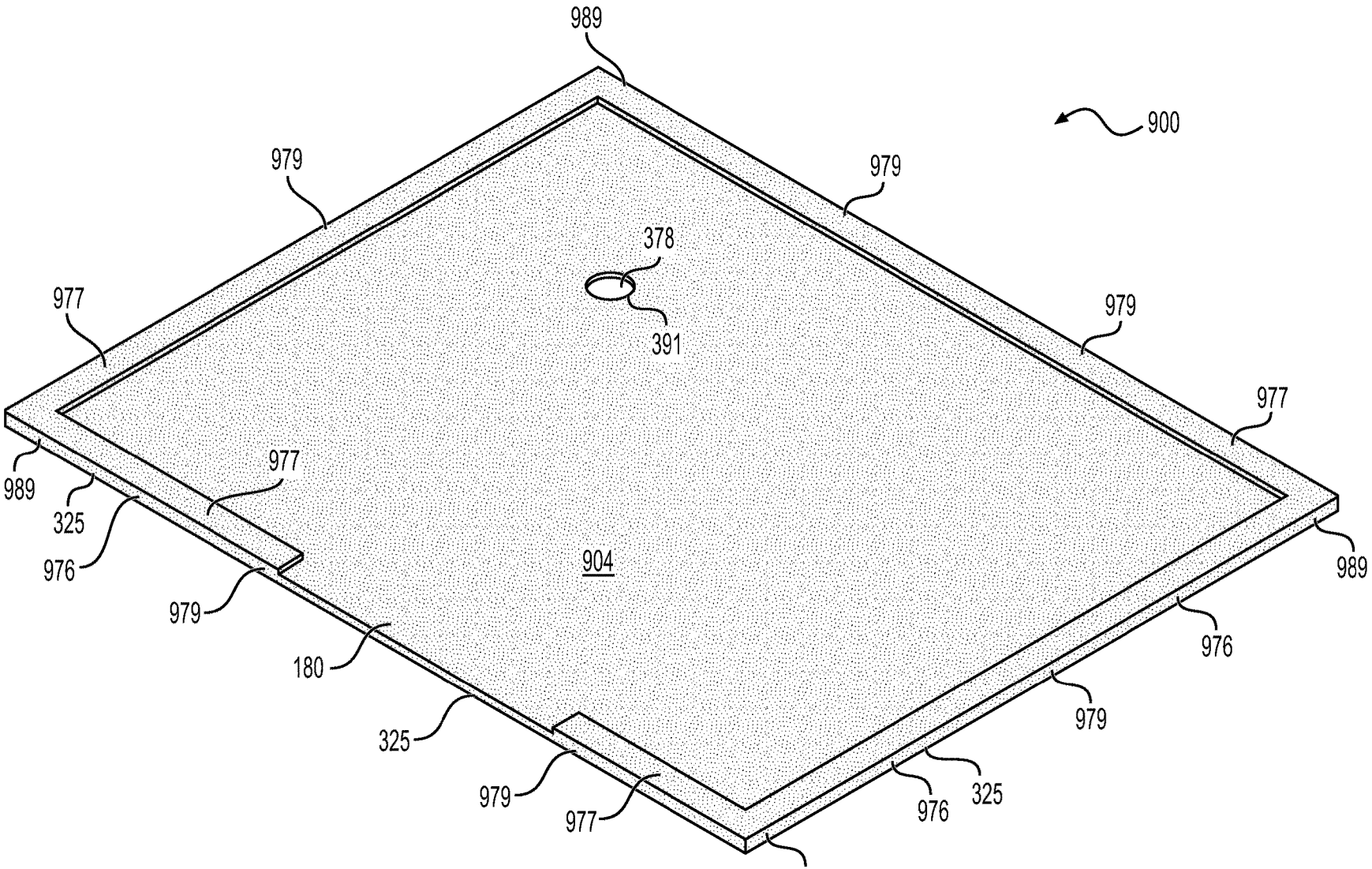
FIG. 18I is a top perspective view of the bathroom floor component of FIGS. 18E and 18G after being coated with a waterproof sealant.
Figure 18J:
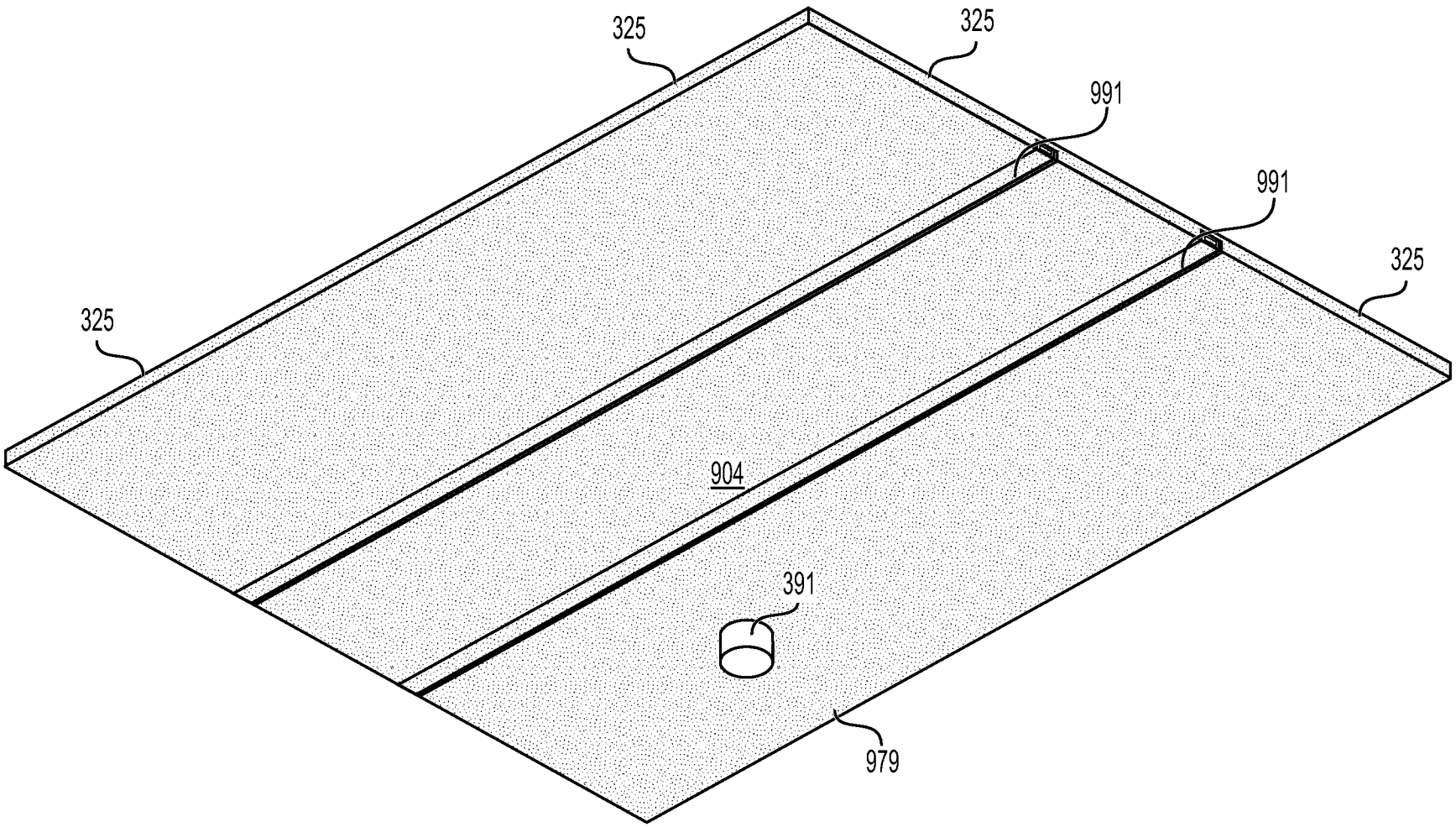
FIG. 18J is a bottom perspective view of the bathroom floor component of FIGS. 18F and 18H after being coated with a waterproof sealant.

FIG. 7A is a cross-sectional exploded elevational view of the embodiment of a prefabricated bathroom floor component shown in FIG. 3A. FIG. 7B is a cross-sectional exploded elevational view of the embodiment of a prefabricated bathroom floor component shown in FIG. 15B. FIG. 7C is a cross-sectional exploded elevational view of the embodiment of a prefabricated bathroom floor component shown in FIG. 15C. FIG. 7D is a cross-sectional exploded elevational view of the embodiment of a prefabricated bathroom floor component shown in FIG. 18D. FIG. 7E is a cross-sectional exploded elevational view of the embodiment of a prefabricated bathroom floor component shown in FIG. 23.

Figure 8A:
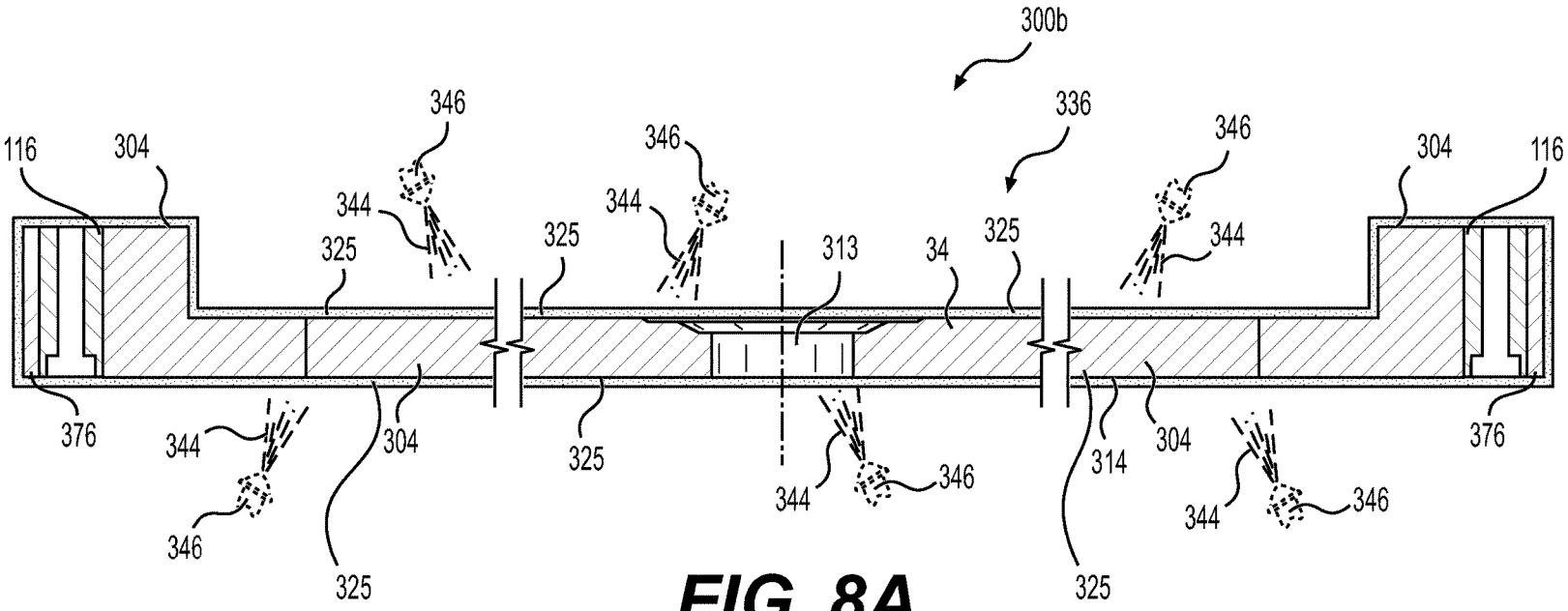
FIG. 8A depicts a waterproof sealant being applied to the prefabricated bathroom floor component of FIG. 3A.
Figure 8B:
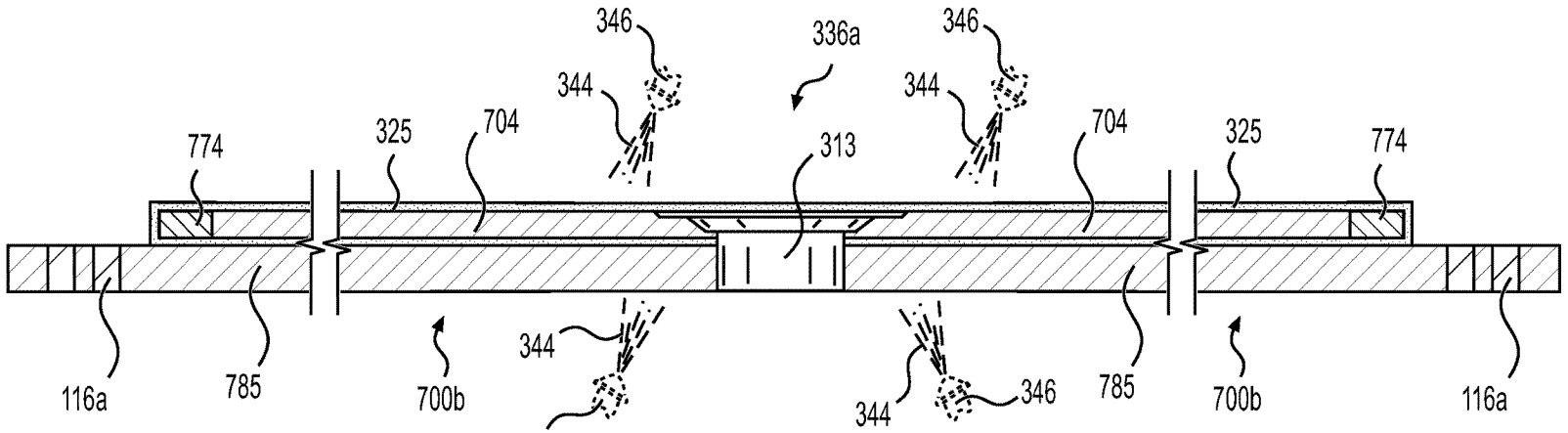
FIG. 8B depicts a waterproof sealant being applied to the prefabricated bathroom floor component of FIG. 15C.
Figure 8C:
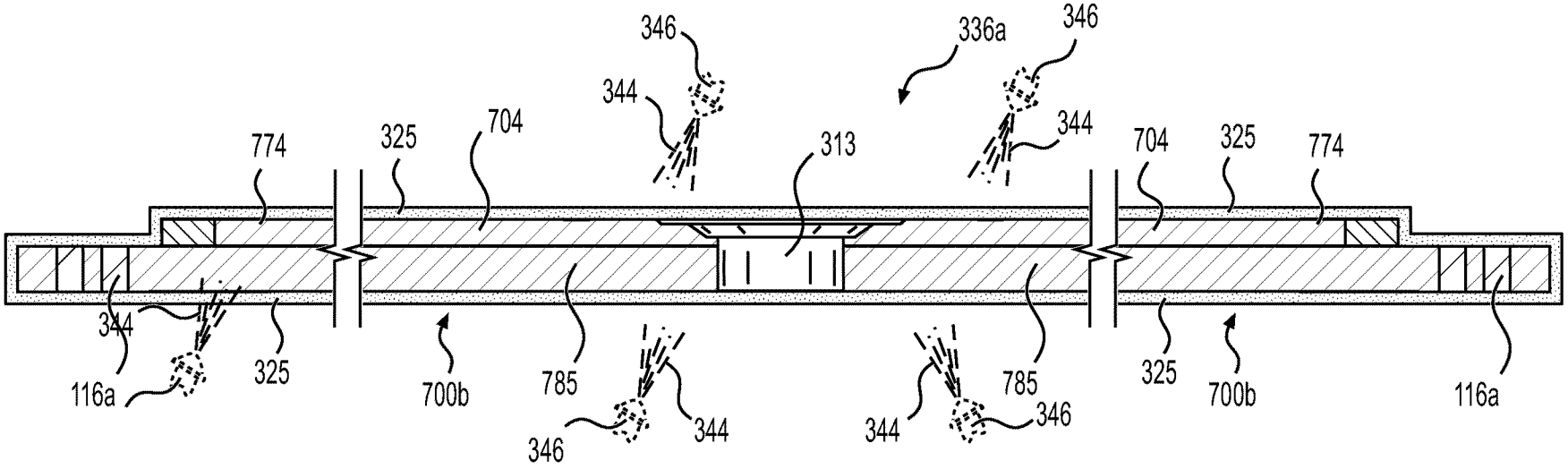
FIG. 8C depicts a waterproof sealant being applied to the prefabricated bathroom floor component of FIG. 15D.
Figure 8D:
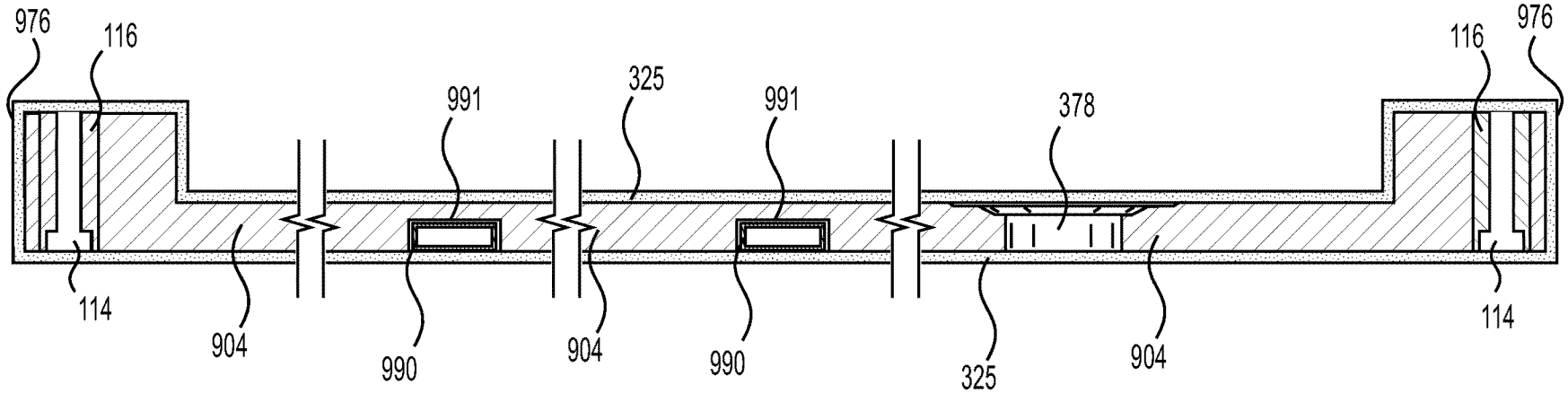
FIG. 8D depicts a waterproof sealant being applied to the prefabricated bathroom floor component of FIG. 18D.
Figure 8E:
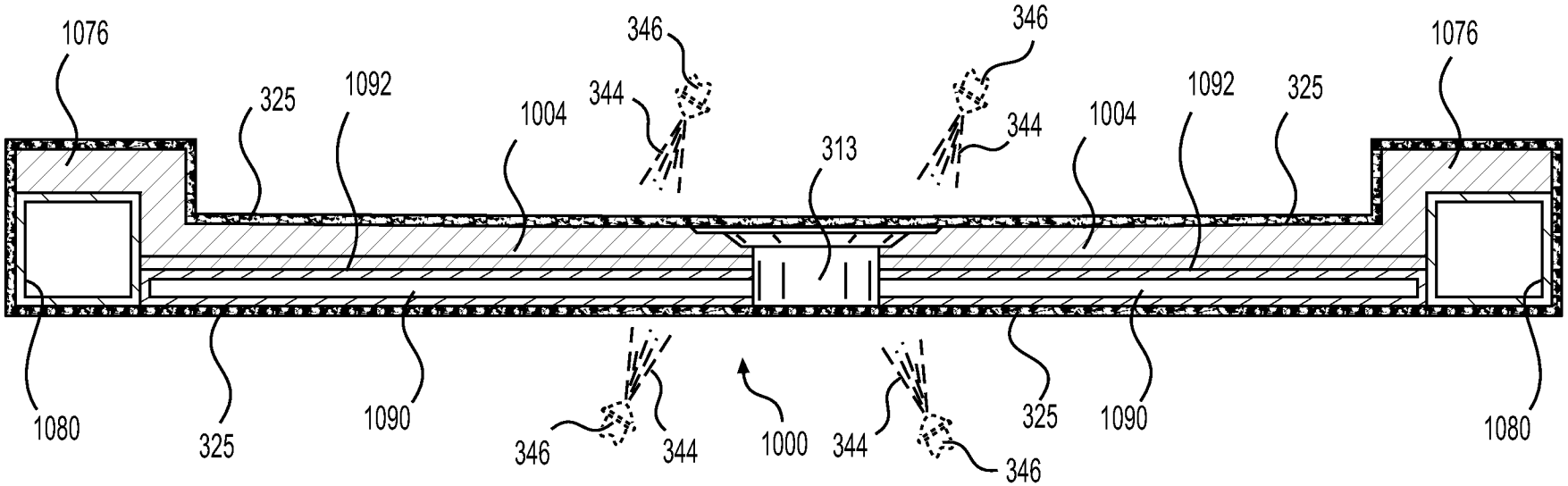
FIG. 8E depicts a waterproof sealant being applied to the prefabricated bathroom floor component of FIG. 23.

FIG. 8A depicts a waterproof sealant being applied to the prefabricated bathroom floor component of FIG. 3A. FIG. 8B depicts a waterproof sealant being applied to the prefabricated bathroom floor component of FIG. 15C. FIG. 8C depicts a waterproof sealant being applied to the prefabricated bathroom floor component of FIG. 15D. FIG. 8D depicts a waterproof sealant being applied to the prefabricated bathroom floor component of FIG. 18D. FIG. 8E depicts a waterproof sealant being applied to the prefabricated bathroom floor component of FIG. 23.

INDUSTRIAL APPLICABILITY

As seen in connection with FIGS. 9-10, in practice, a bathroom chamber or pod, and a pod bathroom floor component, which may or may not employ a support and/or strengthening framework, may be designed, specified, sold, manufactured, bought, etc., in the commercial or custom application markets according to any of the embodiments discussed herein. That is to say, any of the embodiments described herein may be used to retrofit, repair or refurbish a building or prefabricated bathroom pod, or bathroom floor, or may be used to construct a new bathroom pod for or in a building of any type.

The prefabricated bathroom pods, the bathroom floor components, and any support apparatus disclosed herein may provide easier, quicker and less expensive ways to construct buildings.

It is to be understood that the arrangements disclosed herein are suitable for use with any drain location, even though embodiments are shown using specific drain locations. Such locations are shown for example purposes only, it being understood that the principles of the present disclosure may be applied to create more embodiments.

In broader terms than heretofore discussed, a method for fabricating and/or using embodiments of the present disclosure may be characterized as follows with reference to FIGS. 9-10.

Figure 9A:
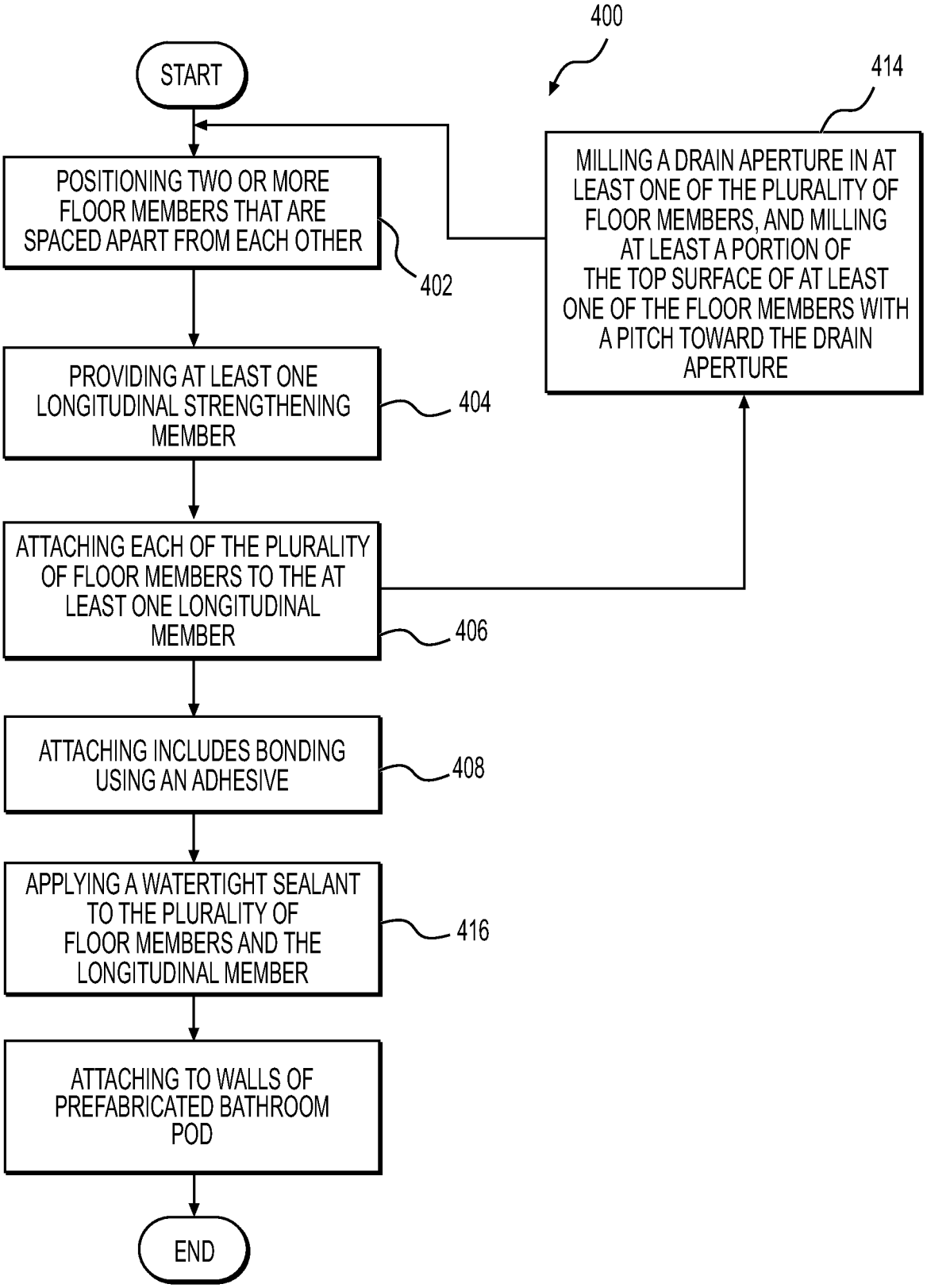
FIG. 9A is a flow chart depicting a method of manufacture and use of prefabricated bathroom floor components according to an embodiment of the present disclosure.

With reference to FIG. 9A, the method 400 may comprise the following steps presented in no particular order: step 402 may include positioning either two or more plastic and/or foam floor members 304 that are spaced apart from each other, step 404 may include providing one or more longitudinal strengthening cross-brace members 302, and step 406 may include attaching each of the one or more plastic and/or foam floor members 304 to the at least one longitudinal strengthening members 302. Referring still to FIG. 9A, in some embodiments, the step 406 of attaching at least one or more of the plurality of plastic and/or foam members 304 to at least one or more of the plurality longitudinal transverse strengthening members 302, includes bonding using an adhesive (see step 408).

The method 400 may further comprise milling or otherwise rendering a drain aperture in at least one or more of the floor members, and milling the top surface of one or more of the floor members, or portions thereof, with a pitch, such as but not by way of limitation, toward the drain aperture at any appropriate time(s) (step 414).

In some embodiments, the method 400 may further comprise applying a waterproof sealant to the one or more of the plurality of floor members and the longitudinal strengthening member(s) 302 (step 416).

Figure 10A:
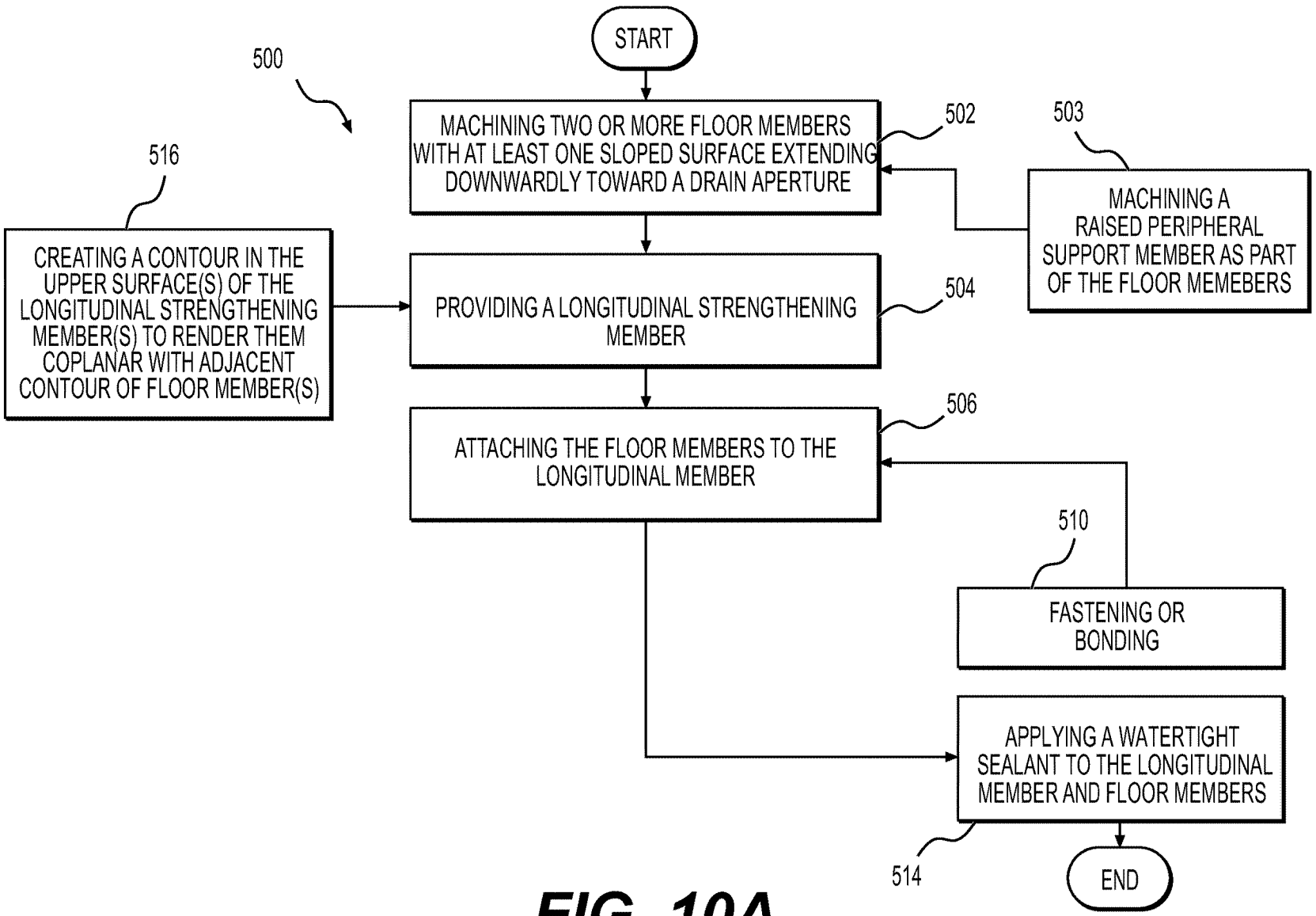
FIG. 10A is a flow chart depicting the method of manufacture and use of prefabricated bathroom floor components according to FIG. 9A.

Looking now at FIG. 10A, another method 500 of fabricating a pod bathroom floor component will now be described.

The method 500 may comprise machining a first plastic and/or foam floor member with at least one sloped surface extending downwardly toward a drain aperture and a peripheral strengthening raised platform member (step 502), machining a second foam floor member with a peripheral strengthening raised platform member (step 503), providing one or more longitudinal strengthening member(s) (step 504), joining the first and second floor members to opposite side edges of the longitudinal strengthening member (step 506), and applying a waterproof sealant to the assembly (step 514).

Step 506 may include attaching the floor members to the longitudinal strengthening member by fastening or bonding using an adhesive (step 510).

The method may further comprise creating a contour in the upper surface of the longitudinal strengthening member(s) 302 to coincide with the contour of the upper surface of the adjacent floor members to render the upper surfaces of the longitudinal strengthening member(s) 302 coplanar with the contour of the upper surface of the adjacent floor members, to permit application of a floor covering (e.g., floor tile) that is to be attached to the floor members and the longitudinal strengthening member(s), if any (step 516).

Optionally, a raised peripheral support platform member, such as raised peripheral platform 376 shown in FIGS. 1-6, 976 shown in FIGS. 18A through 18H, 1076 shown in FIGS. 19 through 26, and 1176 shown in FIGS. 27 through 35, may be formed in the floor member(s), and in some cases combined with peripheral support and/or framing members disclosed herein, to create a support for the bottoms of pod walls 104.

As alluded to earlier herein, once the floor component has been manufactured with a wall strengthening raised peripheral platform, then it may be attached to the walls, and indirectly the ceiling, etc., to make an assembled bathroom pod.

Figure 9B:
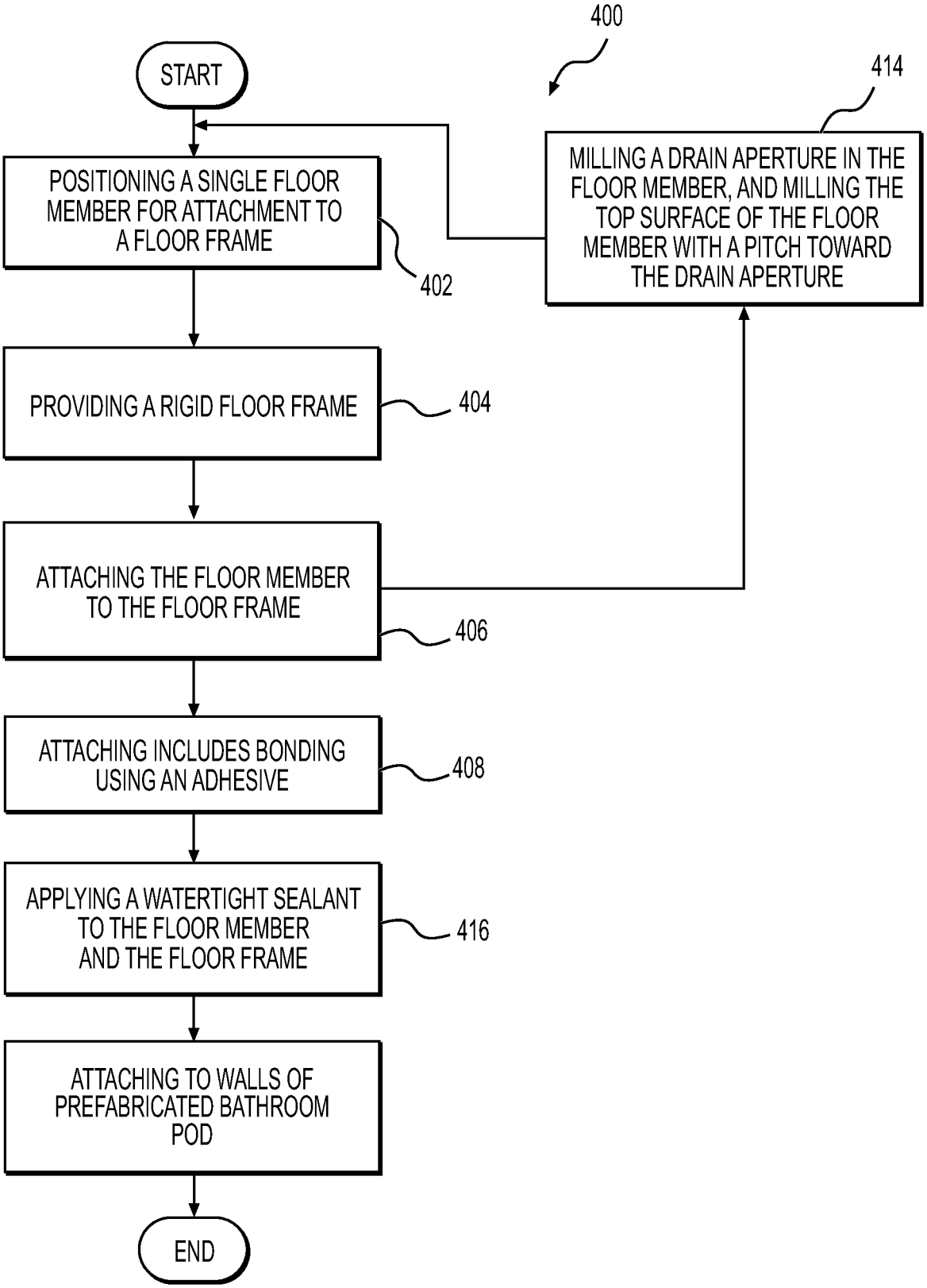
FIG. 9B is a flow chart depicting a method of manufacture and use of prefabricated bathroom floor components according to another embodiment of the present disclosure.
Figure 24:
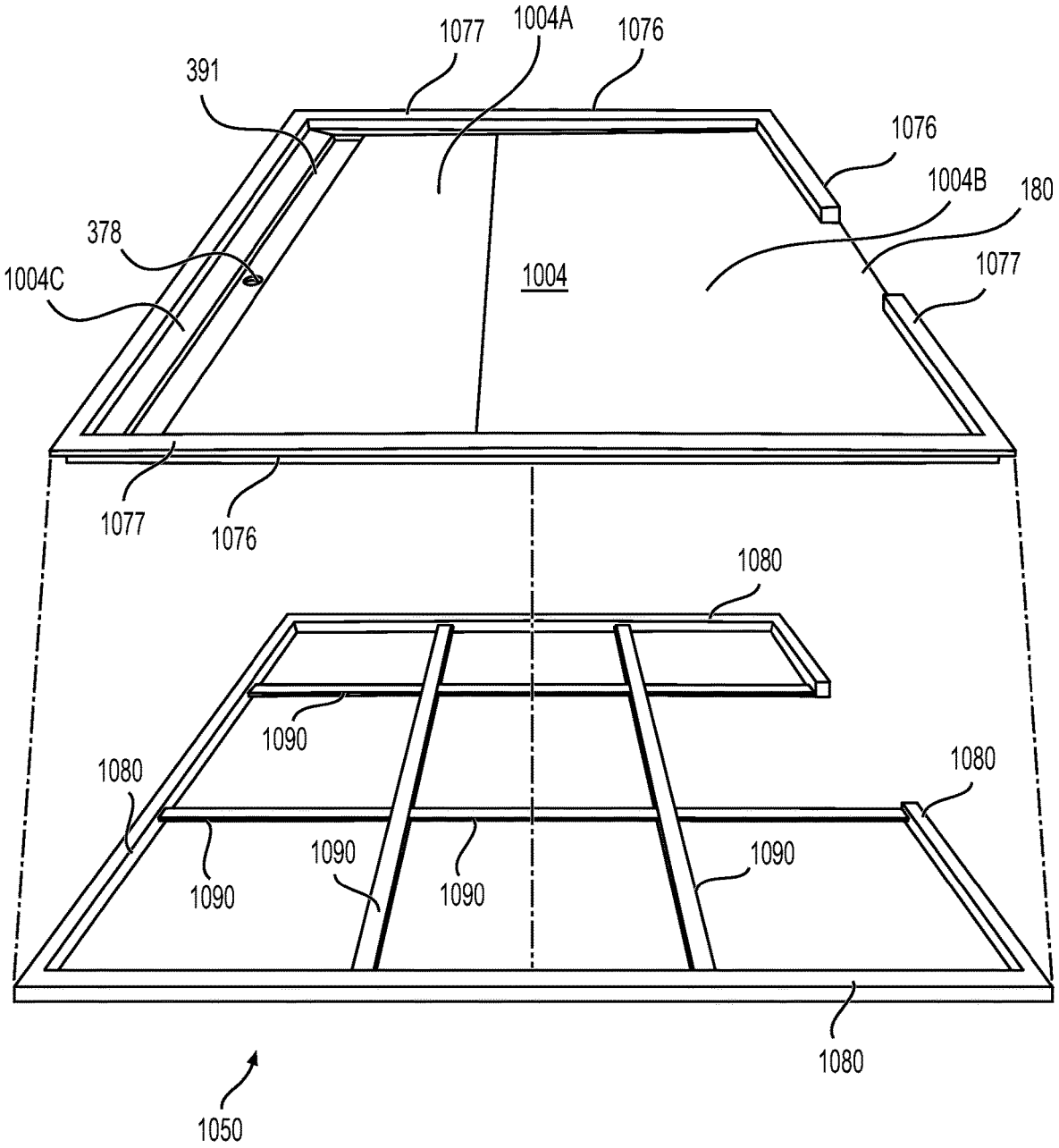

With reference to FIG. 9B, the method comprises providing a single bathroom floor panel, such as panel 1004 shown in FIG. 24, and a support frame, such as frame 1050 shown in FIG. 24. The panel(s) defines a peripheral raised support platform 1076 which in turn defines apertures 120 through which fasteners may be passed to be used during an attachment step to be discussed in more detail below.

At step 414, a drain aperture is milled or otherwise rendered in the floor panel, as well as any desired floor pitch/slope.

In step 406, the raised platform 1076 of the bathroom floor component is placed in registry with the floor frame 1050

The bathroom floor panel 1004 and frame 1050 are then coated with a waterproof coating 325 as described above, which not only creates a waterproof floor component but adds significant strength and rigidity to the bathroom floor component and, thereby, to the pod overall.

The raised support platform 1076 coincides substantially with a footprint defined by lower edges of the pod walls 104. The lower edges of the pod walls 104 are placed in registry with the raised platform 1076 and fastened to the pod walls 104. Wall and floor covering material such as wall and floor tile 390, 394 may thereafter be applied to the pod walls and floor in a manner well known to those skilled in the art. A sturdy pod is thus created, and can be transported to and installed at a construction site.

Figure 10B:
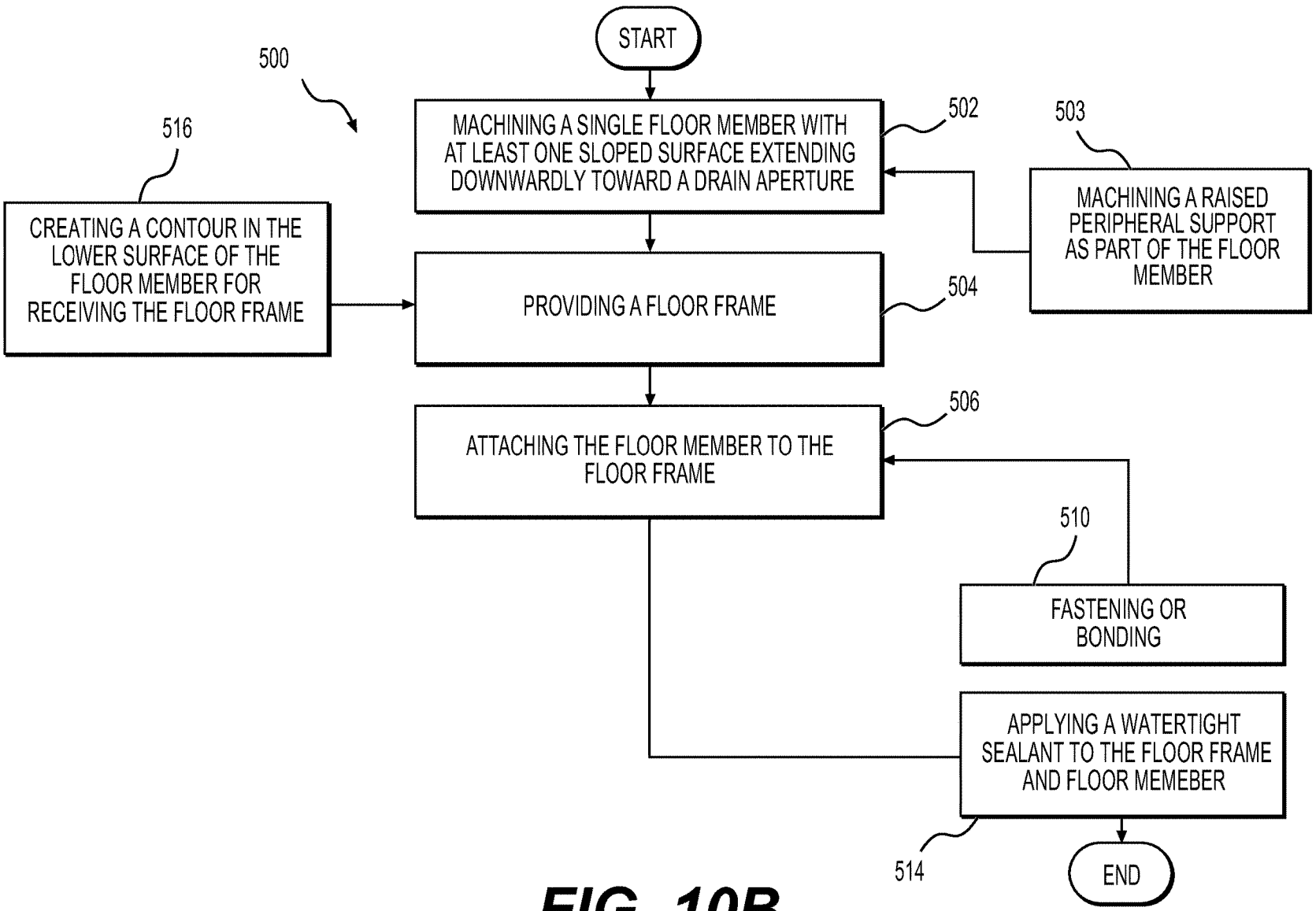
FIG. 10B is a flow chart depicting the method of manufacture and use of prefabricated bathroom floor components according to FIG. 9B.
Figure 25:
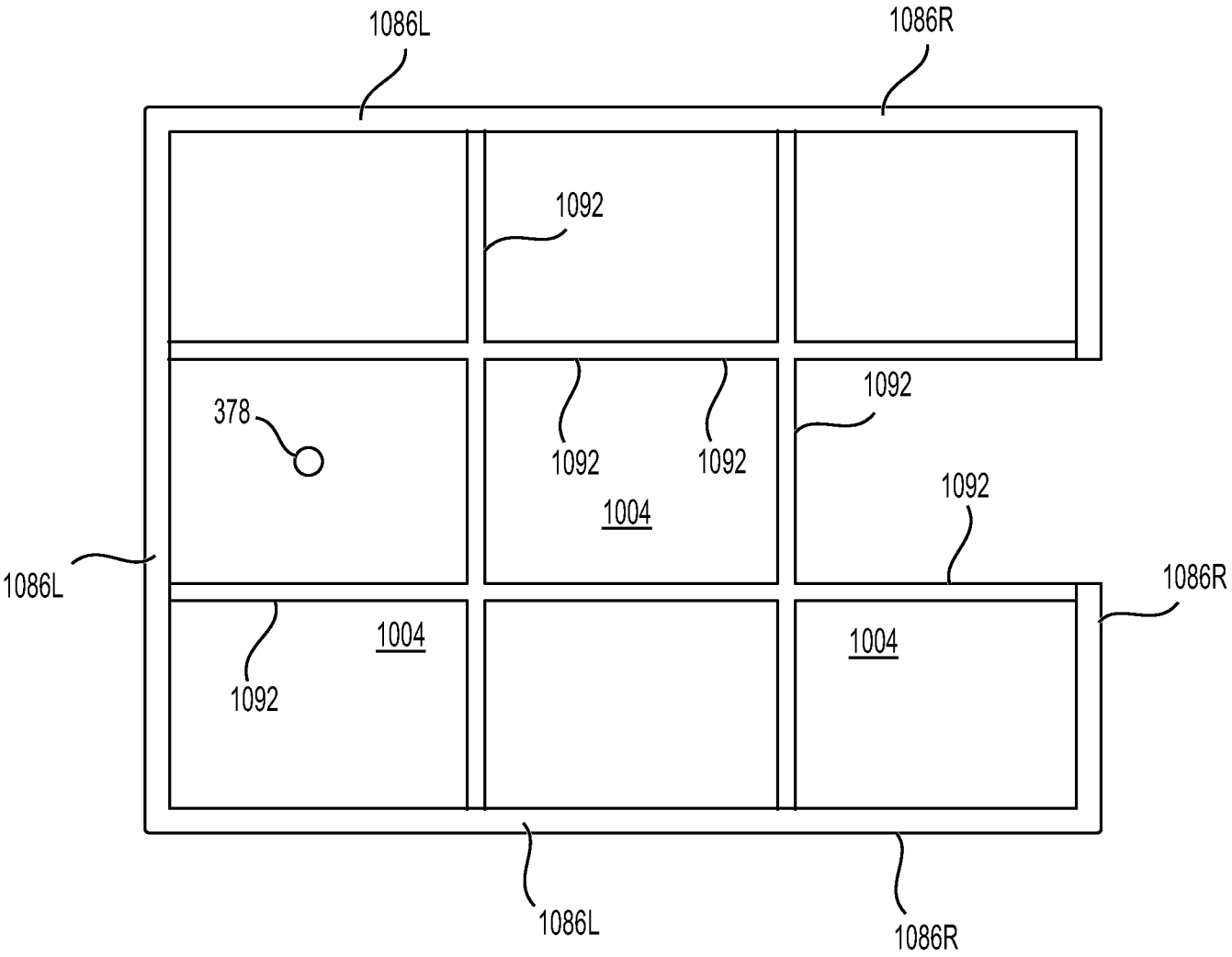
Figure 26A:
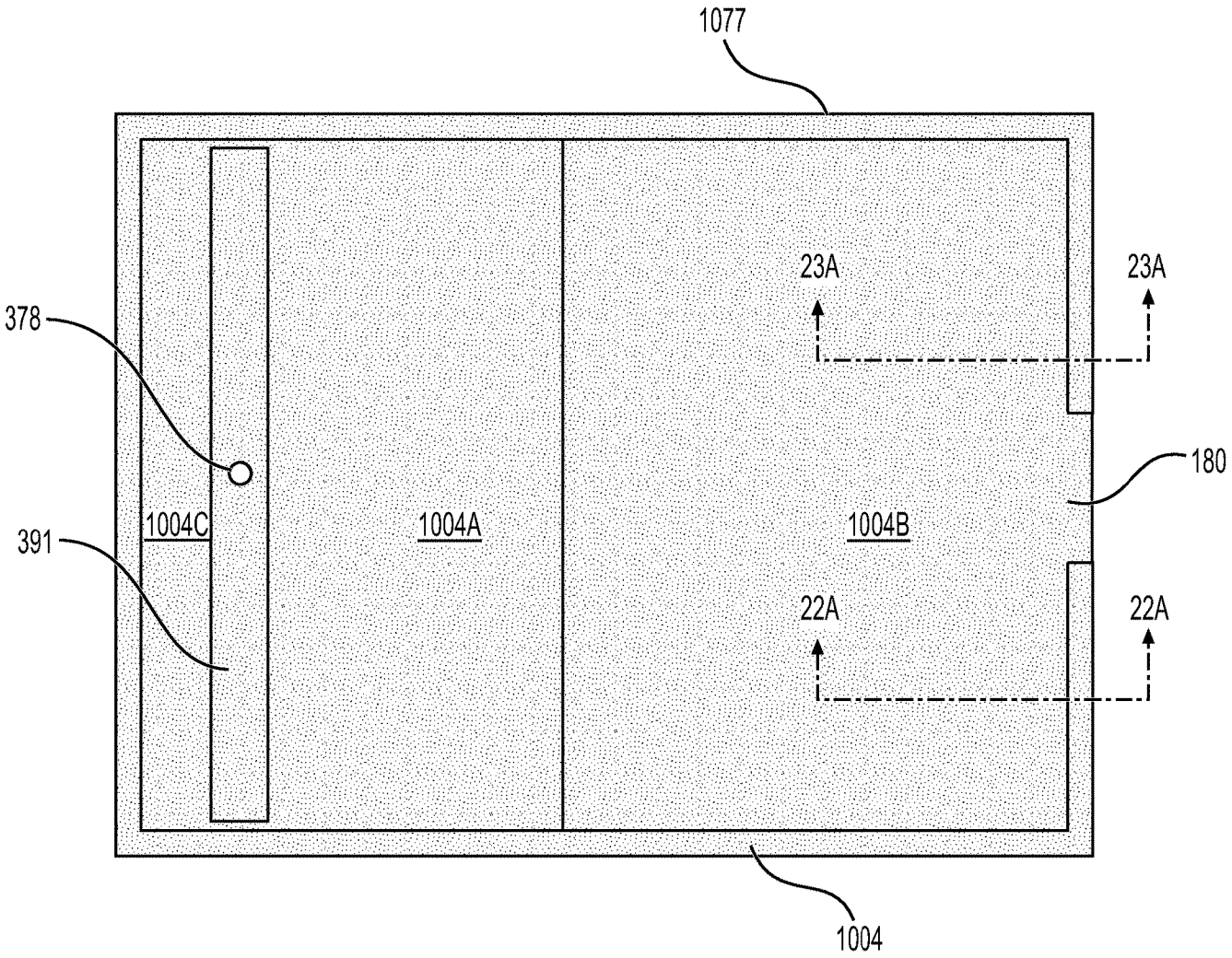
FIG. 26A is a top plan view of the bathroom floor component of FIGS. 24 and 25 after being coated with a waterproof membrane.
Figure 26B:
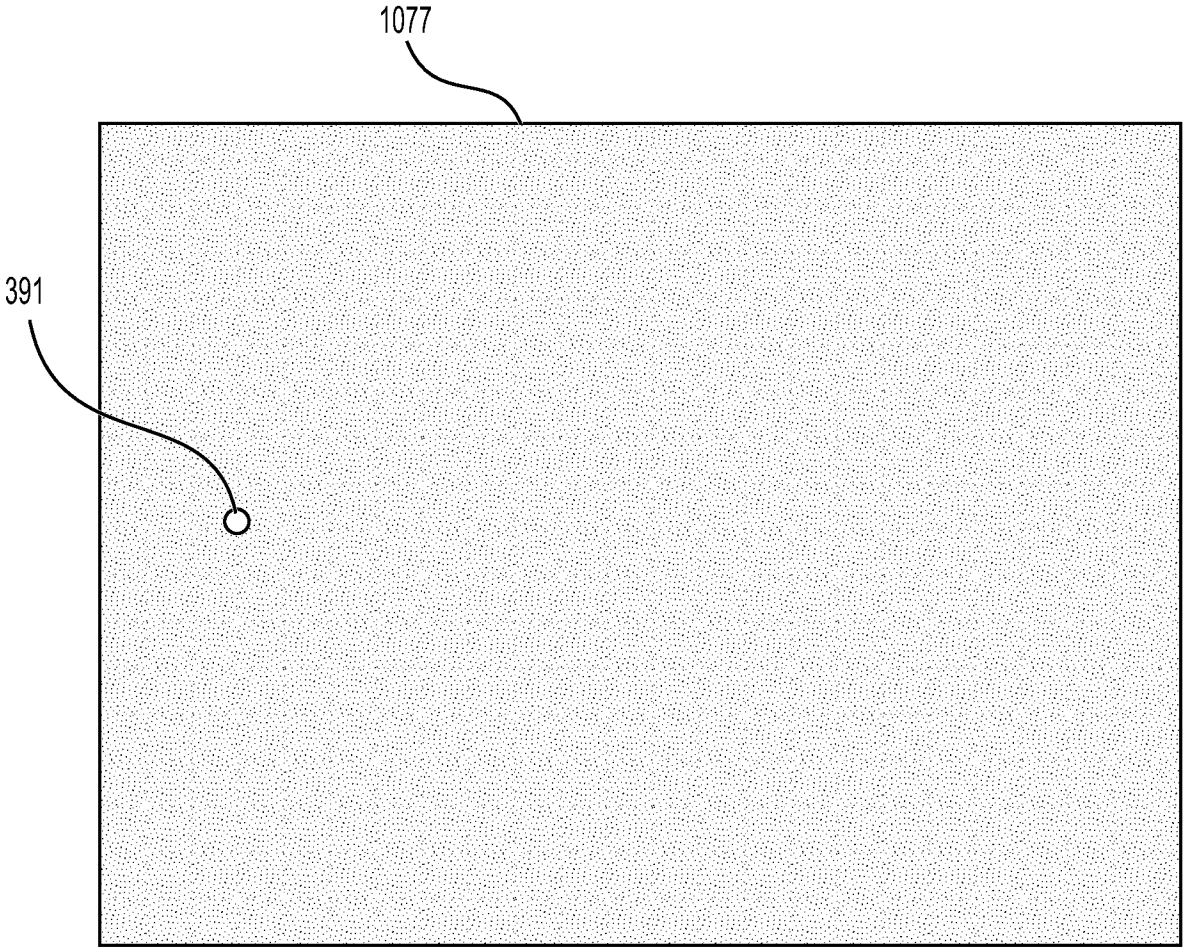

FIG. 10B depicts a process for manufacturing a pod bathroom floor component using a floor member comprised of a single floor panel, such as panel 1004 of FIGS. 24-26. In this embodiment, a pod bathroom floor component is produced by providing a single floor panel which defines raised support platform 1076, providing floor contour to an upper surface of the floor panel, including a drain aperture, placing the raised platform 1076 of the bathroom floor component in registry with the lower edges of the pod walls 104, and fastening the floor component to the pod walls. Wall and floor covering material, such as wall and floor tile 390, 394, may be applied to the pod walls and floor in a manner well known to those skilled in the art.

Figure 9C:
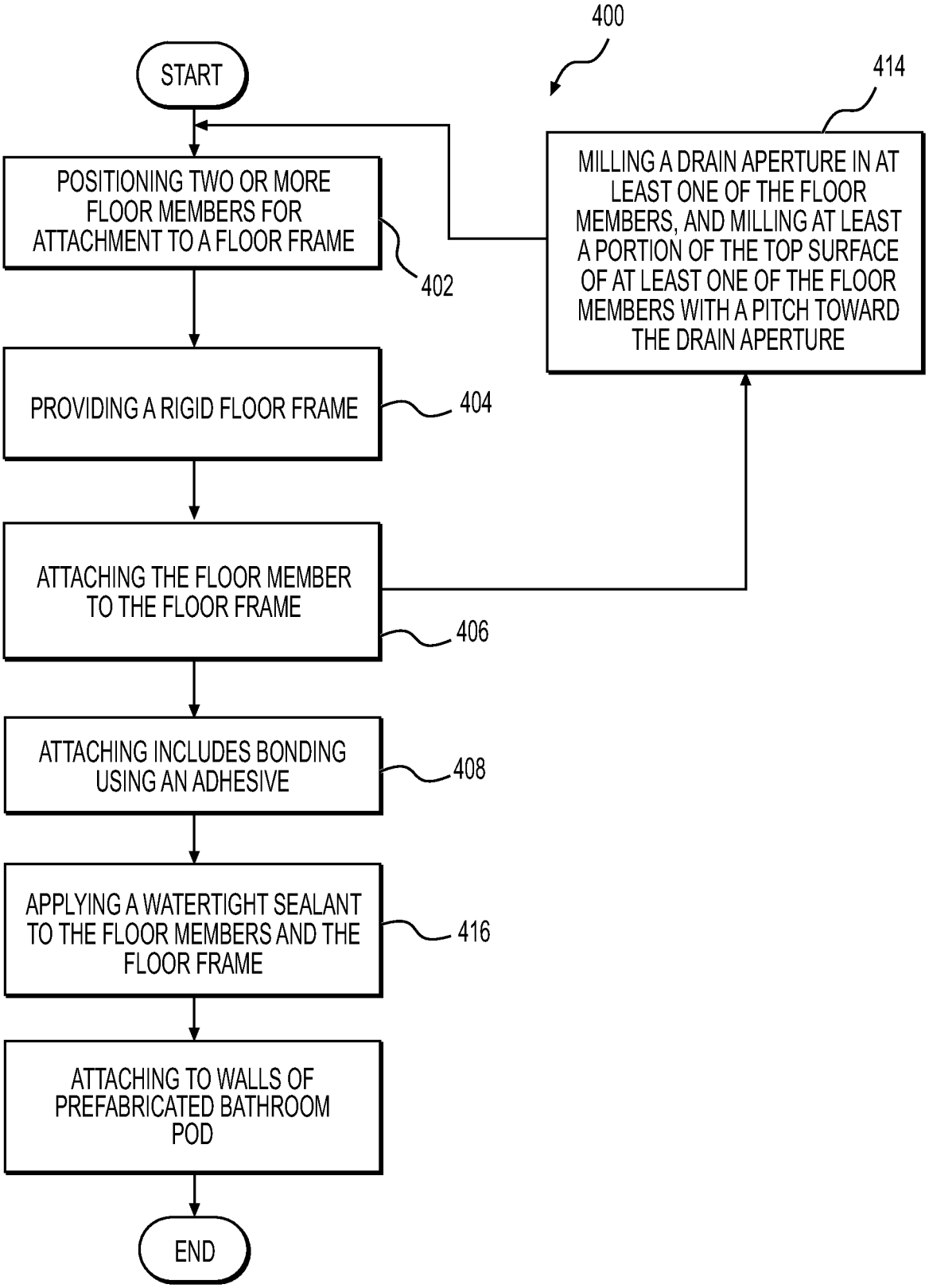
FIG. 9C is a flow chart depicting a method of manufacture and use of prefabricated bathroom floor components according to a further embodiment of the present disclosure.
Figure 19:
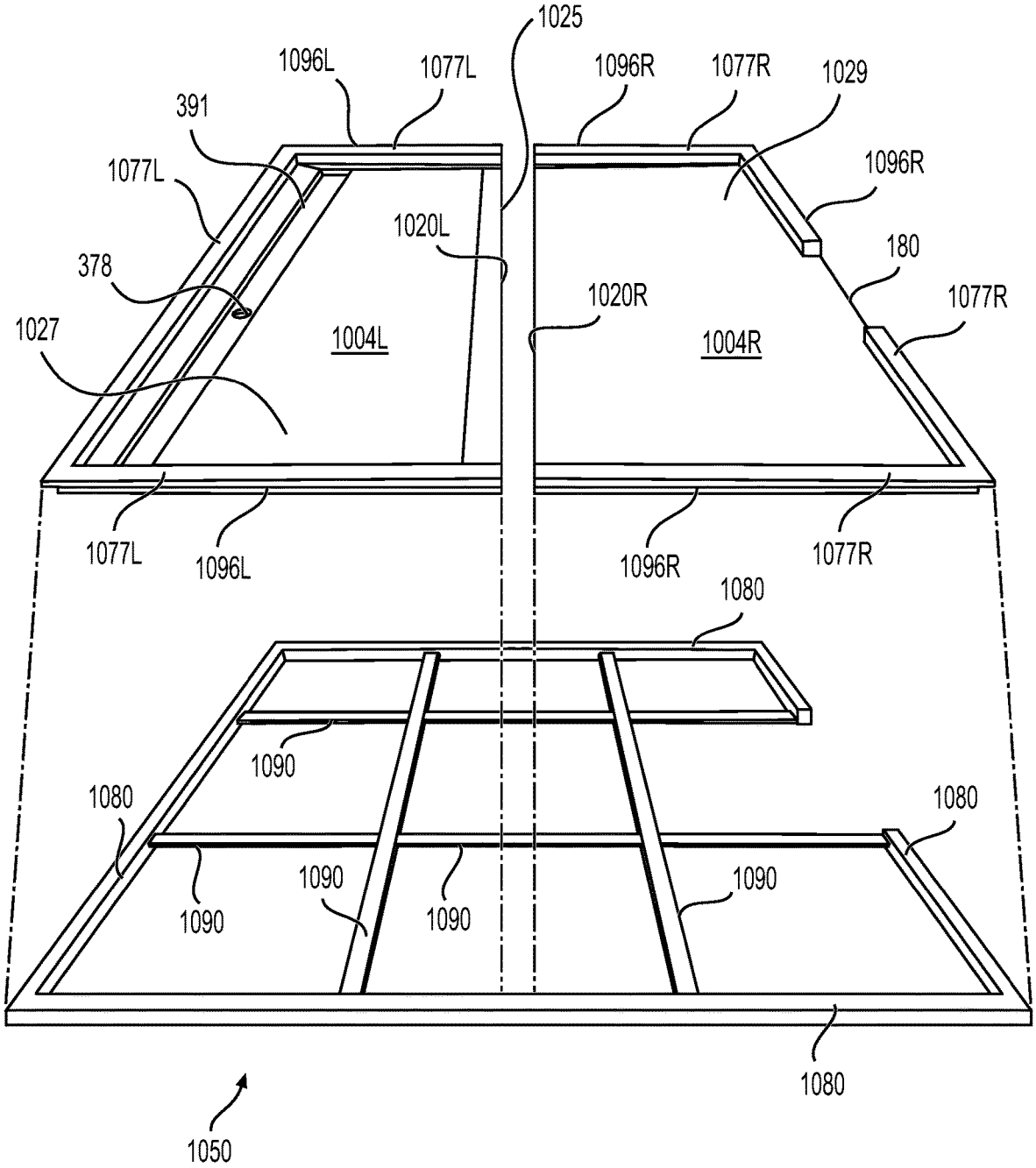
FIG. 19 is a perspective exploded view of a fourth embodiment of the invention.

FIG. 9C shows a further method comprised of: providing two or more bathroom floor panels, such as panels 1004L, 1004R shown in FIG. 19, and a support frame, such as frame 1050 shown in FIG. 19. The panels define a peripheral raised support platform 1076 which in turn defines apertures 120 through which fasteners may be passed to be used during an attachment step to be discussed in more detail below.

At step 414, a drain aperture is milled or otherwise rendered in one of the floor panels, as well as any desired floor pitch/slope.

In step 406, the raised platforms 1076L and 1076R of the bathroom floor panels 1004L, 1004R are placed in registry with the floor frame 1050.

The bathroom floor panels 10041, 1004R and frame 1050 are then coated with a waterproof coating 325 as described above, which not only creates a waterproof floor component but adds significant strength and rigidity to the bathroom floor component and, thereby, to the pod overall.

The raised support platforms 1076L, 1076R coincide substantially with a footprint defined by lower edges of the pod walls 104. The lower edges of the pod walls 104 are placed in registry with the raised platforms 1076L, 1076R and fastened to the pod walls 104. Wall and floor covering material such as wall and floor tile 390, 394 may thereafter be applied to the pod walls and floor in a manner well known to those skilled in the art.

Figure 10C:
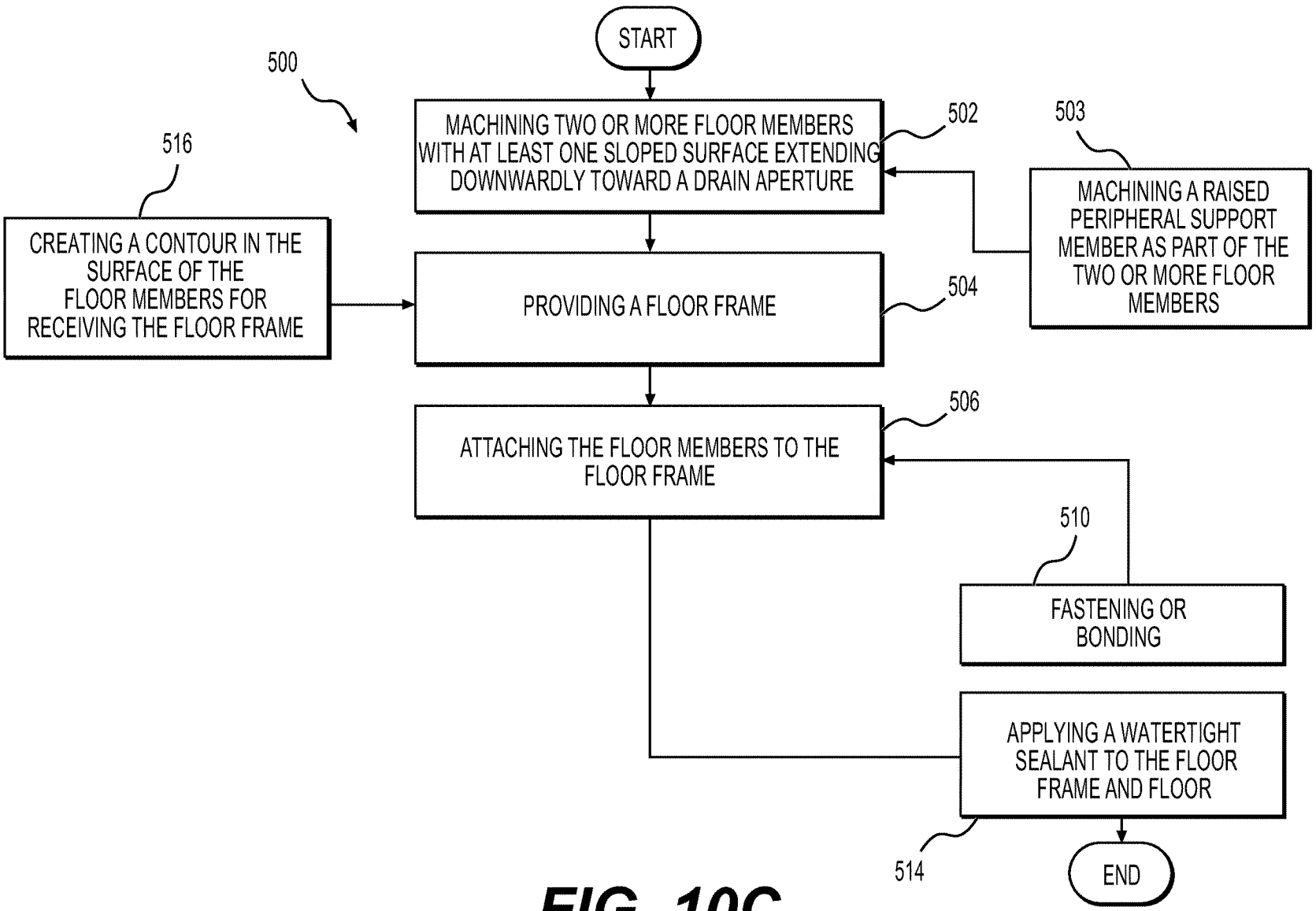
FIG. 10C is a flow chart depicting the method of manufacture and use of prefabricated bathroom floor components according to FIG. 9C.
Figure 11:
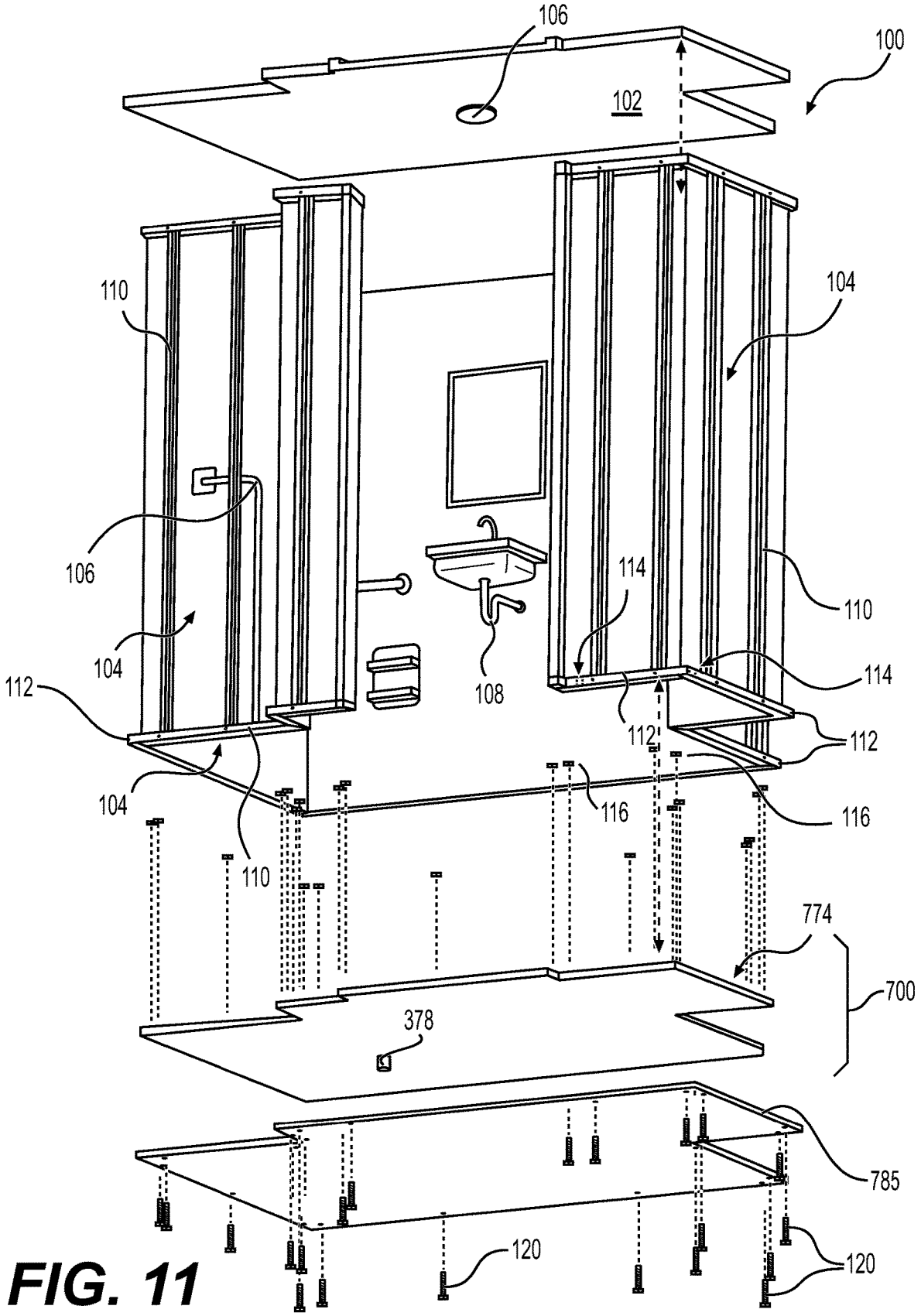
FIG. 11 is an exploded perspective view of a bathroom pod constructed with a prefabricated floor component according to a third embodiment of the present disclosure.
Figure 12:
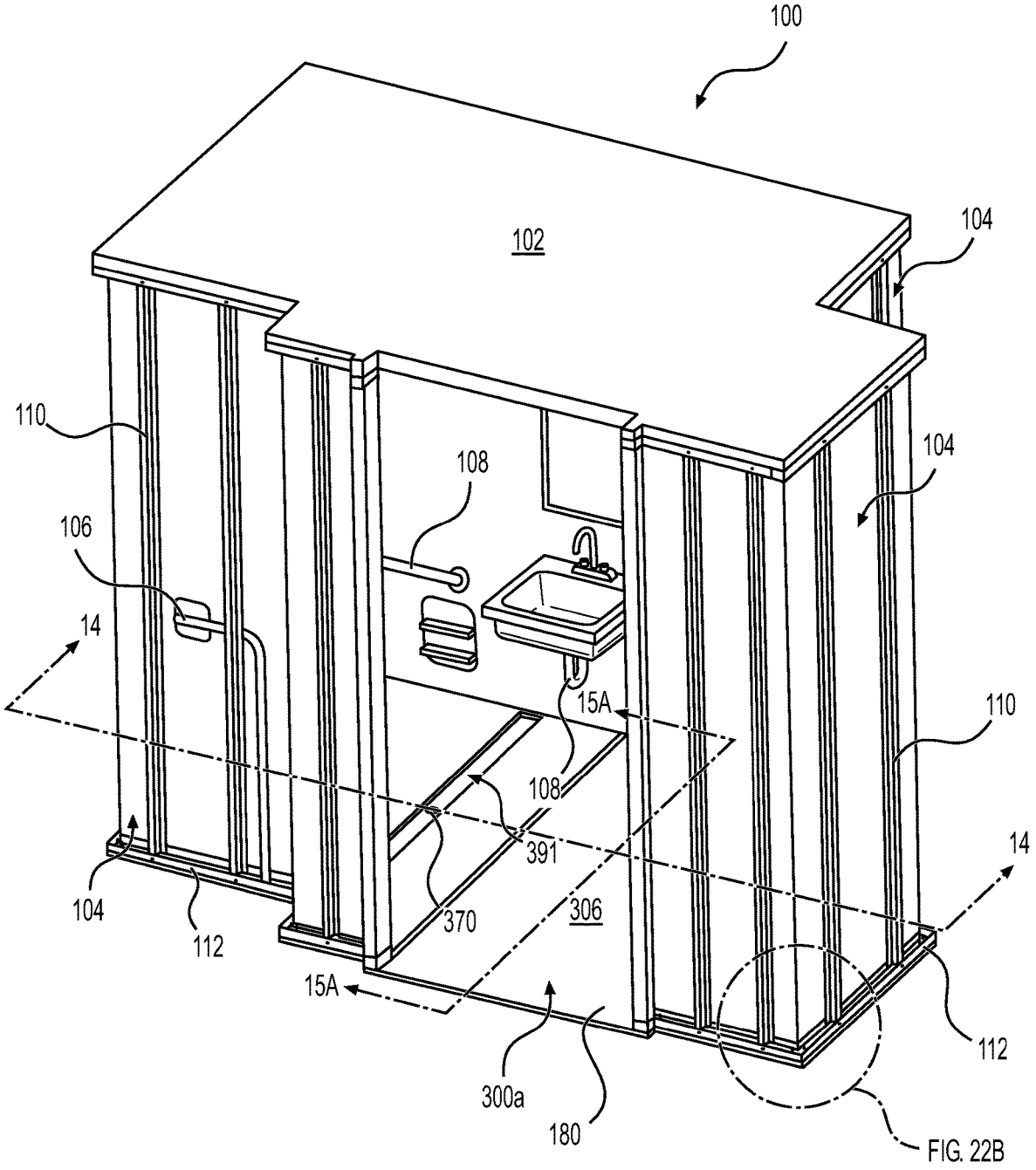
FIG. 12 is a perspective assembled view of the bathroom pod constructed with a prefabricated bathroom floor component of FIG. 11.
Figure 13:
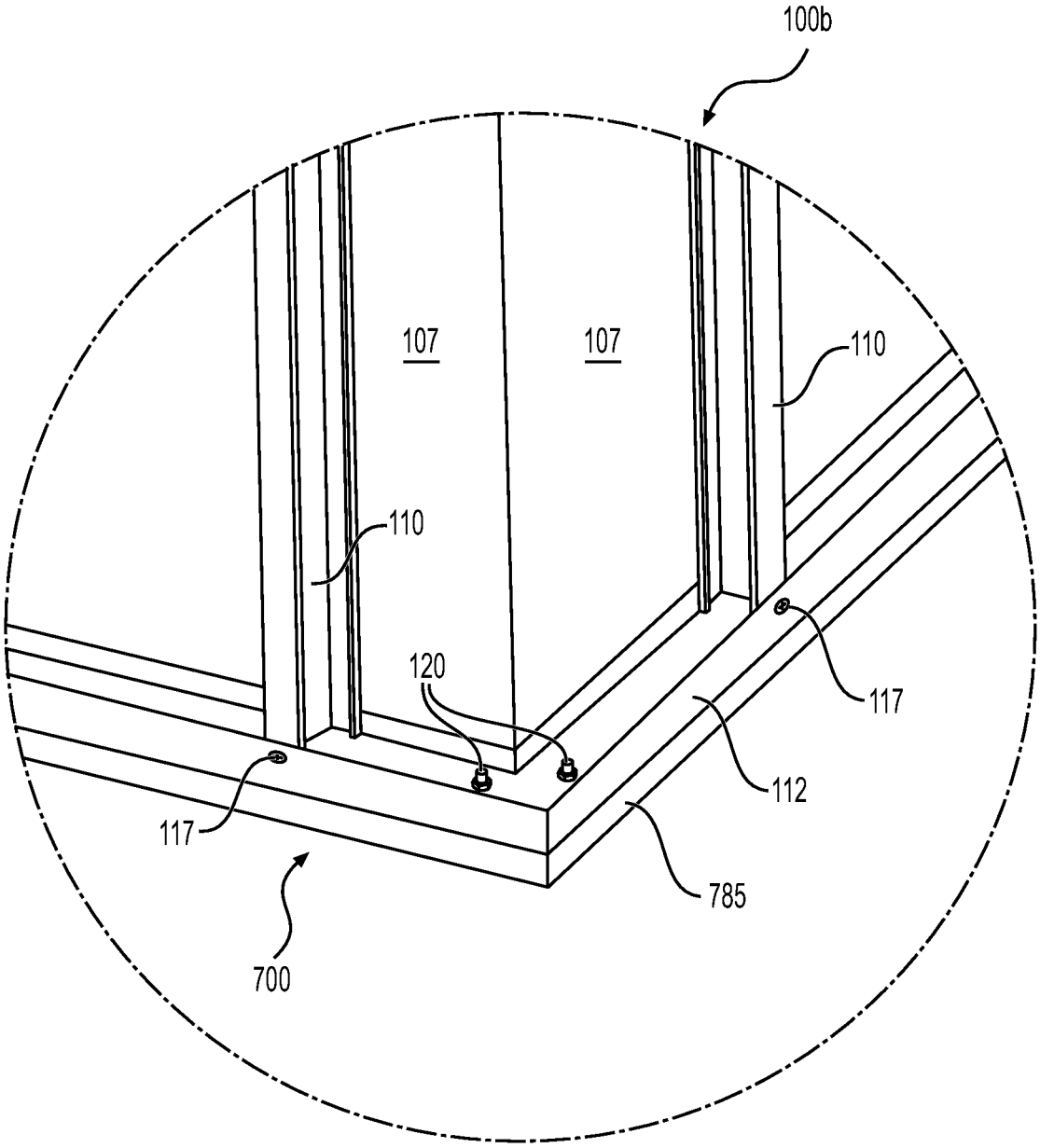
FIG. 13 is an enlarged detail view taken from FIG. 12.
Figure 14:
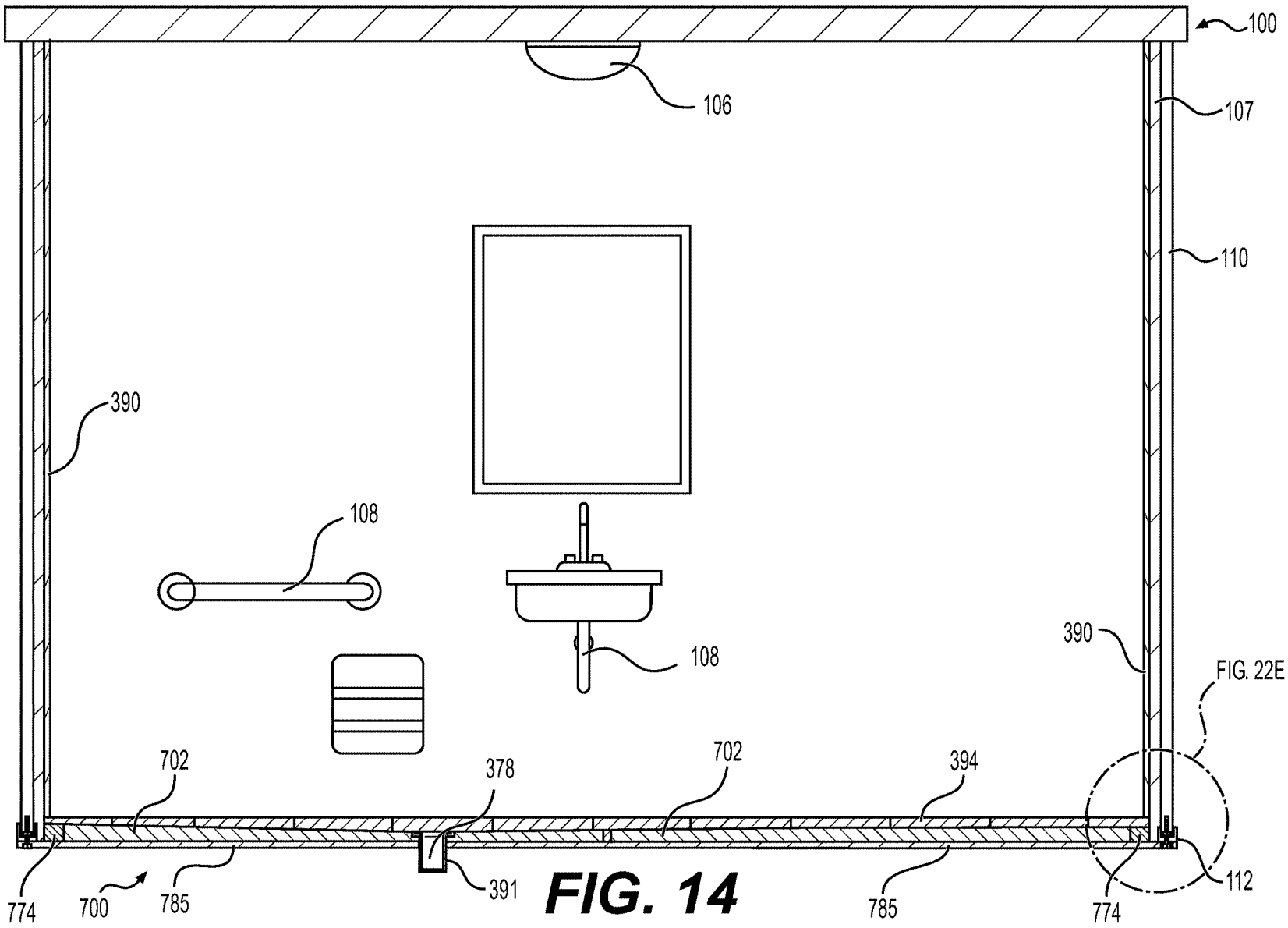
FIG. 14 is a front cross-sectional elevational view of the bathroom pod of FIG. 12, taken along lines 14-14 thereof.

FIG. 10C shows a still further process for manufacturing a pod bathroom floor component using a floor member comprised of two or more floor panels, such as panels 1004L, 1004R of FIGS. 19-23. In this embodiment, a pod bathroom floor component is produced by providing a single floor panel which defines raised support platform 1076L, 1076R, providing any desired floor contour to an upper surface of the floor panels, including a drain aperture, placing the raised platforms 1076L, 1076R of the bathroom floor component in registry with the lower edges of the pod walls 104, and fastening the floor component to the pod walls. Wall and floor covering material, such as wall and floor tile 390, 394, may be applied to the pod walls and floor in a manner well known to those skilled in the art.

Representative Prefabricated Bathroom Floor Component without Weight Bearing Perimeter Raised Platform.

FIGS. 11-17B depict a further embodiment of the invention, in which bathroom floor component 720 is comprised of one of more longitudinal strengthening members 702, peripheral strengthening members 774, and foam floor members 704. In this embodiment, no perimeter raised platforms are employed, and a third party substrate is provided to support the bathroom floor component.

Figure 16A:
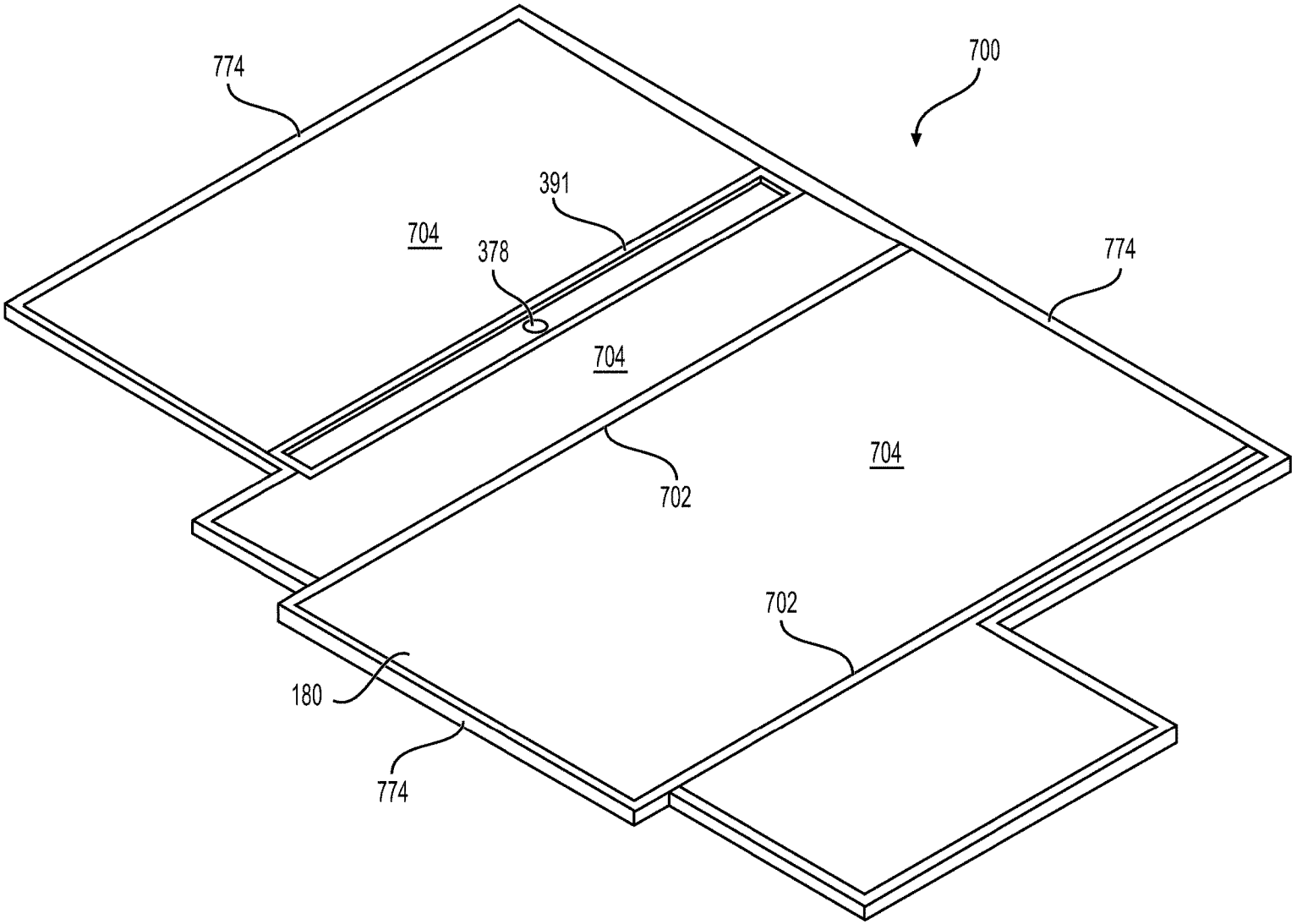
FIG. 16A is a top oriented perspective view of a prefabricated bathroom floor component before completion.
Figure 16B:
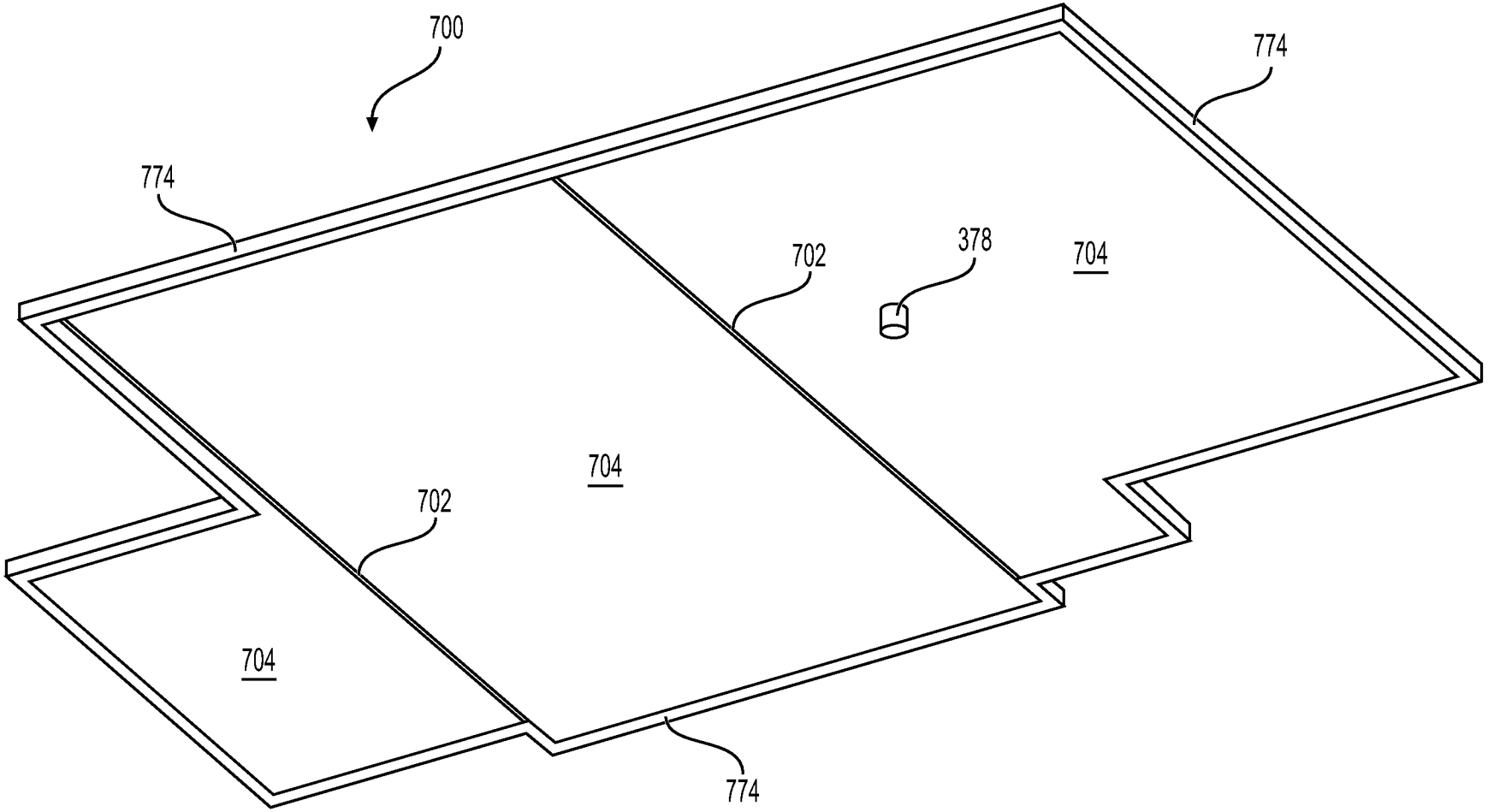
FIG. 16B is a bottom oriented perspective view of the prefabricated bathroom floor component of FIG. 16A.
Figure 17A:
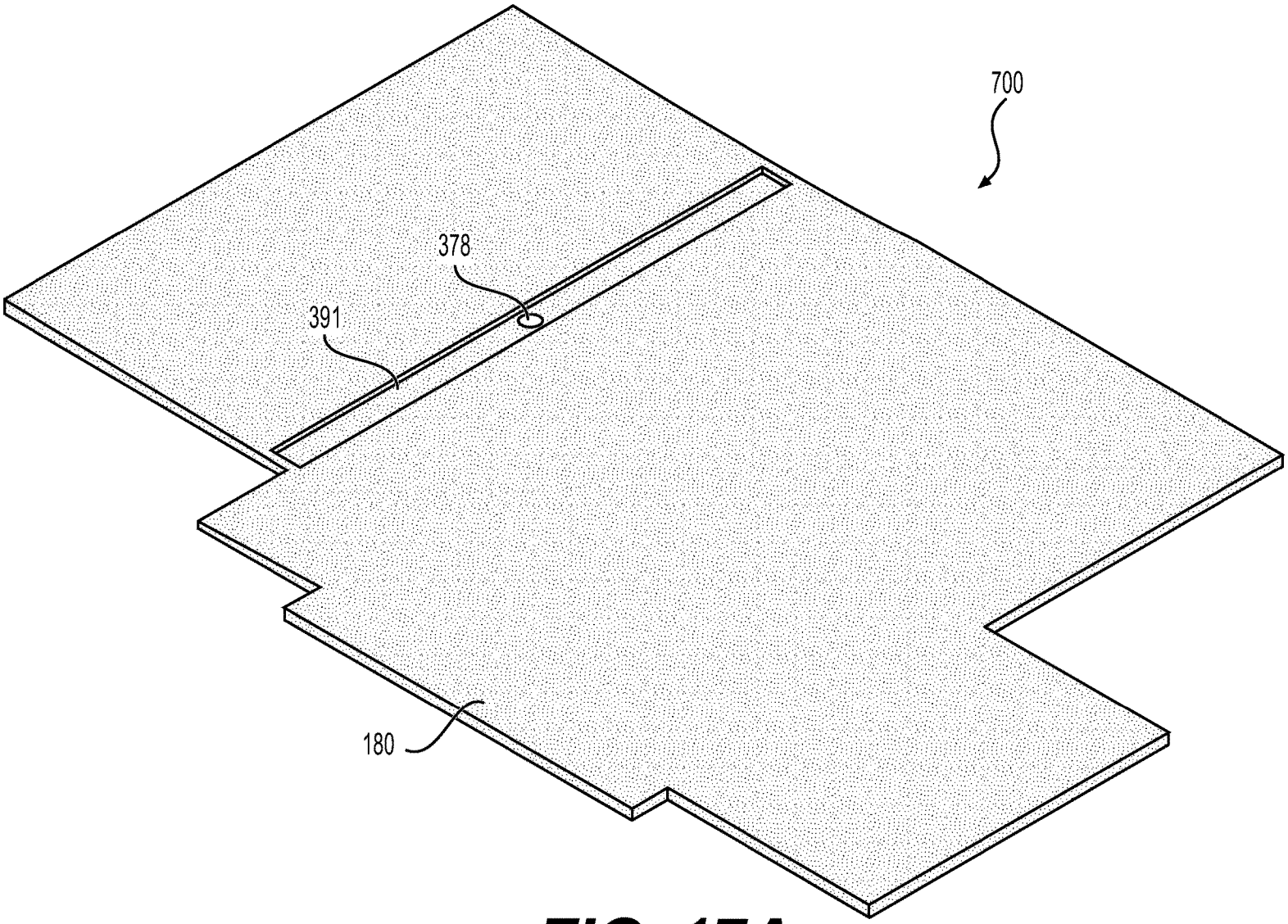
FIG. 17A is a top perspective view of the bathroom floor component of FIG. 16A after being encapsulated in a waterproof membrane.
Figure 17B:
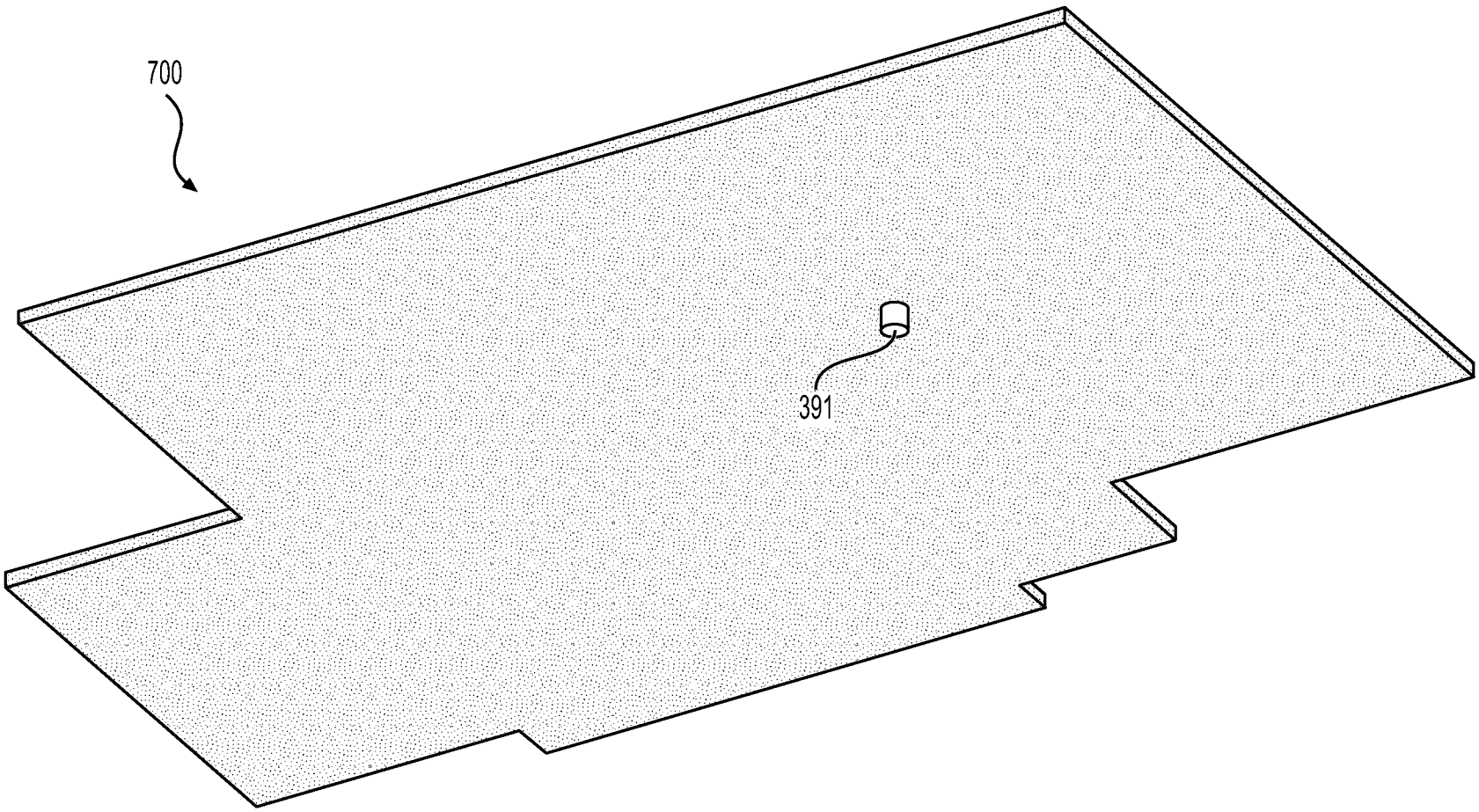
FIG. 17B is a bottom perspective view of the bathroom floor component of FIG. 16B after being encapsulated in a waterproof membrane.

The bathroom pod 100 as shown may comprise a ceiling 102, a plurality of walls 104, electrical wiring 106, plumbing 108, and a bathroom floor component. As shown in FIGS. 16A and 16B, the underlying bathroom floor component 700 may include at least a first longitudinal strengthening member 702 that is adhered to one or more foam floor panels 704, which are not typically seen in the bathroom floor component 100 as assembled since the entire floor component 700 is encapsulated in a waterproof material 325, and usually covered by decorative and/or functional wall and floor covering 390, 394, respectively, such as wall and floor tile, respectively, or the like, as is well known. And similarly, bathroom floor component 700 as shown in FIGS. 16A and 16B may include one or more perimeter strengthening members 774, which completely or partially surround(s) foam floor panels 704. Further, in some embodiments, perimeter strengthening members 774 are attached to peripheral edges of the floor members 704 to define a reinforced outer perimeter of the bathroom floor component 700. Additionally, one or more of the foam floor panels 704 may define a drain aperture 378, may employ a circular or linear drain 391 such as a trench drain as shown, and define sloped upper surfaces 380 that are directed toward the drain 391.

In this embodiment, a support panel or substrate 785 supports and is the substrate for bathroom floor component 700, and the outer periphery of bathroom floor component 700 fits substantially within the area defined by inner-facing surfaces of wall board material 107.

Support substrate 785 in turn is attached to bathroom pod 100 in any desirable manner. One such manner is to connect the substrate to the walls 104 of the pod 100. In embodiments, substrate 785 may be connected to walls 104 by mechanical connection therebetween, an example of which can be seen in the drawings. Fasteners 120, such as nut and bolt arrangements, may connect the substrate 785 to the pod wall bottom frame members 112. In this way, the bathroom floor component 700 is supported by substrate 785 and walls 104 when the pod 100 is not supported itself on a floor such as a factory floor, transport vehicle or final building floor slab.

Any suitable fastener 120 may be used including nuts and bolts, dry wall screws and the like. Bottom wall frame members 112 are preferably aligned with upper peripheral surfaces of substrate 785. The fasteners 120 may engage one or more of the bottom frame members 112 through apertures 714 defined by the substrate 785.

Typically, as seen in FIGS. 11-15B, the walls 104 may connect the ceiling 102 to the bathroom floor component 700, the electrical wiring 106 is attached to at least one of the plurality of walls 104 and/or the ceiling 102, and the plumbing 108 is attached to at least one of the plurality of walls 104 or the bathroom floor component 700. It is contemplated that the ceiling and/or one or more of the plurality of walls and/or plumbing fixtures/accessories may be omitted from the pod 100 in other embodiments of the present disclosure. Also, various light and plumbing fixtures, or any other accessories, may or may not be present. In embodiments, ceiling 102 my be manufactured and employed in the manner described in connection with bathroom floor component 700. An ingress/egress area 180 may be provided.

Similarly, FIGS. 12 thru 15B depict the bathroom pod 100 as assembled. Some of the plumbing accessories are more easily seen including the shower accessories. Other features, configurations, and accessories are possible in other embodiments of the present disclosure.

The ceiling 102 may be monolithic, crack-proof, and water proof. The electrical wiring 106 and the plumbing 108 may be pretested and code compliant. The walls 104 may have moisture, mold and abuse resistant wallboard 107. Engineered steel framing studs 110 may hold the walls, and the bathroom floor component and the pod 100 as a whole, together. Accessories such as, but not limited to, a sink 115, rail 118, mirror 111 and foot rest 113 may also be provided. One or more of these features or attributes may be omitted in other embodiments of the present disclosure.

Turning to FIGS. 16A and 16B, it can be understood that the bathroom floor component 700 is assembled as a collection of component parts, and (as seen in connection with FIGS. 7-10) thereafter encapsulated within a one piece waterproof, rigid layer to result in a monolithic, extremely strong floor member that resists bending, sagging and twisting. The pre-encapsulated floor as shown may comprise any number of transverse strengthening members 702 and one or more of a plurality of peripheral outside edge strengthening members 374. One or more foam floor-forming members 704 may be disposed between the one or more plurality of transverse strengthening members 702 and peripheral strengthening members 774. More particularly, at least one of the plurality of foam floor members 704 may be disposed between an adjacent cross-brace strengthening member 702 and an outside edge peripheral strengthening member 774. In some embodiments, a single peripheral strengthening member 774 and a single sheet of foam 704 may be employed, etc., to form the bathroom floor component 700. The strengthening member(s) 702, 774 may be bonded or otherwise attached to one or more of the foam floor panels 704. Any suitable bonding agent may be used, such as glue, latex modified rapid setting material, etc., as will occur to those of skill in the relevant art.

As best seen in FIGS. 16A-16B, one of the foam members 704 may define a drain aperture 378. The drain aperture 378, as well as any contour, e.g., slope or pitch to the upper surface of floor panels 704, may be milled or drilled, etc. using a CNC (computer numerically controlled) router or milling machine, or other aperture-forming technique, etc., or formed using a molding process. In like manner, contour, e.g., support ribs (not shown), may be formed in the lower surface of floor members 704. Later, a drain assembly 391 (such as the linear trench and linear drain shown in the figures, or a circular drain, etc.) may be inserted into the drain aperture 378 during the fabrication of the bathroom floor component.

FIGS. 16A and 16B show floor component 700 prior to being encapsulated with a waterproof membrane 750. FIGS. 11, 12, 14, 15A and 15B show floor component 700 after being encapsulated with a waterproof membrane 325. As can be seen, strengthening members 702 and 774, as well as the peripheral edges of drain fixture 391, can no longer be seen after floor component 700 has been encapsulated.

Figure 15C:
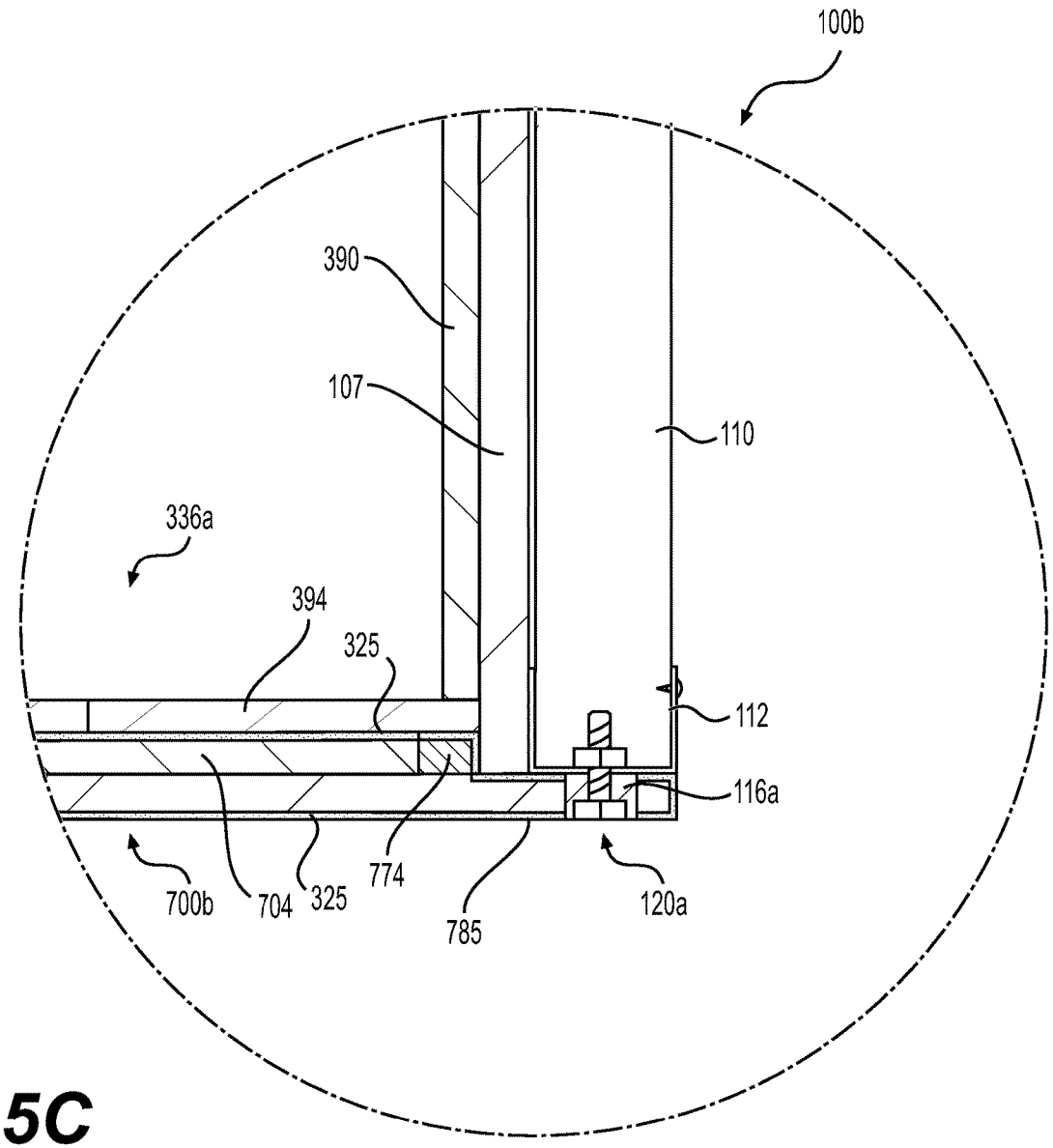
FIG. 15C is an enlarged detail view taken from FIG. 14, showing alternative internal details of the fastened connection of the prefabricated bathroom floor component to the walls of the bathroom pod.

Alternatively, as seen in FIG. 15C, the bathroom floor component and the substrate 785 may be mated together prior to applying the waterproof encapsulation layer, and then sprayed or otherwise coated with a waterproofing layer 325.

Bathroom Floor Components Including Underside Strengthening Members

FIGS. 18A-18F show a third embodiment of the invention along with variations on the embodiment, in which a bathroom floor component is disclosed comprised of one or more foam floor panels 904, optionally one or more longitudinal strengthening members 902, and a peripheral raised platform defining a peripheral upper surface 977. One or more sloped floor surfaces may be provided, as well as one or more drain apertures 378 and one or more drain fixtures 391. Raised platform 976 may be attached or formed integrally with floor members 904, or connected thereto using peripheral strengthening members (not shown) such as peripheral strengthening members 374 shown in FIGS. 15 and 16. In the embodiment shown in FIGS. 18A-18F, strengthening members 374 are not employed. However, it is to be understood that the use of such strengthening members may be included as being within the scope of the invention.

The raised platform 976 is adapted to bear the weight of at least a portion of the walls 104 and ceiling 102 of pod 100, including the weight of any accessories attached thereto, and as such will be constructed and arranged in such a manner that it can support said weight without distortion (e.g., will resist collapse, crushing or bending). To that end, the material out of which peripheral shoulder 976 is manufactured will be sufficient to support the weight of the ceiling 102 and walls 104. Alternatively, strengthening inserts 979 and 989 may be integrated into the peripheral raised platform 976 to add weight-bearing and anti-compressive capacity to the raised platform component 976 of the bathroom floor component 900.

Additionally, the walls 104 of the bathroom pod 100 may connect the ceiling to the bathroom floor component 900. The walls 104 may include bottom frame members 112 which are adapted to be placed in registry with upper surface 977. A plurality of hollow fastener-receiving bushings or journals 116 may be disposed in the plurality of apertures 114 defined by raised platform 976. These bushings 116 may act as alignment features when the walls are fastened to the bathroom floor component 900, act to protect the integrity of apertures 114, which in some embodiments are formed in the polystyrene or other relatively soft foam making up support platform 976, and act to transfer weight from the walls 104 to the sub-floor (not shown) supporting pod 100. In doing so, the raised platform 976 is protected from crushing. The hollow interiors of bushings 116 allow fasteners 120 to extend through apertures 114 in raised platform 976 through the bottom wall of frame members 112.

Bushings 116 similar to those depicted in other embodiments herein, such as metal cylindrical journals (not shown), which are preferably fabricated of metal, although any material having good compression resistance is suitable, may be used transfer weight from the walls 104 down to the supporting surface or substrate (not shown) on which the bathroom floor component 900 will sit.

Alternatively or additionally, weight bearing supporting inserts such as intermediate inserts 979 and corner inserts 989 may be used to support the weight of walls 104 and ceiling 102. Fasteners may be used to attach the walls 104 to the bathroom floor component 900 as described elsewhere in this disclosure, using corresponding apertures 114 defined by support inserts 979 and 989.

Support straps or bars 990 may be employed to transfer compressive forces from walls 104 to tensile forces exerted within bars 990. Bars 990 also serve to strengthen bathroom floor component 900, and ultimately pod 100, against twisting, bending a sagging action. Preferably, bars 990 are recessed in corresponding slots 991 formed in the lower surfaces of floor panels 904 and transverse strengthening members 902 so as not to add any height dimension to the profile of the bathroom floor component 900. Bars 990 may be associated with bathroom floor component 900 either before or after floor component 900 is encapsulated with waterproofing sealant 325. FIGS. 7D and 8D depict bathroom floor component 900 being coated with sealant 325 after bars 990 have been associated therewith. It is to be understood that the step of applying sealant 325 may be performed either before or after bars 990 have been associated with floor 900.

In embodiments, bars 990 connect to walls 104 in the same manner as described in connection with the interconnection of walls 104 with raised support platform 976.

Bathroom Floor Components with Reinforced Peripheral Support Platform

FIGS. 19-23 depict a further embodiment of the invention, wherein a bathroom floor component 1000 includes one or more floor panels 1004L, 1004R provided with a supporting and reinforcing frame 1050. The frame may be comprised of peripheral raised platform support members 1080, and may also include, but not necessarily, longitudinal strengthening members 1090. Support members 1080 are preferably attached to longitudinal strengthening members 1090, as by welding, bolting or any attachment means. Preferably, the frame members 1080, 1090 are made of steel or other compression-resistant material. The cross-sectional profile of the frame members may be any shape.

Figure 20:
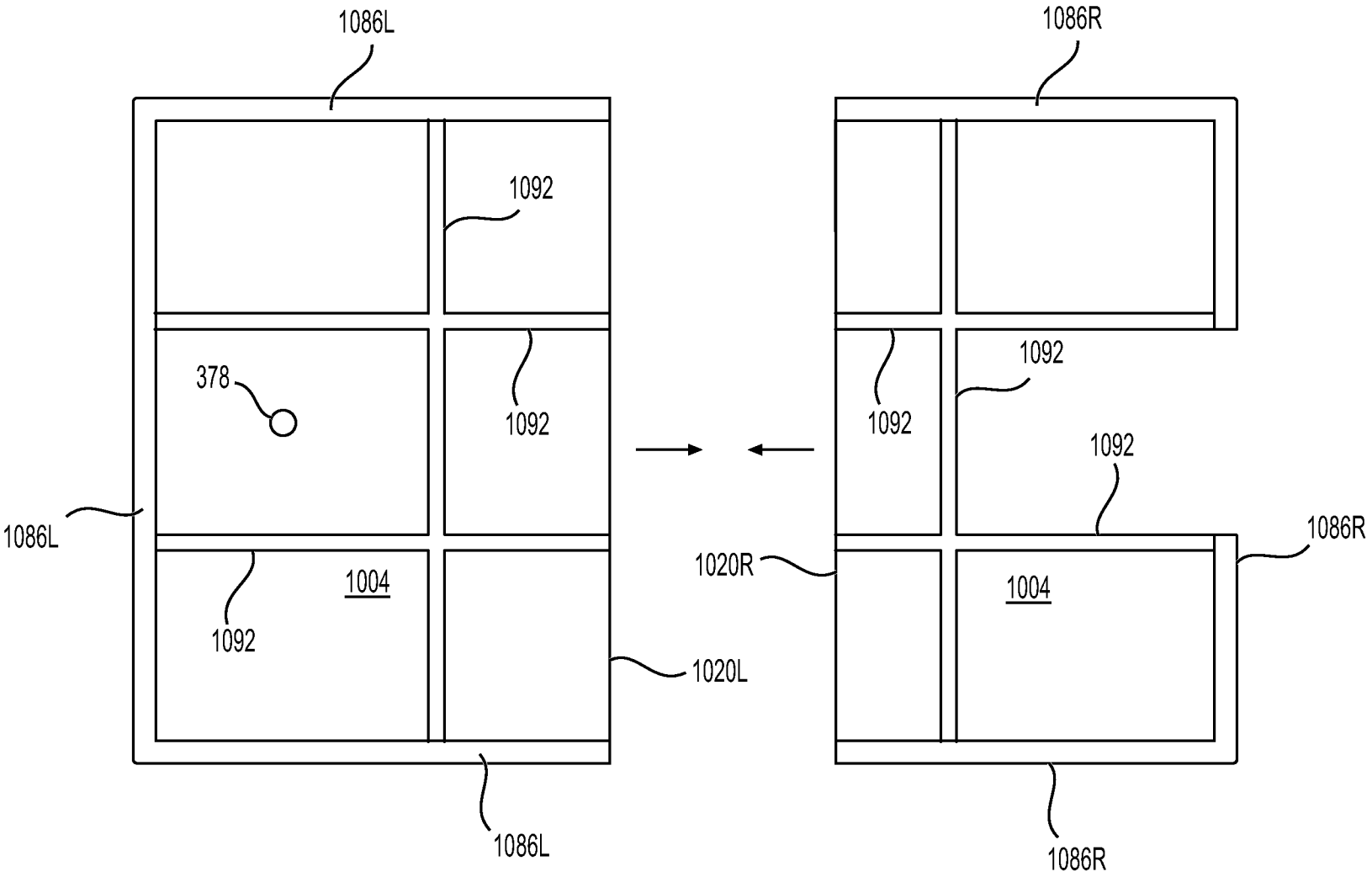
FIG. 20 is a bottom plan exploded view of representative floor sections thereof.

Preferably, as a seen in FIG. 20, recesses 1086L and 1086R are provided in the underside of panels 1004L and 1004R to permit panels 1004L and 1004R to nest within the peripheral support members 1080. Likewise, recesses 1092 may be provided in the underside of panels 1004L and 1004R to permit longitudinal strengthening members 1090 to nest there within. In this way, the height of the bathroom floor component is kept to a minimum.

Floor panel 1004L may include sloped surfaces 1027, a flat surface 1025, and a drain, such as linear drain 378. Floor section 1004R defines an upper surface which may be flat, or maybe sloped as well.

Figure 22A:
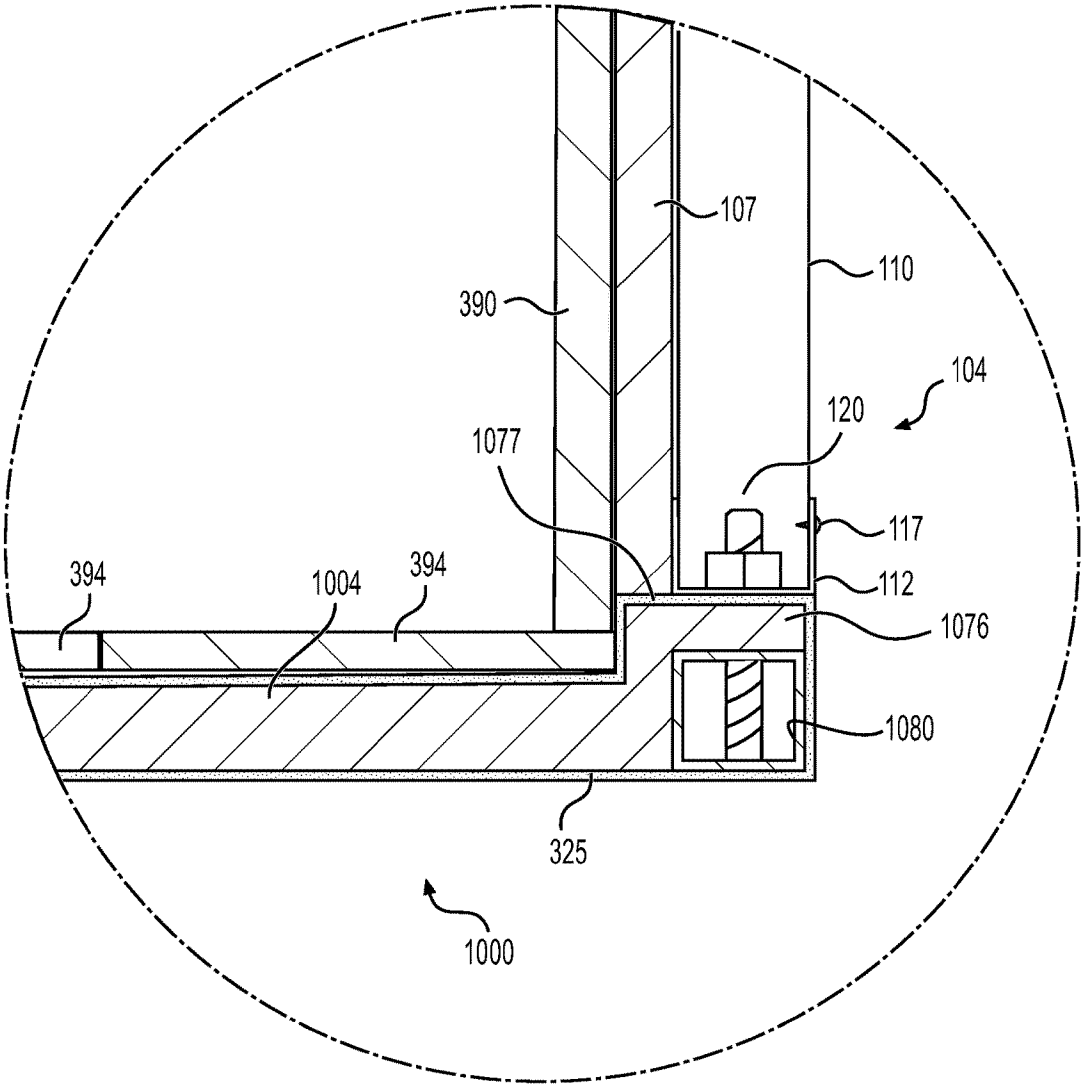
FIG. 22A is a cross-sectional elevational view taken along lines 22-22 of FIG. 21.

Floor sections 1004L and 1004R define raised peripheral support platforms 1077L and 1077R adapted to be placed in registry with the pod walls when assembled with the pod. As seen in FIG. 22, the raised peripheral support platform is integrally formed with floor member 1004, which adds to the strength of the unitary member. Floor panels 1004, frame members 1080 and longitudinal strengthening members 1090 are encapsulated in a waterproof membrane prior to being connected with pod walls 104. Fastening means such as nut and bolt arrangements 120 may be used to connect bathroom floor component 1000 to pod walls 104. Any other suitable fasteing arrangement may be used. Once so connected, floor and wall tile 390, 394, respectively, may be applied to cosmetically finish off the pod. An ingress/egress area 180 may be provided. It is to be understood throughout this disclosure that the frame and the floor panel(s) (and raised peripheral support platform if used) may be encapsulated together within the waterproof membrane, or the floor panel(s) itself (themselves) (and raised peripheral support platform if used) may be encapsulated within the waterproof membrane and, thereafter, the frame associated therewith, such that the frame and floor panel(s) is (are) not integrated within the waterproof membrane together.

Figure 22B:
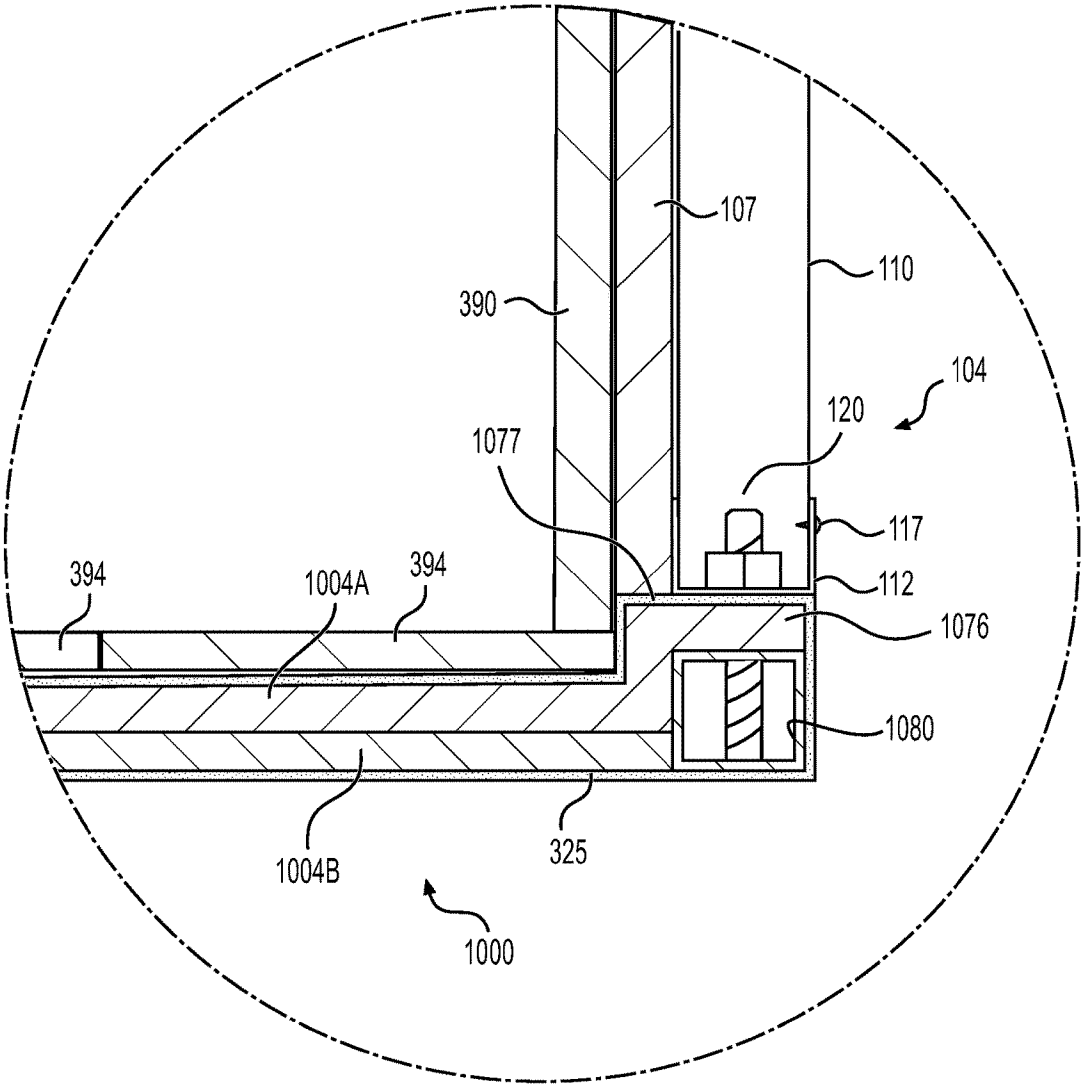
FIG. 22B is a cross-sectional elevational view taken along lines 22-22 of FIG. 21, but where the floor member is comprised of two stacked floor panels.
Figure 23A:
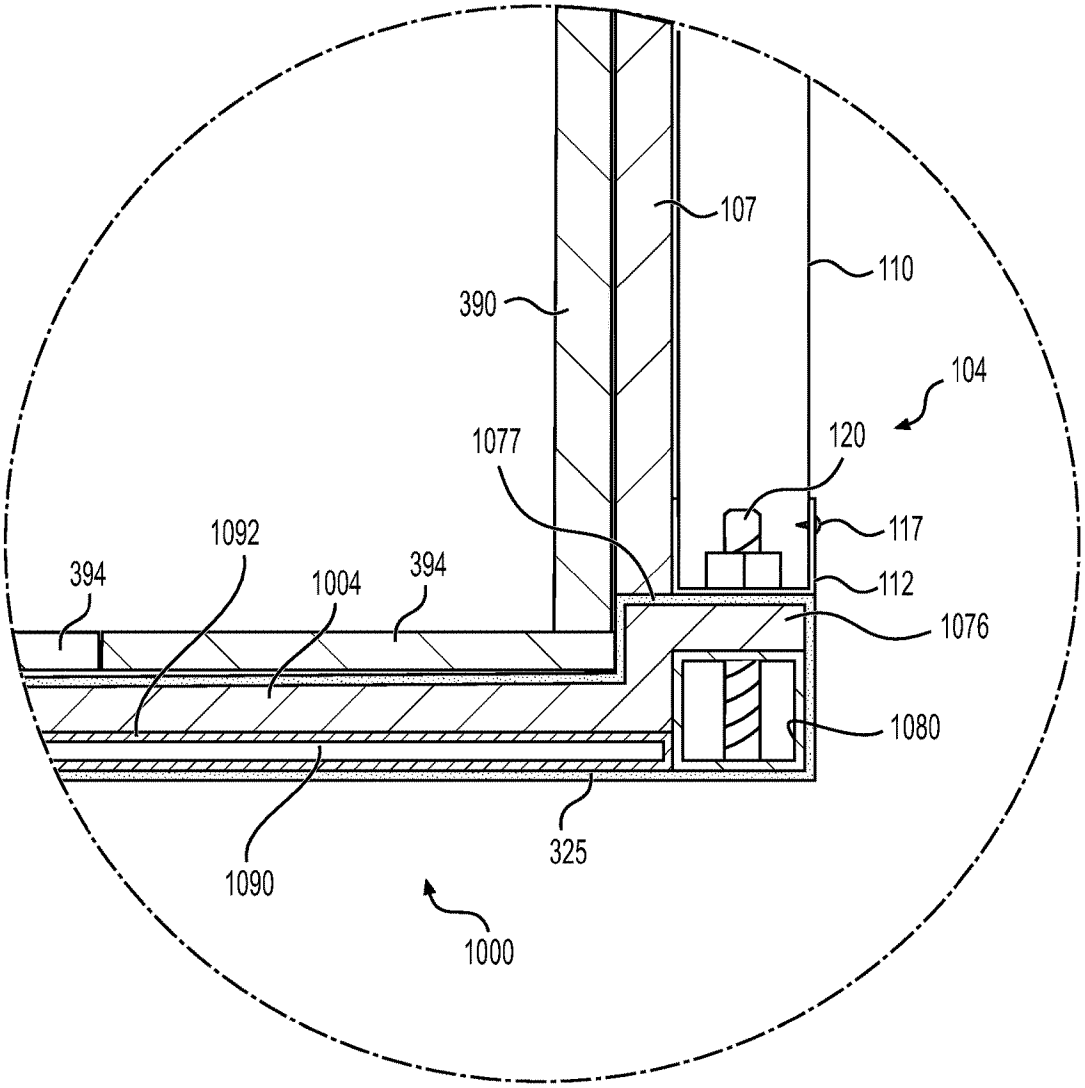
FIG. 23A is a cross-sectional elevational view taken along lines 23-23 of FIG. 21.

In embodiments, the raised peripheral support platform 1076 may be as wide as only the wall 104 and/or wall studs 110, or may be wide enough to reside in registry with the wall board 107 as well, as seen in FIGS. 22-23. The raised peripheral support platform 1076 also may be wider or narrower than the wall studs with or without wall board attached.

Figure 21A:
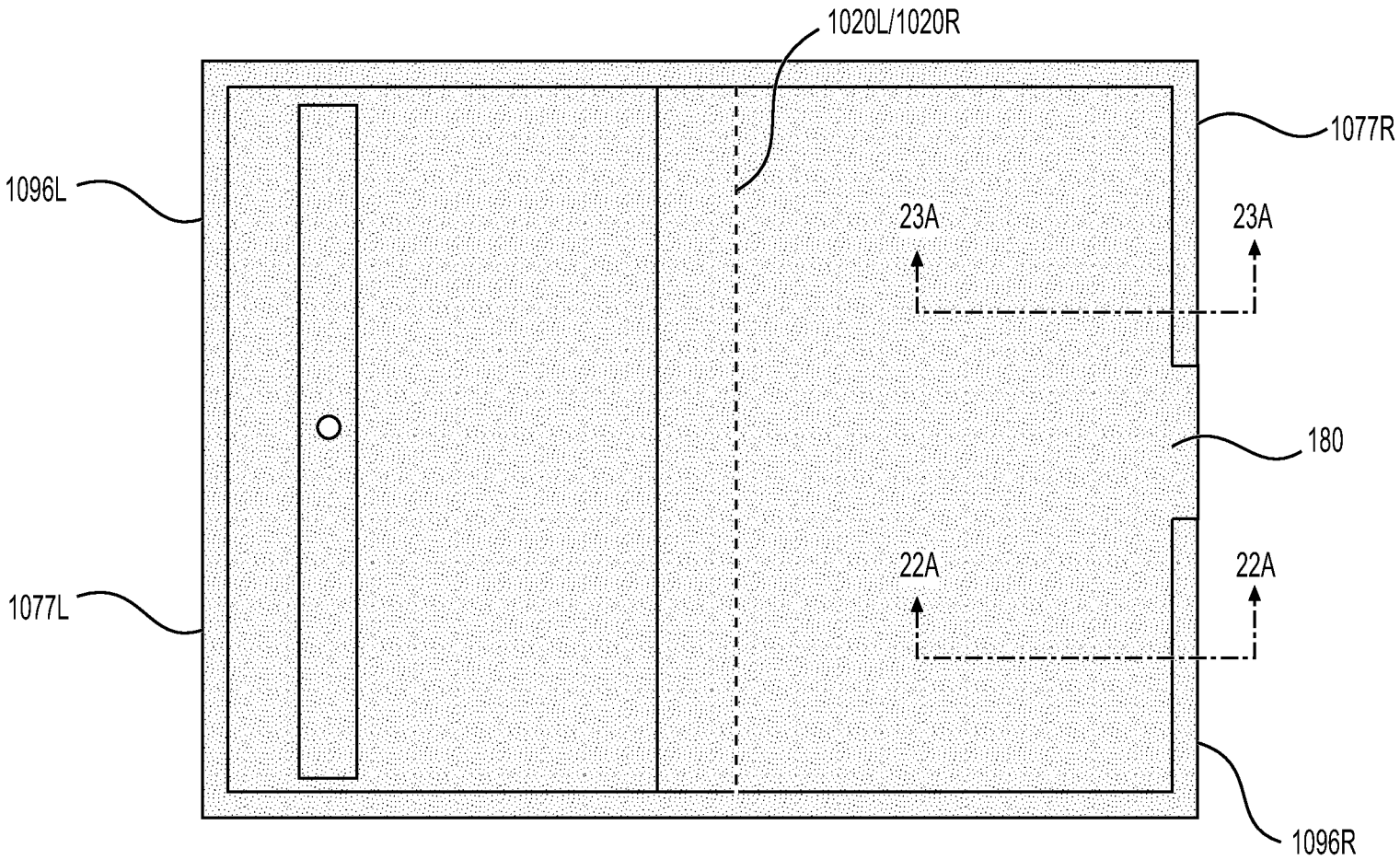
FIG. 21A is a top plan assembled view of the bathroom floor component of the fourth embodiment after assembly and coating with a waterproof membrane.
Figure 21B:
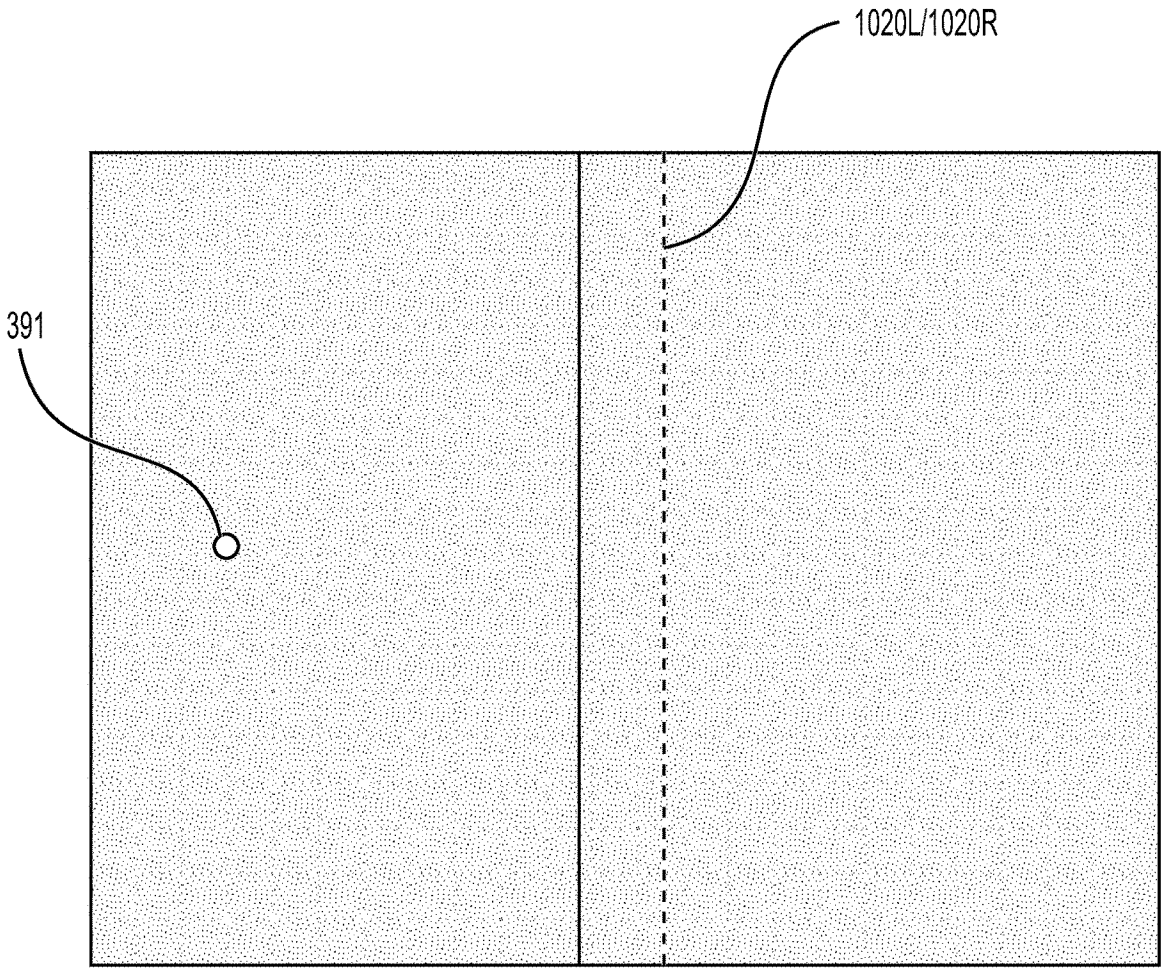
FIG. 21B is a bottom plan assembled view of the bathroom floor component of the fourth embodiment after assembly and coating with a waterproof membrane.

In the case where the floor member is made up of two panels 1004L and 1004R, those panels are joined together at opposed edges 1020L, 1020R, as best seen in FIG. 21. In embodiments, floor panel 1004 is a single piece of foam or plastic (or any other suitable material) that spans the entirety of the frame 1050. In other embodiments, such as that shown in FIGS. 22B and 23B, the floor panel is made up of two or more members. In any embodiment, floor panels may be stacked on top of each other to create a thicker floor, and may be machined in areas to create contour (e.g., slope or drain cutouts).

In embodiments, as shown in FIGS. 24-28, the floor member may be made from a single, unitary floor panel 1004 defining peripheral raised support platform 1096, instead of separate panels 1004L and 1004R or however many panels may be necessary to cover a given floor area. In the case of larger floor areas, it may be desirable or efficient to utilize more than one floor panel member with frame 1050, or it may be desirable or efficient to use just a single floor panel such as panel 1004. In addition or alternatively, it may be desirable or efficient to use a reinforcing frame arrangement that is made of larger or smaller component parts than those shown in the drawings. It is also important to note that the height of any raised peripheral support platform disclosed herein in connection with any embodiment can be specified according to the designer or customer to be whatever height desired for a particular application.

Numerous floor features such as sloped bathroom floor upper surfaces 1004A and 1004C, as well as flat bathroom floor area 1048B, shown in FIG. 24, may be employed as will occur to those of skill in the art. In addition, in any of the embodiments described in this disclosure, additional or alternative features such as the following may be included:

a. An additional drain or drains may be included in a non-shower area of the bathroom floor member;
b. a second shower may be provided in the bathroom pod;
c. a non-shower pitched wet area may be provided in the bathroom pod;
d. a flat bathroom floor area may be provided in the bathroom pod;
e. non-shower dry pitched bathroom floor area may be provided in the bathroom pod; and/or
f. a shower bench may be provided in the bathroom pod.

Preferably, as a seen in FIG. 25, recesses 1086 are provided in the underside of panel 1004 to permit panel 1004 to nest within the peripheral support members 1080. Likewise, recesses 1092 may be provided in the underside of panel 1004 to permit longitudinal strengthening members 1092 to nest there within. In this way, the height of the bathroom floor component is kept to a minimum.

Floor panel 1004 may include optional features such as sloped surfaces 1027, a flat surface 1025, and a drain, such as linear drain 378.

Figure 27:
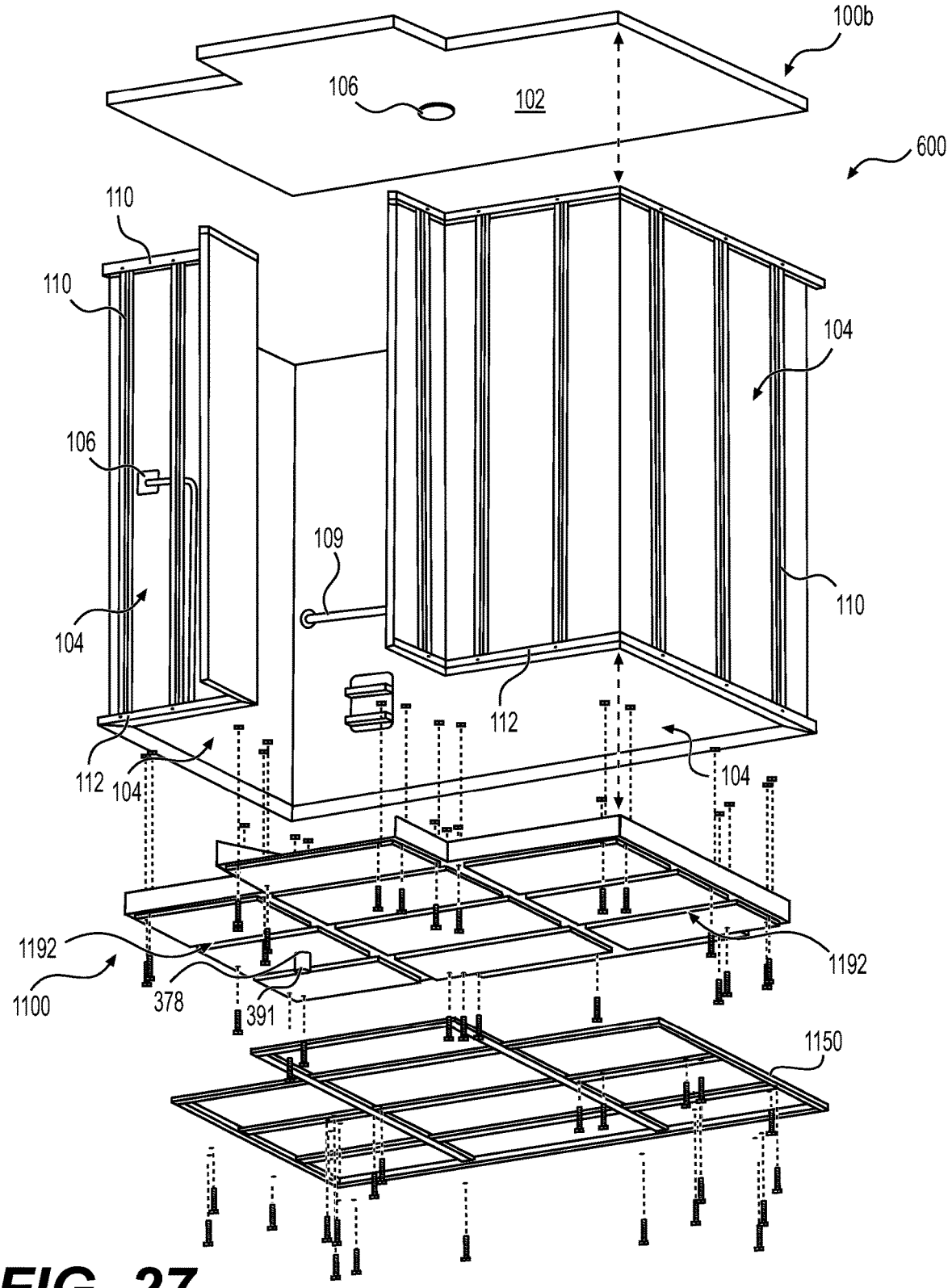
FIG. 27 is a bottom exploded perspective view of a bathroom pod constructed with a prefabricated bathroom floor component according to a sixth embodiment of the present disclosure.
Figure 28:
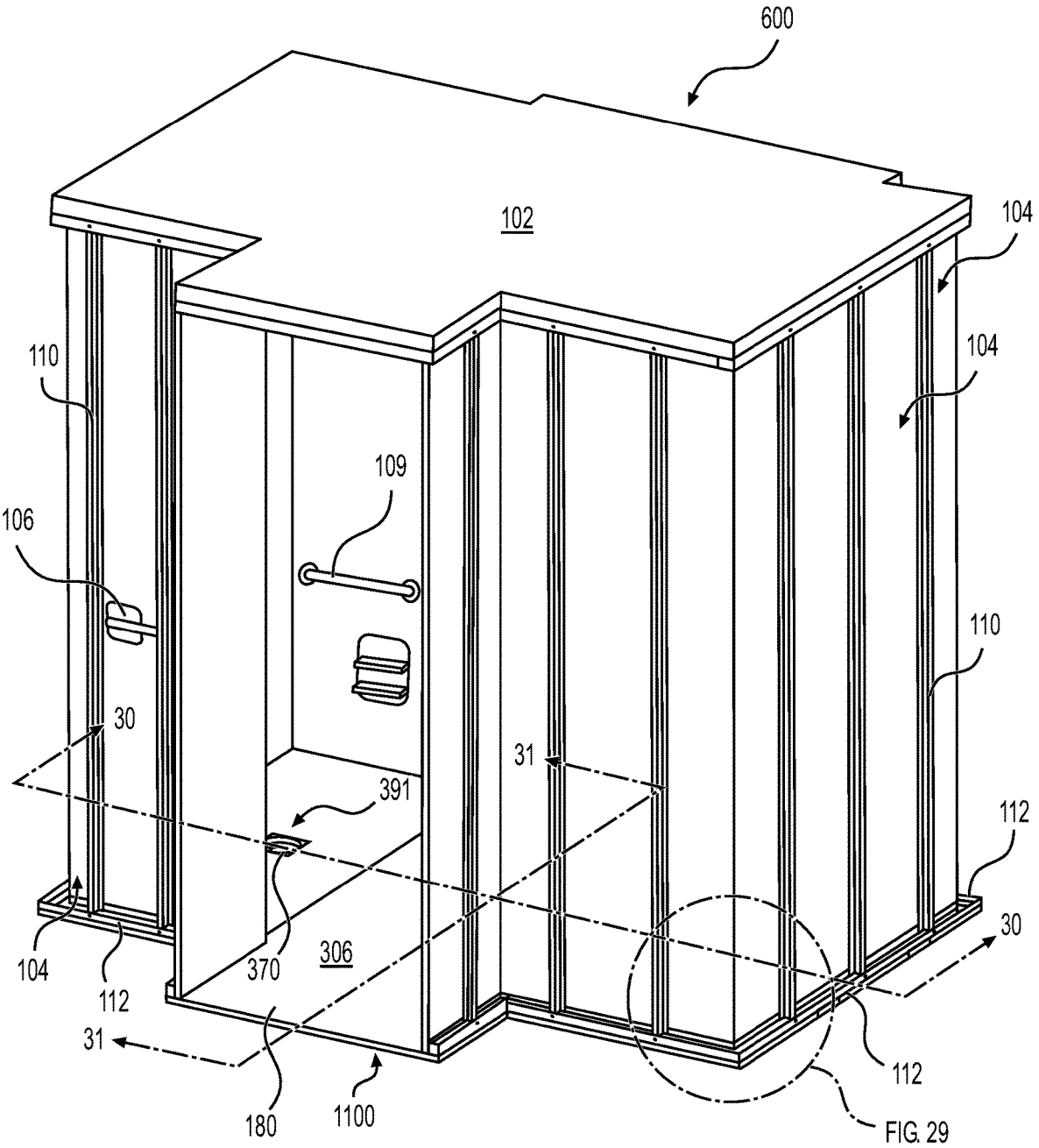
FIG. 28 is a top perspective view thereof.
Figure 29:
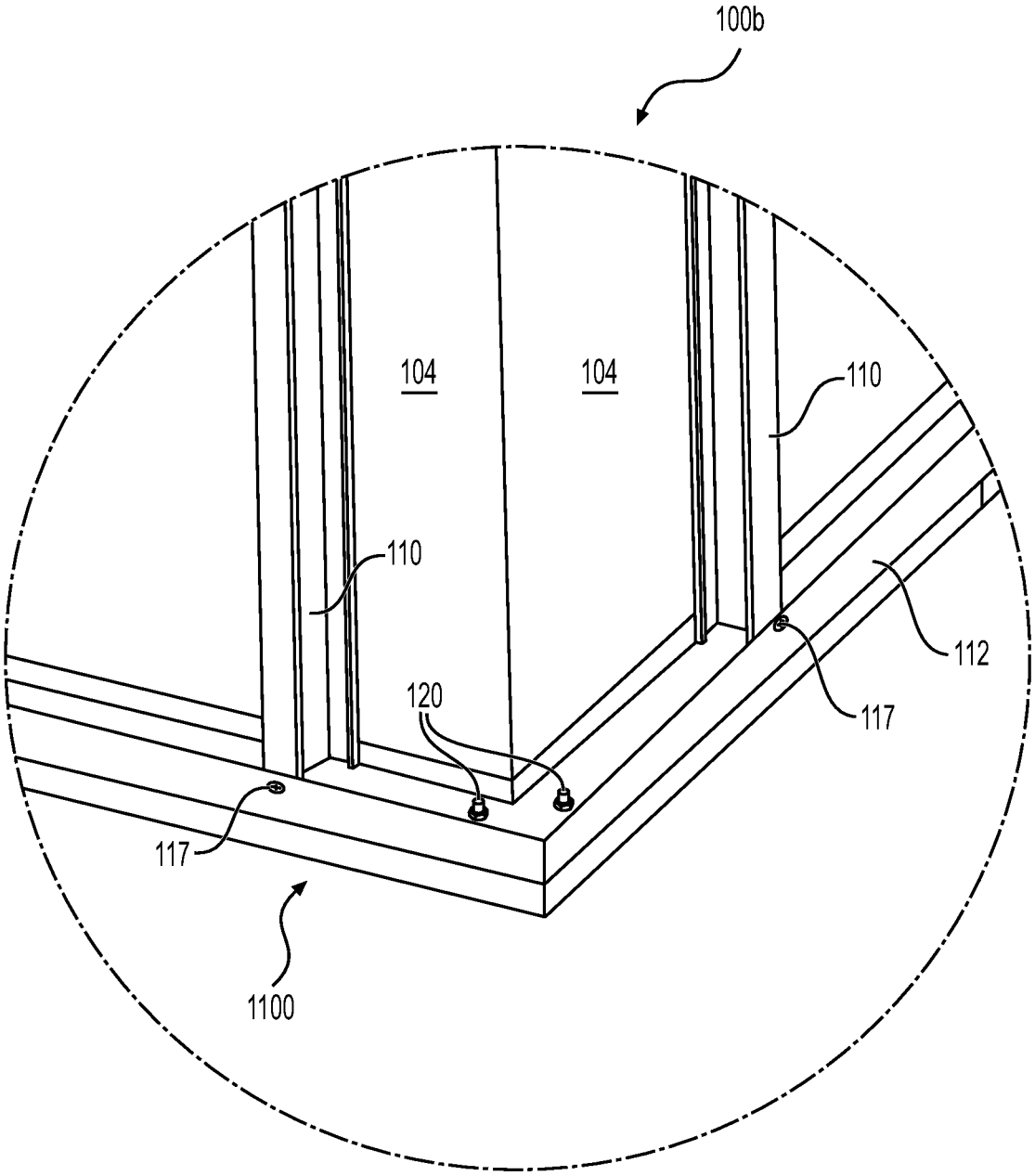
FIG. 29 is a close up of the area of detail shown in FIG. 28.
Figure 30:
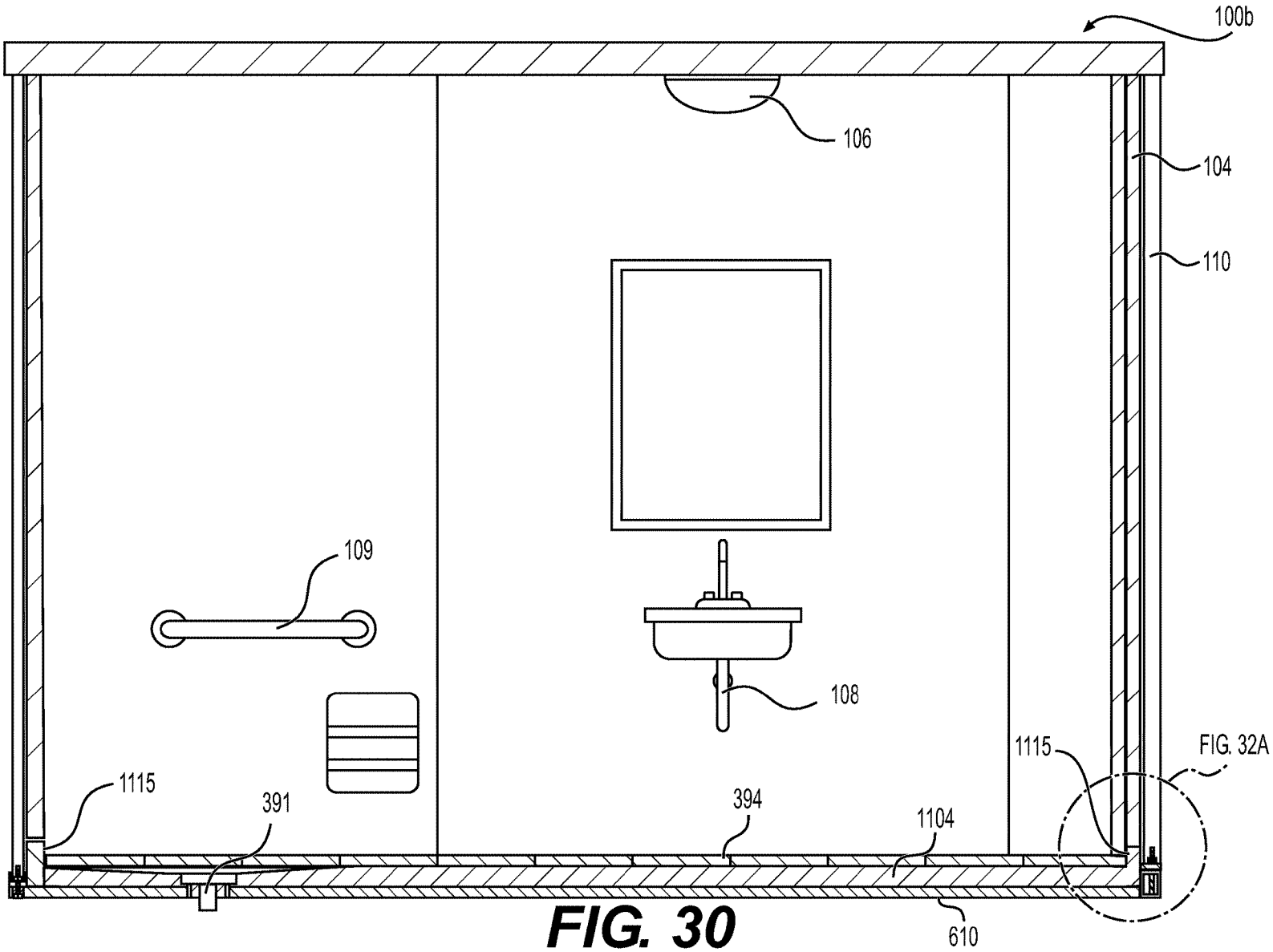
FIG. 30 is a cross-sectional elevational view taken along lines 30-30 of FIG. 28.
Figure 31:
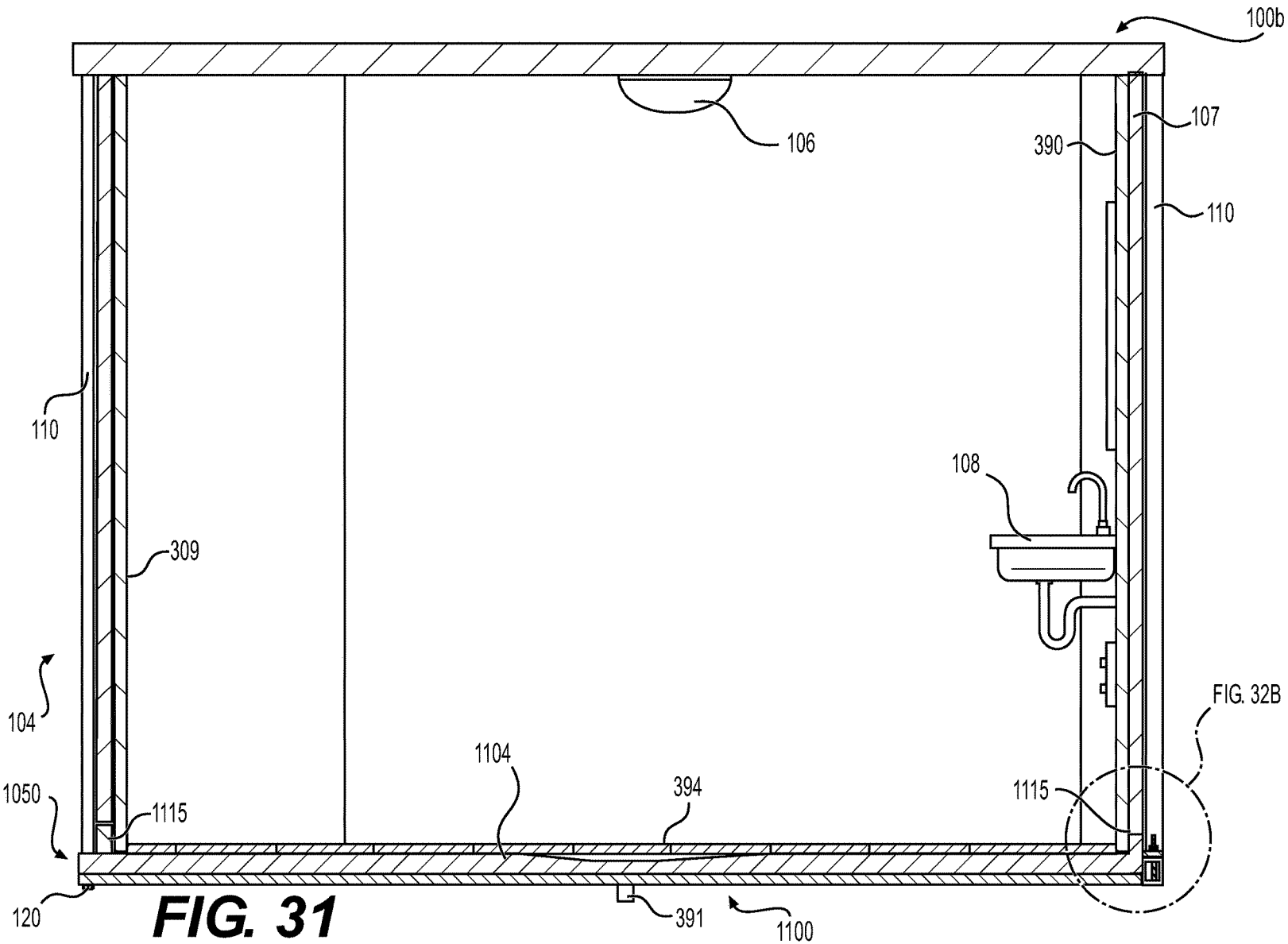
FIG. 31 is a cross-sectional elevational view taken along lines 31-31 of FIG. 28.

Floor panel 1004 defines raised peripheral support platform 1077 adapted to be placed in registry with the pod walls when assembled with the pod. As seen in FIG. 27, the raised peripheral support platform is integrally formed with floor member 1004, which adds to the strength of the unitary member. Floor panels 1004, frame members 1080 and longitudinal strengthening members 1090 may be encapsulated in a waterproof membrane prior to being connected with pod walls 104. Fastening means such as nut and bolt arrangements 120 may be used to connect bathroom floor component 1000 to pod walls 104. Any other suitable fasteing arrangement may be used. Once so connected, floor and wall tile 390, 394, respectively, may be applied to cosmetically finish off the pod.

In embodiments, the raised peripheral support platform 1076 may be as wide as only the wall 104 and/or wall studs 110, or may be wide enough to reside in registry with the wall board 107 as well, as seen in FIGS. 22-23, and can be narrower or wider than the u-channels which underly the wall studs 110 with or without the wall board.

Figure 23B:
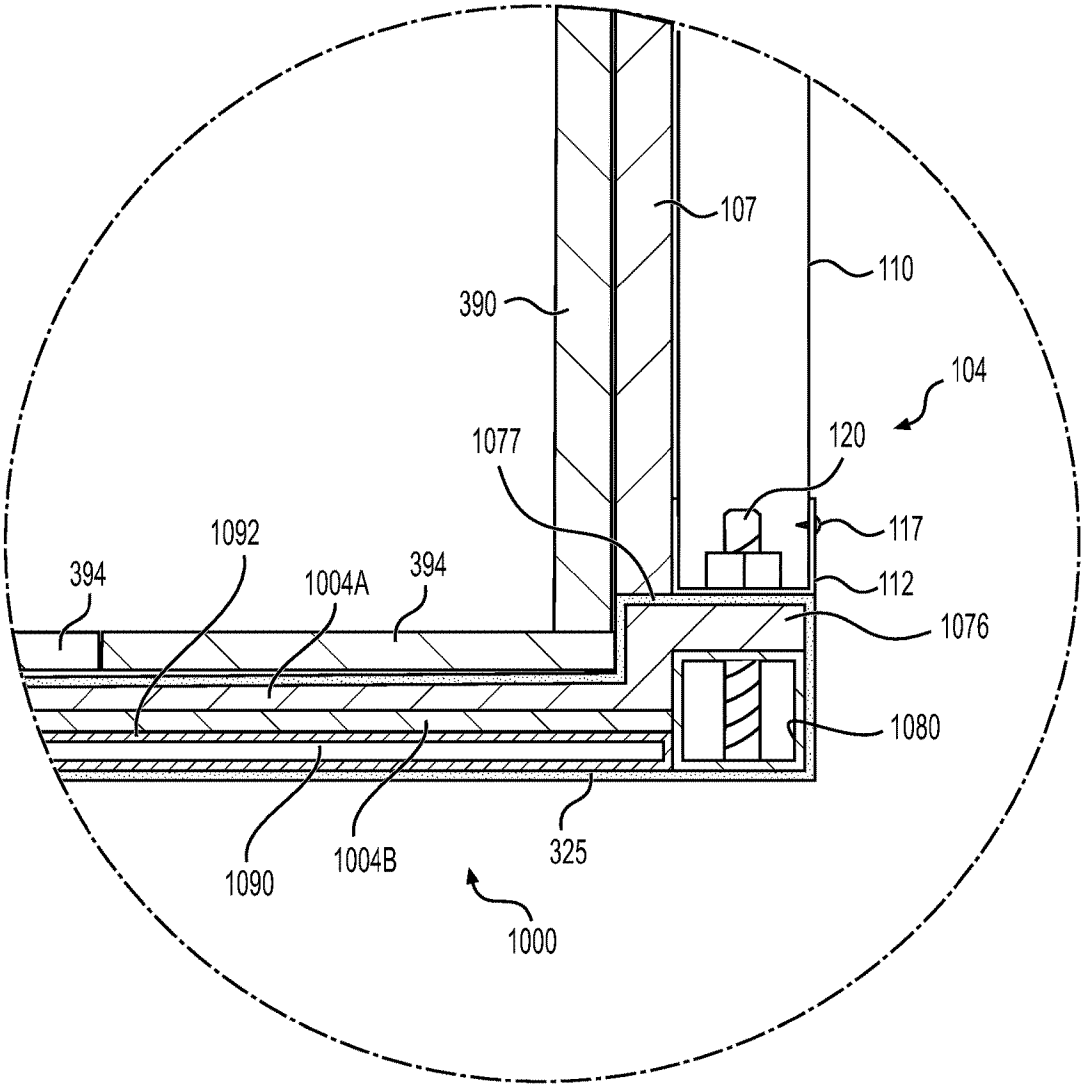
FIG. 23B is a cross-sectional elevational view taken along lines 23-23 of FIG. 21, but where the floor member is comprised of two stacked floor panels.

In any embodiment, the floor panel(s) 1004 may be comprised of two or more thinner panels stacked on top of each other to create a desired floor thickness, and may be machined in areas to create contour (e.g., slope or drain cutouts). In this way, panels that are manufactured to be thinner than the greatest thickness that will be needed for the floor member can be stacked together as shown in FIGS. 22B and 23B, as well as 27B and 28B, because individual, thinner, floor panels can be manufactured faster and cure faster. The individual panels 1004 can be secured together by adhesive (or simply stacked on top of each other without adhesive), and the top panel (or however many panels are used) can be milled to create contour in the floor member, as well as apertured for one or more drains or any other purpose.

Bathroom Floor Member with Splashwalls and Support Frame

FIGS. 27-35 depict another embodiment of the invention, wherein a bathroom floor component is comprised of a shower member 1100 associated with a support substrate 1150.

Floor member 1100 preferably includes recessed grooves 1192 into which support frame members 1180, 1190 nestably relate. Floor member 1100 may also include raised splash walls 1115 around the perimeter thereof other than at the entry or entries to the bathroom. Floor member 1100 also defines an upper floor surface, at least a portion of which tapers toward a drain opening 378. A suitable drain insert, such as drain insert 391, may be employed. As will occur to those of skilled in the art, any type of drain may be used in any of the applications of the invention disclosed herein.

Figure 32A:
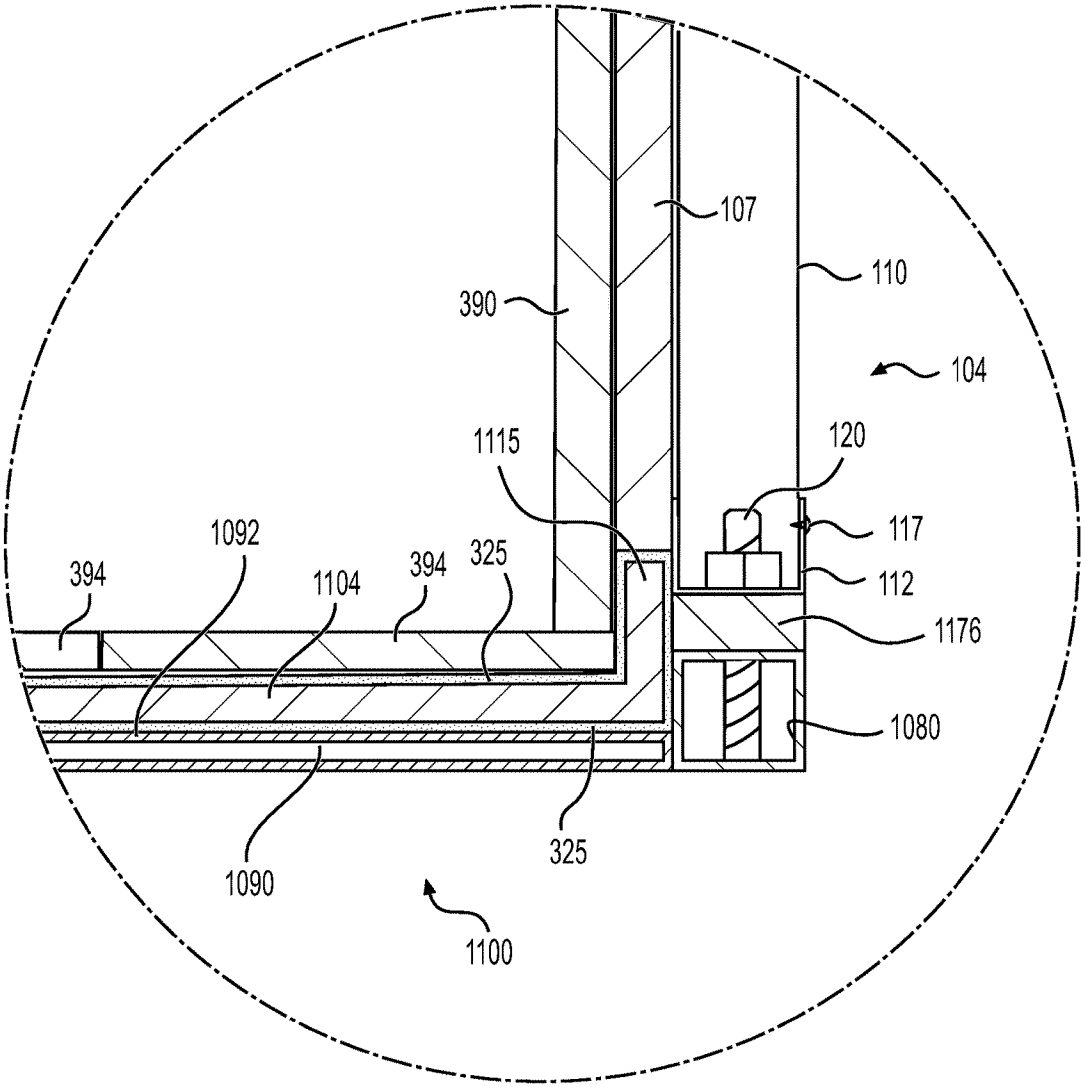
FIG. 32A is an enlargement of the area of detail shown in FIG. 30, showing internal details of the fastened connection of the prefabricated floor component to the walls of the bathroom pod.

In one version of this embodiment, as best seen and FIG. 32A, the floor member is encapsulated with a waterproofing layer 325 and connected to the support frame 1150, which in turn is connected to pod walls 104, after which finishing material such as wall and floor tile 390, 394 may be attached.

Figure 32B:
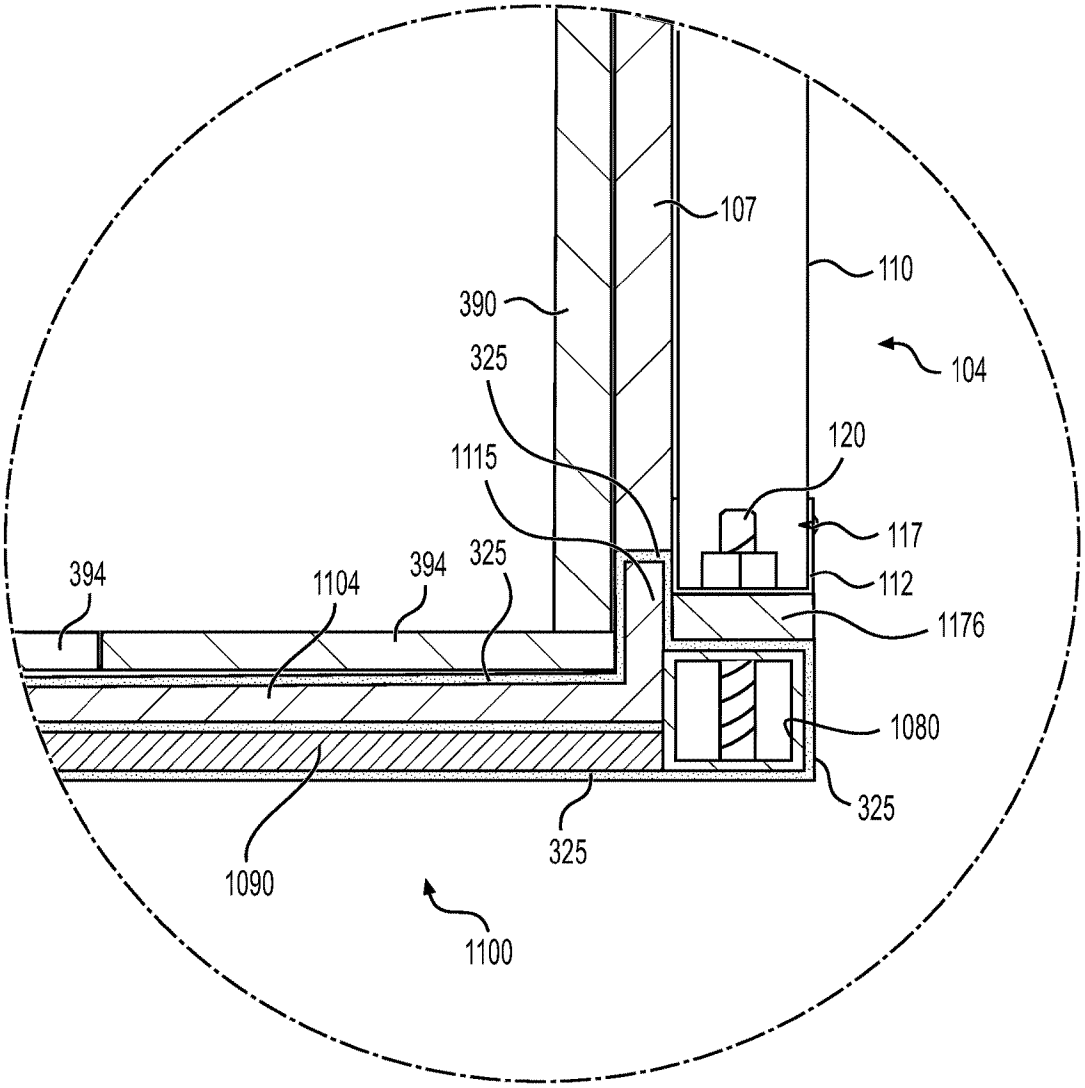
FIG. 32B is a modified form of the enlarged area of detail shown in FIG. 32A.

In another version of this embodiment, as shown in FIG. 32B, shower floor member 1100 and support frame 1150 are both encapsulated with waterproofing material layer 325, and thereafter attached to pod walls 104. Thereafter, finishing materials may be applied there too, such as floor and wall tile 394, 390.

Figure 33:
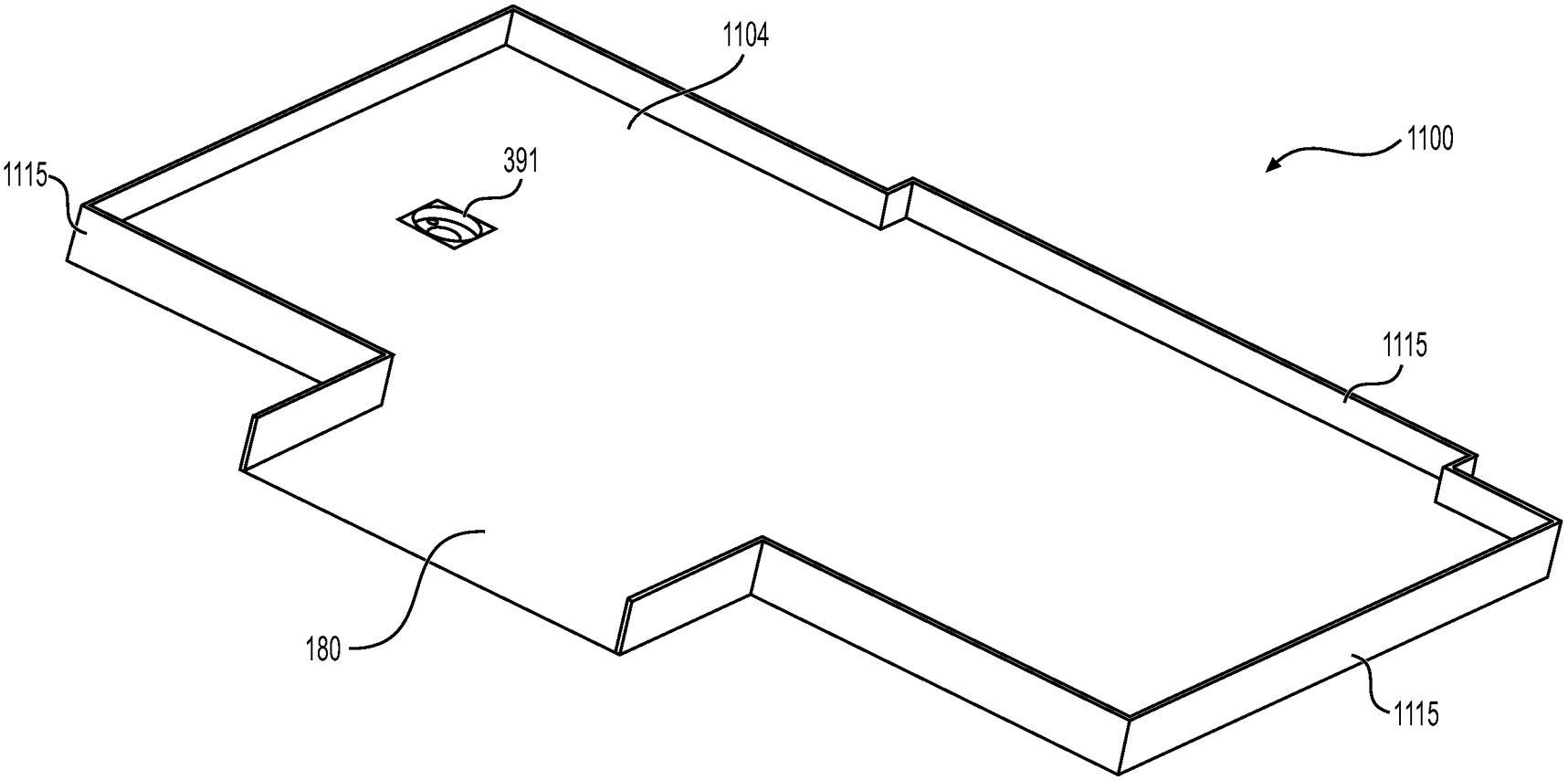
FIG. 33 is a top oriented perspective view of a prefabricated bathroom floor component that is similar or identical to that depicted in FIG. 27 prior to being encapsulated with a waterproof strengthening membrane.
Figure 34:
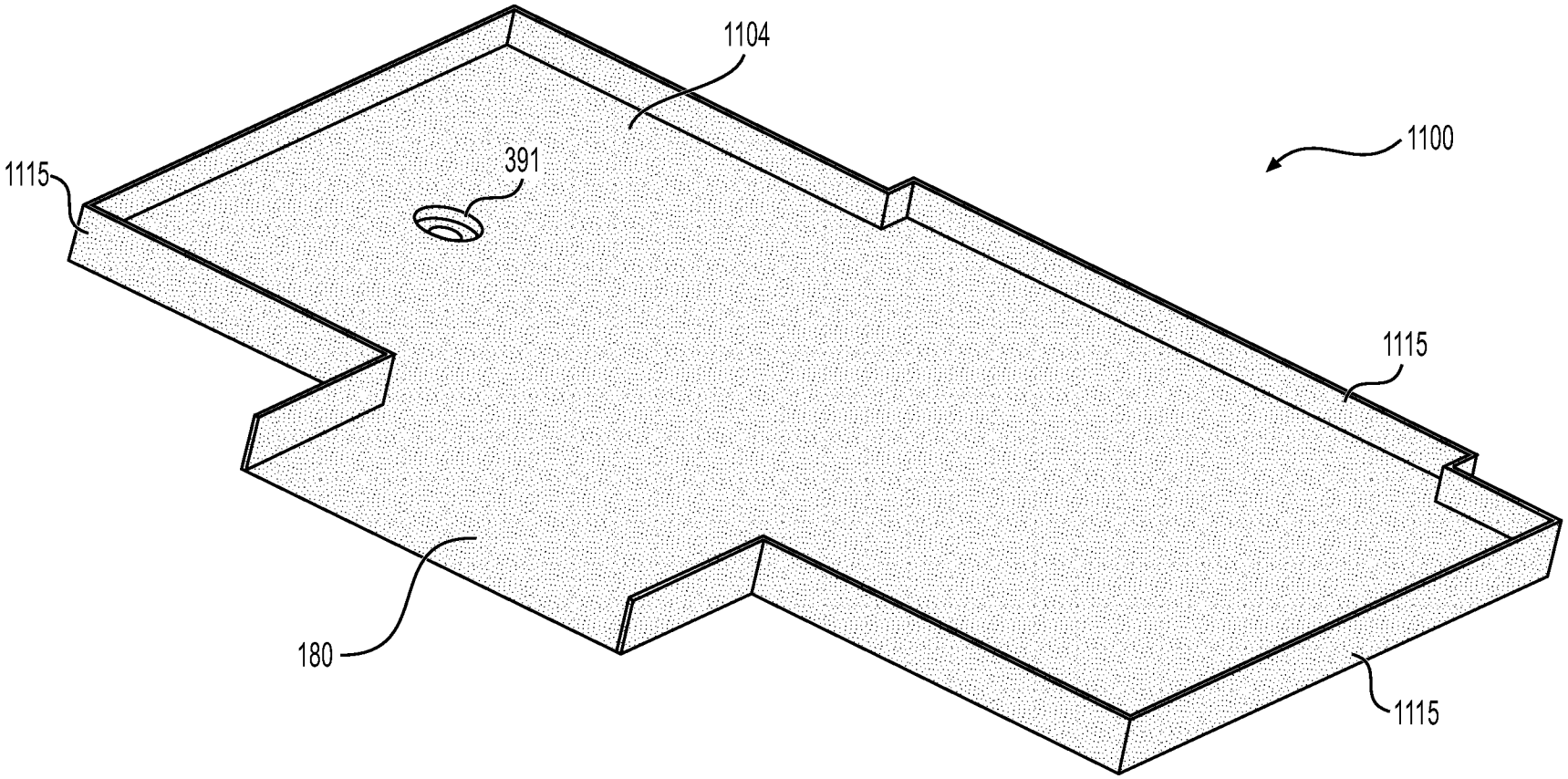
FIG. 34 is a top oriented perspective view of the prefabricated bathroom floor component of FIGS. 27 and 33 after being coated with a waterproof sealant.
Figure 35:
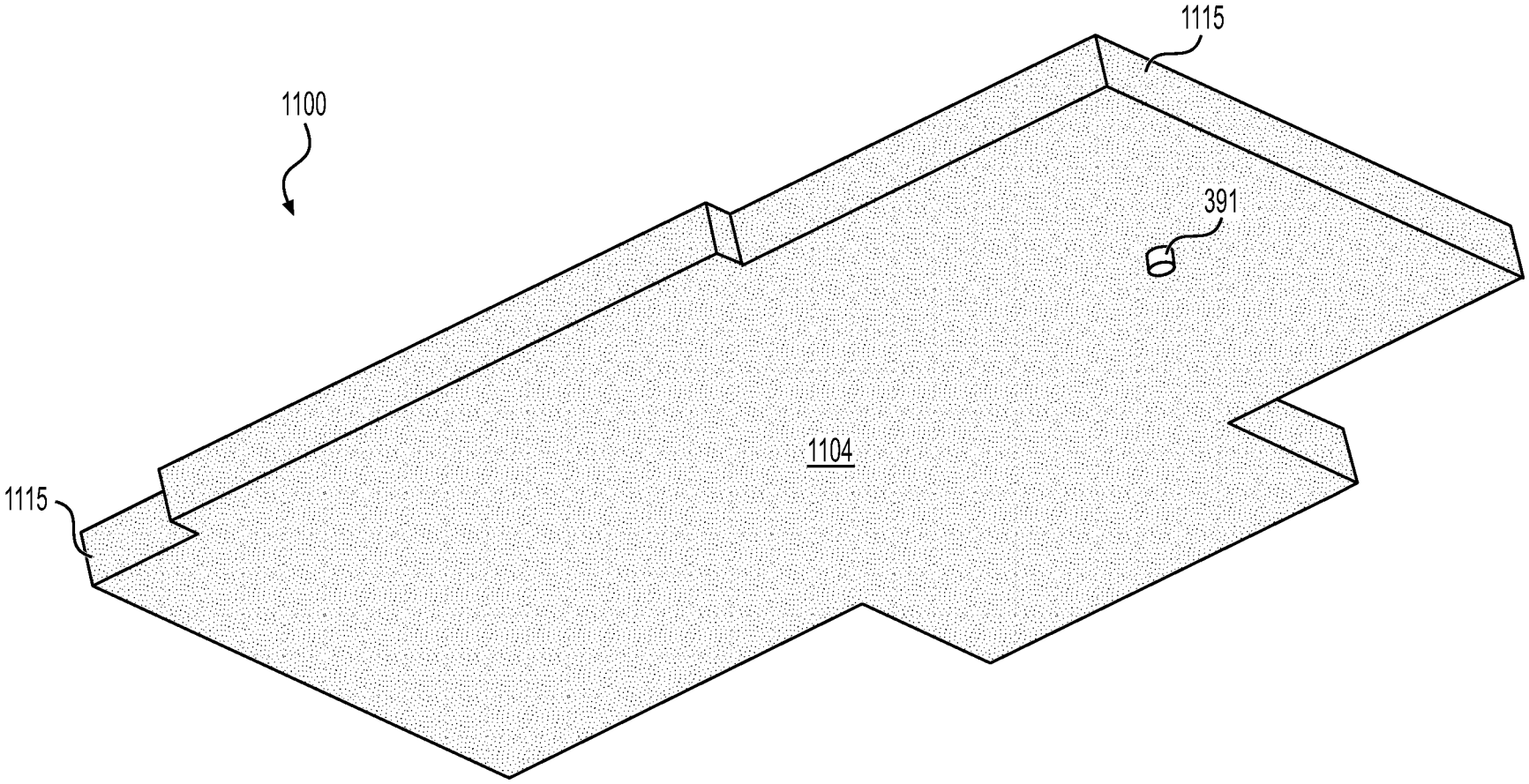
FIG. 35 is a bottom oriented perspective view of the prefabricated bathroom floor component of FIGS. 27 and 33 after being coated with a waterproof sealant.

FIG. 33 is a top perspective view of the shower floor member 1100 of this embodiment. FIG. 34 is the same view as in FIG. 33, but after waterproofing layer 325 has been applied thereto. FIG. 35 is a bottom perspective view thereof after the waterproofing layer 325 has been applied.

Closed Cell Single Panel Material for Floor Panels, for Raised Platform and/or for Both.

Figure 5C:
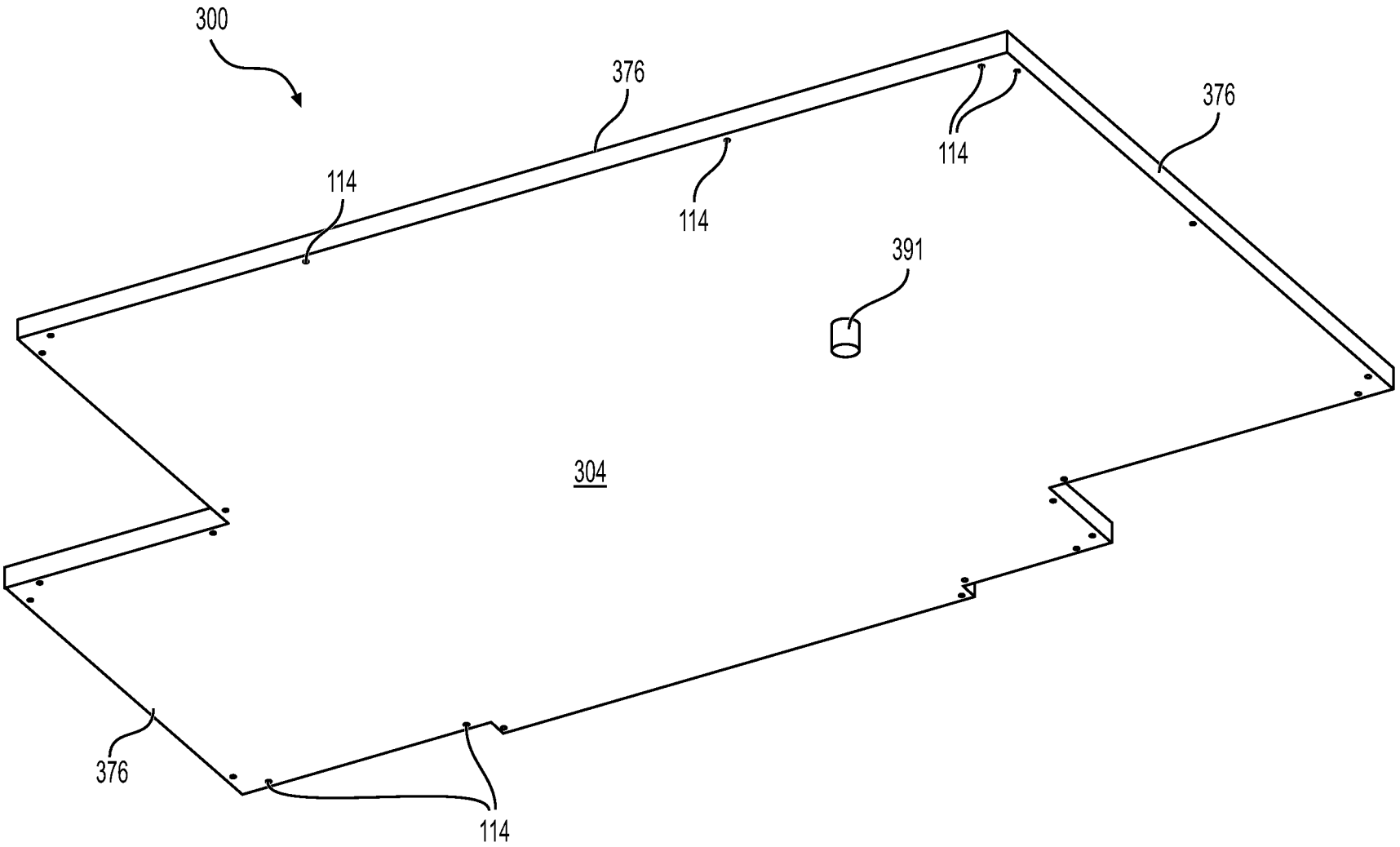
FIG. 5C is a bottom oriented perspective view of the prefabricated bathroom floor component of FIG. 4C.
Figure 5D:
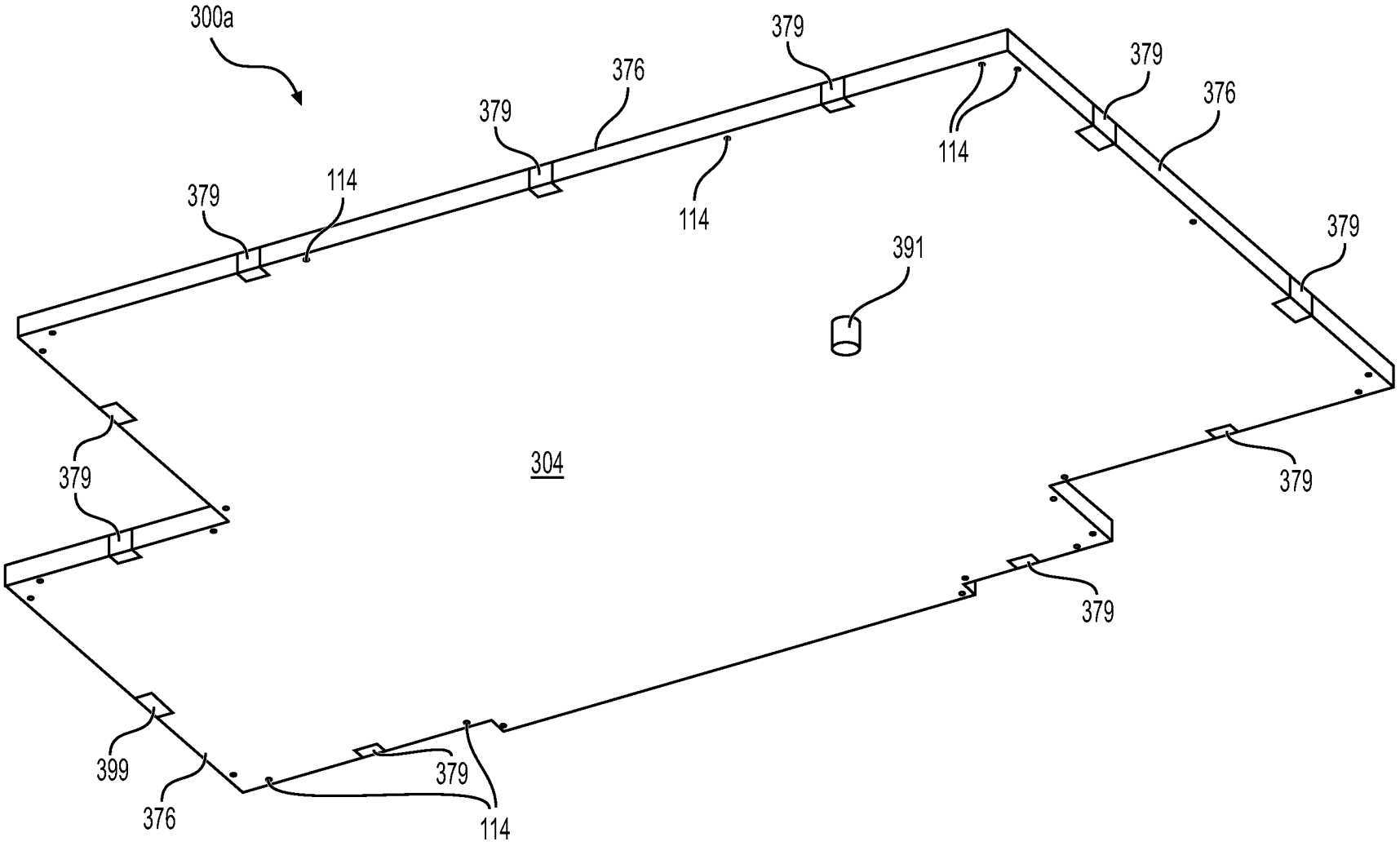
FIG. 5D is a bottom oriented perspective view of the prefabricated bathroom floor component of FIG. 4D.

In embodiments, such as shown in FIGS. 4C and 5C, 8D and E, 11-17B, 18A-18I, and 27-35, the floor member of the bathroom floor component may be comprised of a one-piece floor panel manufactured of a water impervious material. In such cases, the waterproof membrane discussed elsewhere in this disclosure may be unnecessary. In other embodiments, the floor panel may be manufactured of a water impervious material but any raised platform may be made of one or more different materials (including anti-compression elements), and vice versa.

Moreover, in any of the disclosed embodiments, one or more of the additional or alternative features such as the following may be included in the bathroom floor component:

a. one or more additional drains (not shown) may be included in a non-shower area of the bathroom floor member;
b. one or more additional showers (not shown) may be provided in the bathroom pod;
c. one or more non-shower pitched wet areas (such as the intermediate areas 904 in FIGS. 18A and E) may be provided in the bathroom floor component, which is/are designed to become wet and drain water therefrom toward a provided drain;
d. one or more flat bathroom floor areas (such as the area 904 to the far right in FIGS. 18A and E) may be provided anywhere in the bathroom floor component, defined by the floor member;
e. one or more non-shower dry pitched/sloped bathroom floor areas (not shown) may be provided in the bathroom floor component, defined by the floor member; and/or
f. one or more shower benches (not shown) may be provided in the bathroom pod upon which a user may sit, rest a foot, etc.

Strengthening Members.

Strengthening members such as those described throughout this disclosure, including the anti-compressive members, provide support and rigidity for the bathroom floor components. Certain strengthening members are focused exclusively on strengthening the bathroom floor feature of a bathroom floor component. Other strengthening members are focused exclusively on strengthening the raised platform feature of the bathroom floor component. A third category of strengthening members are focused on strengthening both the bathroom floor feature and the raised platform feature of the bathroom floor component.

Strengthening members can comprise any type of material, including but not limited to wood, metal, plastic, concrete, stone, polyurethane, along with any and all other types of structures or apparatus that would be adequate for peripheral or transverse strengthening purposes. These materials may be used individually and in combination with other materials depending upon the specific support requirements of a specific bathroom floor feature and a specific raised platform feature of a specific bathroom floor component.

For the bathroom floor component strengthening members, their support characteristics are specific to where they are located in the bathroom floor component.

For all embodiments, the heads of fasteners 120 are preferably recessed into the respective apertures 114, particular at the bottom of raised platforms 376, 776 and 976, so as not to unnecessarily add to the height of the bathroom floor component. Appropriate weight-dispersing features such as washers and/or bushings 116 may be employed to distribute forces to the extent necessary to avoid cracking or other disturbance in the waterproof layer 325 or any other aspect of the bathroom floor component.

The top surfaces 377, 1077 of the raised support platforms in all embodiments are preferably horizontal. Fasteners and fastener-receiving structures are preferably recessed in the raised platform to maintain a uniformly flat and thin profile.

It is understood that the raised platform is not needed where there is a threshold into the bathroom, such as in the doorways shown in FIGS. 1, 2A, 11 and 12. In embodiments, therefore, the raised platform is provided only where pod walls 104 are provided. In this way, ingress and egress to the bathroom will be unimpeded by the peripheral support platforms 376, 976 and 1076. Also, as stated previously, it is important to note that the height of any raised peripheral support platform disclosed herein in connection with any embodiment can be specified according to the designer or customer to be whatever height desired for a particular application.

Frame member 1050 acts as a strengthening member for both the floor and the raised platform, along with providing strengthening to any other member with which it is associated. In this, resistance to bending, twisting and sagging is provided.

It is also to be understood that bathroom pods manufactured in accordance with the description set forth herein are typically set upon substrates, in many cases concrete slabs, in buildings under construction. It is desired to avoid changes in height when going from the substrate/floor of the building into the prefabricated bathroom pod (for example, at an entrance area 180 of any of the floor members described herein) to avoid tripping and/or to meet various disability codes. In some cases, recesses are provided in such building floor substrates to accommodate the depth necessary for sloped shower floors. The bathroom floors of the present invention, containing one or more drains, in most cases employ floors which slope toward such drain(s). The slope of the floors requires the bottom surfaces of the bathroom floor components disclosed herein to have a certain clearance depth accommodated by the substrate, which in appropriate cases is accomplished by creating a recess in the upper surface of the substrate. Preferably, selecting combined dimensions of the thickness of the floor member of the bathroom floor components, and the depth of any recess(es) in the building floor substrate which the bathroom floor member sits in, results in the upper surface of the finished floor of the bathroom floor component immediately adjacent the bathroom pod entrance being at substantially the same height as the finished floor of the building into which the bathroom pod is being installed immediately adjacent the bathroom pod entrance. Alternatively, the height of the unfinished floor at the bathroom pod entrance may be engineered to be at substantially the same height as the adjacent room.

It will be apparent to those skilled in the art that various modifications and variations can be made to the embodiments of the apparatus and methods of assembly as discussed herein without departing from the scope or spirit of the invention(s). Other embodiments of this disclosure will be apparent to those skilled in the art from consideration of the specification and practice of the various embodiments disclosed herein. For example, some of the equipment may be constructed and function differently than what has been described herein and certain steps of any method may be omitted, performed in an order that is different than what has been specifically mentioned or in some cases performed simultaneously or in sub-steps. Furthermore, variations or modifications to certain aspects or features of various embodiments may be made to create further embodiments and features and aspects of various embodiments may be added to or substituted for other features or aspects of other embodiments in order to provide still further embodiments.

Accordingly, it is intended that the specification and examples be considered as exemplary only, with a true scope and spirit of the invention(s) being indicated by the following claims and their equivalents.

What is claimed is:

1. In a premanufactured bathroom pod adapted to be placed on a floor substrate in a building, the premanufactured bathroom pod having a ceiling and a plurality of walls, a reinforced floor system comprising:

a floor member defining a drain opening and an upper surface, at least a portion of the upper surface being sloped toward the drain opening;

a reinforcing frame associated with the floor member adapted to support the floor member;

a waterproof membrane surrounding one or both of the floor member and the reinforcing frame; the floor member defining a raised peripheral support platform adapted to reside in registry with bottom edges of the walls;

recesses defined by a bottom surface of said floor member adapted to receive the reinforcing frame in substantially nested relation so that a bottom surface of said reinforcing frame is substantially coplanar with the bottom surface of said floor member;

a plurality of spaced apertures defined by said raised platform; and a plurality of spaced apertures defined by said reinforcing frame, said spaced apertures defined by said raised platform being in substantial registry with said spaced apertures defined by said reinforcing frame and adapted to receive fasteners therethrough to attach the reinforced floor system to the walls.

2. The reinforced floor system of claim 1, wherein the floor member is comprised of two or more floor panels.

3. The reinforced floor system of claim 2, further comprising longitudinal strengthening members between and interconnecting the two or more floor panels.

4. The reinforced floor system of claim 1, wherein the floor member is comprised of a first, upper, floor panel and a second, lower, floor panel, the slope of the at least a portion of the upper surface of the floor member being defined by an upper surface of the first, upper floor panel, the recesses being defined by a bottom surface of the second, lower floor panel.

5. The reinforced floor system of claim 1, further comprising compression resisting members integrated into the raised peripheral platform adapted to transfer weight from said walls.

6. The reinforced floor system of claim 5, wherein the compression resisting members are metal bushings situated in said spaced apertures, and further wherein the bushings are hollow and adapted to receive said fasteners.

7. The reinforced floor system of claim 5, wherein the compression resisting members comprise a plurality of spaced apart blocks of material that have higher compression resistance than the raised peripheral support platform.

8. The reinforced floor system of claim 1, wherein the floor member is polyurethane.

9. The reinforced floor system of claim 1, wherein the recesses in, and slope of, the at least a portion of the upper surface of the floor member are CNC milled.

10. The reinforced floor system of claim 1, wherein the floor member includes an entrance area to provide ingress into and egress out of the premanufactured bathroom pod, and wherein an upper surface of the floor member at the entrance area is substantially coplanar with an upper surface of the floor substrate of the building.

11. The reinforced floor system of claim 1, wherein the floor member includes an entrance area to provide ingress into and egress out of the premanufactured bathroom pod, and wherein an upper surface of the floor member at the entrance area is substantially coplanar with an upper surface of the floor substrate of the building.

* * * * *